US010984931B2

(12) United States Patent
Grensing et al.

(10) Patent No.: US 10,984,931 B2
(45) Date of Patent: Apr. 20, 2021

(54) MAGNETIC COPPER ALLOYS

(71) Applicant: Materion Corporation, Mayfield Heights, OH (US)

(72) Inventors: Fritz C. Grensing, Perrysburg, OH (US); W. Raymond Cribb, Westerville, OH (US); Amy E. Craft, Amherst, OH (US); Derrick L. Brown, Hamilton (CA)

(73) Assignee: MATERION CORPORATION, Mayfield Heights, OH (US)

( * ) Notice: Subject to any disclaimer, the term of this patent is extended or adjusted under 35 U.S.C. 154(b) by 869 days.

(21) Appl. No.: 15/074,210

(22) Filed: Mar. 18, 2016

(65) Prior Publication Data

US 2016/0276077 A1 Sep. 22, 2016

Related U.S. Application Data

(60) Provisional application No. 62/169,989, filed on Jun. 2, 2015, provisional application No. 62/134,731, filed on Mar. 18, 2015.

(51) Int. Cl.

| | |
|---|---|
| ***H01F 1/147*** | (2006.01) |
| ***C22C 9/06*** | (2006.01) |
| ***C22F 1/08*** | (2006.01) |
| ***C21D 1/26*** | (2006.01) |
| ***C21D 1/60*** | (2006.01) |
| ***C22C 9/05*** | (2006.01) |
| ***B22D 21/02*** | (2006.01) |
| ***B22D 21/00*** | (2006.01) |

(52) U.S. Cl.

CPC ..... *H01F 1/147* (2013.01); *B22D 21/005* (2013.01); *B22D 21/025* (2013.01); *C21D 1/26* (2013.01); *C21D 1/60* (2013.01); *C22C 9/05* (2013.01); *C22C 9/06* (2013.01); *C22F 1/08* (2013.01)

(58) Field of Classification Search

CPC ..... H01F 1/147; B22D 21/005; B22D 21/025; C21D 1/26; C21D 1/60; C22C 9/05; C22C 9/06; C22F 1/08

USPC ..... 148/101

See application file for complete search history.

(56) References Cited

U.S. PATENT DOCUMENTS

| | | | |
|---|---|---|---|
| 3,772,093 A | 11/1973 | Shapiro et al. | |
| 3,985,589 A | 10/1976 | Shapiro et al. | |
| 4,052,204 A | 10/1977 | Plewes | |

(Continued)

FOREIGN PATENT DOCUMENTS

| | | | |
|---|---|---|---|
| DE | 1281244 B * | 10/1968 | ..... B23K 35/302 |
| KR | 20030000138 A * | 1/2003 | |

(Continued)

OTHER PUBLICATIONS

English language machine translation of DE-1281244 to Mantel. Generated Apr. 29, 2019. (Year: 2019).*

(Continued)

*Primary Examiner* — Brian D Walck

(74) *Attorney, Agent, or Firm* — Cozen O'Connor

(57) ABSTRACT

Magnetic copper-nickel-tin-manganese alloys are disclosed. Also disclosed are processing steps that can be performed for maintaining and/or changing various magnetic or mechanical properties of the alloys. Further described herein are methods for using such an alloy, including various articles produced therefrom.

33 Claims, 70 Drawing Sheets

(56) References Cited

U.S. PATENT DOCUMENTS

| | | | | |
|---|---|---|---|---|
| RE31,180 | E | 3/1983 | Plewes | |
| 5,019,185 | A | 5/1991 | Nakajima et al. | |
| 5,028,282 | A | 7/1991 | Kubozono et al. | |
| 5,288,457 | A | 2/1994 | Boegel | |
| 5,385,618 | A | 1/1995 | Abita | |
| 5,470,373 | A | 11/1995 | Edelstein et al. | |
| 5,516,484 | A | 5/1996 | Kubosono et al. | |
| 5,820,701 | A | 10/1998 | Bhargava | |
| 5,938,864 | A | 8/1999 | Tomikawa et al. | |
| 6,059,901 | A | 5/2000 | Sahu | |
| 6,136,103 | A | 10/2000 | Boegel et al. | |
| 6,149,739 | A | 11/2000 | Smith | |
| 6,346,215 | B1 | 2/2002 | Boegel et al. | |
| 6,695,934 | B1 | 2/2004 | Bhargava | |
| 6,716,292 | B2 | 4/2004 | Nielsen, Jr. et al. | |
| 8,097,208 | B2 | 1/2012 | Smith | |
| 8,308,096 | B2 | 11/2012 | Mirchandani et al. | |
| 8,449,697 | B2 | 5/2013 | Sahu et al. | |
| 8,858,870 | B2 | 10/2014 | Mirchandani et al. | |
| 2002/0007879 | A1 | 1/2002 | Nielsen et al. | |
| 2007/0253858 | A1* | 11/2007 | Ababneh | C22C 1/06 420/487 |
| 2009/0317290 | A1 | 12/2009 | Ababneh et al. | |
| 2011/0011965 | A1* | 1/2011 | Mirchandani | B22F 7/062 241/277 |
| 2014/0294665 | A1 | 10/2014 | Torre et al. | |

FOREIGN PATENT DOCUMENTS

| | | | |
|---|---|---|---|
| RU | 2348720 | C2 | 10/2009 |
| SU | 244624 | A1 | 5/1969 |

OTHER PUBLICATIONS

Totten et al. "Heat Treating of Copper and Copper Alloys." ASM Handbook, vol. 4E, Heat Treating of Nonferrous Alloys. 2016. (Year: 2016).*

English language machine traslation of KR 20030000138 to Kim. Generated Jun. 12, 2020. (Year: 2020).*

Tyler. "Wrought Copper and Copper Alloy Products." ASM Handbook, vol. 2: Properties and Selection: Nonferrous Alloys and Special-Purpose Materials. ASM International. pp. 241-264. 1990. (Year: 1990).*

Jung et al.; Effect of Mn Substitution for Ni on the Microstructures and Properties in Cu—Li x%Ni—y%Mn(x+y=9)-6%Sn Alloys; J. Kor. Inst. Met. & Mater.; vol. 37; No. 10; 1999.

International Search Report and Written Opinion for International Application No. PCT/US2016/023137 dated Jun. 20, 2016.

Russian Search Report for Russian Application No. 2017134706 dated Aug. 28, 2019.

* cited by examiner

FIG. 9

| Material | As-Cast | Homogenize | | | | | 2-Step Homogenize | Homogenize + Hot Upset (~50% Reduction) | | | |
|---|---|---|---|---|---|---|---|---|---|---|---|
| | | 1630°F, 6 hrs + WQ | 1580°F, 6 hrs + WQ | 1525°F, 10 hrs +WQ | 1450°F, 10 hrs + WQ | 1450°F, 14 hrs + WQ | 1450°F, 14 hrs + WQ, + 1525°F, 10 hrs + WQ | 1630°F, 6 hrs + HU + WQ | 1580°F, 6 hrs + HU + WQ | 1525°F, 10 hrs + HU + WQ | 1450°F, 10 hrs + HU + WQ |
| A | Yes | Slight | No | No | Slight | No/ Slight | No | Slight | No | Slight | Yes |
| B | Yes | No | No | No | No | - | - | No | No | No | No |
| C | No | No | No | No | No | - | - | No | No | No | No |
| D | Yes | Yes | Yes | Slight | No | No/ Slight | No/ Slight | Yes | Yes | Slight | Slight |
| E | Yes | No | No | No | No | - | - | No | No | No | No |
| F | Yes | Yes | Yes | Yes | Slight | No | Yes | Yes | Yes | Yes | Slight |
| G | Yes | No | No | No | No | No | No | No | No | No | No |
| H | No | No | No | No | No | - | - | No | No | No | No |

FIG. 10

| Material | Homogenize | | | Homog. + Sol'n Anneal | | Homogenize + Solution Anneal + Age | | | | | |
|---|---|---|---|---|---|---|---|---|---|---|---|
| | 1580°F, 6 hrs + AC | 1540°F, 6 hrs + AC | 1375°F, 16 hrs + AC | SA 1525°F, 2 hrs +WQ | SA 1400°F, 2 hrs +WQ | Age 600°F, 3 hrs +AC | Age 700°F, 3 hrs +AC | Age 800°F, 3 hrs +AC | Age 900°F, 3 hrs +AC | Age 981°F, 3 hrs +AC | Age 1100°F, 3 hrs +AC |
| A | - | Yes | - | No | - | No | No | Yes | Yes | Yes | Yes |
| B | No | - | - | No | - | No | No | Slight | Yes | Yes | Slight |
| C | No | - | - | No | - | No | No | No | No | No | No |
| D | - | - | No | - | No | No | No | Yes | Yes | Yes | Yes |
| E | No | - | - | No | - | No | No | Yes | Yes | Yes | Yes |
| F | - | - | No | - | No | No | No | Yes | Yes | Yes | Yes |
| G | - | - | No | - | No | No | No | Yes | Yes | Yes | Yes |
| H | No | - | - | No | - | No | No | No | No | No | No |

FIG. 11

| Material | Homogenize + Hot Roll (~67% Total Reduction) | Homogenize + Hot Roll + Solution Anneal | | Homogenize + Hot Roll + Solution Anneal + Age | | | | | |
|---|---|---|---|---|---|---|---|---|---|
| | 1580°F, 6 hrs, AC + 1525°F, 2 hrs + HR + 1525°F, 30 min reheat + HR | SA 1525°F, 5 hrs +Fce Cool | SA 1525°F, 5 hrs +WQ* | Age 800°F, 1 hr +AC | Age 800°F, 2 hrs +AC | Age 800°F, 4 hrs +AC | Age 800°F, 8 hrs +AC | Age 800°F, 16 hrs +AC | Age 800°F, 24 hrs +AC |
| A | - | - | - | - | - | - | - | - | - |
| B | No | Slight | Slight | No/Slight | Slight/Yes | Yes | Slight/Yes | Yes | Yes |
| C | No | No | No | No | No | No | No | No | No |
| D | - | - | - | - | - | - | - | - | - |
| E | Slight | Yes | Yes | Slight | Yes | Yes | Yes | Yes | Yes |
| F | - | - | - | - | - | - | - | - | - |
| G | Slight | Yes | Yes | No/Slight | Yes | Yes | Yes | Yes | Yes |
| H | No | No | No | No | No | No | No | No | No |

FIG. 12

| Material | Homog. + HR + Solution Anneal | Homogenize + Hot Roll + Solution Anneal + Age | | | | | |
|---|---|---|---|---|---|---|---|
| | various | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | No | No | No | Yes | Yes | Yes | Yes |
| B | No | No | No | Yes | Yes | Yes | Slight |
| C | No | No | No | No | No | No | No |
| D | Yes | Yes | Yes | Yes | Yes | Yes | Yes |
| E | No | Slight | No | Yes | Yes | Yes | Yes |
| F | Yes | Yes | Yes | Yes | Yes | Yes | Yes |
| G | Yes | Yes | Yes | Yes | Yes | Yes | Yes |
| H | No | No | No | No | No | No | No |

FIG. 13

| Material | Homog.+ HR + SA + Cold Roll | | Homogenize + Hot Roll + Sol'n Anneal + Cold Roll + Age (21% CR) | | | | | |
|---|---|---|---|---|---|---|---|---|
| | 21% CR ("½ H") | 37% CR ("H") | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | No | No | Slight | Yes | Yes | Yes | Yes | Yes |
| B | No | No | No | Slight | Yes | Yes | Yes | Slight |
| C | No | No | No | No | No | No | No | No |
| D | Yes | Yes | Yes | Yes | Yes | Yes | Yes | Yes |
| E | No | No | Slight | Yes | Yes | Yes | Yes | Yes |
| F | Yes | Slight | Yes | Yes | Yes | Yes | Yes | Yes |
| G | Slight | Slight | Yes | Yes | Yes | Yes | Yes | Yes |
| H | No | No | No | No | No | No | No | No |

FIG. 14

| Material | Homogenize + Hot Roll + Sol'n Anneal + Cold Roll + Age (37% CR) | | | | | |
|---|---|---|---|---|---|---|
| | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | Slight | Yes | Yes | Yes | Yes | Yes |
| B | No | Yes | Yes | Yes | Yes | Slight |
| C | No | No | No | No | No | No |
| D | Yes | Yes | Yes | Yes | Yes | Yes |
| E | Slight | Yes | Yes | Yes | Yes | Yes |
| F | Yes | Yes | Yes | Yes | Yes | Yes |
| G | Yes | Yes | Yes | Yes | Yes | Yes |
| H | No | No | No | No | No | No |

FIG. 15

| Material | Homogenize + Extrude (88%) | Homogenize + Extrude + Solution Anneal | | | | | | | |
|---|---|---|---|---|---|---|---|---|---|
| | Various | SA 1295°F, 2 hrs + WQ | SA 1335°F, 2 hrs + WQ | SA 1385°F, 2 hrs + WQ | SA 1400°F, 2 hrs + WQ | SA 1430°F, 2 hrs + WQ | SA 1480°F, 2 hrs + WQ | SA 1520°F, 2 hrs + WQ | SA 1570°F, 2 hrs + WQ |
| A | Yes | Yes | Yes | Yes | - | Yes | Slight | No | No |
| B | No | No | No | No | - | No | No | No | No |
| C | No | No | No | No | - | No | No | No | No |
| D | Yes | Yes | Yes | Slight/Yes | - | Slight | Slight | No | No |
| E | No | No | No | No | No | No | No | No | No |
| F | Yes | Yes | Slight | Slight/Yes | - | Slight | Slight | No | No |
| G | No | Yes | No | No | No | No | No | No | No |
| H | No | No | No | No | - | No | No | No | No |
| J | No | - | - | - | No | - | - | - | - |

FIG. 16

| Material | As-Cast | Homogenize | | | | | 2-Step Homogenize | Homogenize + Hot Upset (~50% Reduction) | | | |
|---|---|---|---|---|---|---|---|---|---|---|---|
| | | 1630°F, 6 hrs + WQ | 1580°F, 6 hrs + WQ | 1525°F, 10 hrs +WQ | 1450°F, 10 hrs + WQ | 1450°F, 14 hrs + WQ | 1450°F, 14 hrs + WQ, + 1525°F, 10 hrs + WQ | 1630°F, 6 hrs + HU + WQ | 1580°F, 6 hrs + HU + WQ | 1525°F, 10 hrs + HU + WQ | 1450°F, 10 hrs + HU + WQ |
| A | > 1.999 | 1.005 | 1.004 | 1.005 | 1.029 | | | | | | |
| B | > 1.999 | 1.005 | 1.005 | 1.003 | 1.000 | | | | | | |
| C | 1.000 | 1.005 | 1.005 | 1.000 | 1.001 | | | | | | |
| D | > 1.999 | > 1.999 | > 1.999 | 1.025 | 1.004 | | | | | | |
| E | > 1.999 | 1.005 | 1.001 | 1.001 | 1.002 | | | | | | |
| F | > 1.999 | > 1.999 | > 1.999 | 1.054 | 1.002 | | | | | | |
| G | > 1.999 | 1.004 | 1.004 | 1.002 | 1.002 | | | | | | |
| H | 1.005 | 1.005 | 1.005 | 1.000 | 1.000 | | | | | | |

FIG. 17

| Material | Homogenize | | | Homog. + Sol'n Anneal | | Homogenize + Solution Anneal + Age | | | | | |
|---|---|---|---|---|---|---|---|---|---|---|---|
| | 1580°F, 6 hrs + AC | 1540°F, 6 hrs + AC | 1375°F, 16 hrs + AC | SA 1525°F, 2 hrs +WQ | SA 1400°F, 2 hrs +WQ | Age 600°F, 3 hrs +AC | Age 700°F, 3 hrs +AC | Age 800°F, 3 hrs +AC | Age 900°F, 3 hrs +AC | Age 981°F, 3 hrs +AC | Age 1100°F, 3 hrs +AC |
| A | N/A | N/A | N/A | 1.006 | - | 1.007 | 1.042 | 1.430 | 1.990 | 1.590 | 1.450 |
| B | N/A | N/A | N/A | 1.001 | - | 1.001 | 1.006 | 1.185 | 1.145 | 1.029 | 1.007 |
| C | N/A | N/A | N/A | 1.000 | - | 1.001 | 1.001 | 1.000 | 1.001 | 1.001 | 1.001 |
| D | N/A | N/A | N/A | - | 1.004 | 1.005 | 1.045 | 1.310 | > 1.999 | 1.524 | 1.950 |
| E | N/A | N/A | N/A | 1.001 | - | 1.001 | 1.017 | 1.162 | 1.900 | 1.630 | 1.895 |
| F | N/A | N/A | N/A | - | 1.003 | 1.004 | 1.021 | 1.333 | 1.666 | 1.230 | 1.985 |
| G | N/A | N/A | N/A | - | 1.001 | 1.003 | 1.020 | 1.236 | > 1.999 | 1.885 | 1.925 |
| H | N/A | N/A | N/A | 1.000 | - | 1.001 | 1.000 | 1.001 | 1.001 | 1.000 | 1.000 |

FIG. 18

| Material | Homogenize + Hot Roll (~67% Total Reduction) | Homogenize + Hot Roll + Solution Anneal | | Homogenize + Hot Roll + Solution Anneal* + Age | | | | | |
|---|---|---|---|---|---|---|---|---|---|
| | 1580°F, 6 hrs, AC + 1525°F, 2 hrs + HR + 1525°F, 30 min reheat + HR | SA 1525°F, 5 hrs +Fce Cool | SA 1525°F, 5 hrs +WQ* | Age 800°F, 1 hr +AC | Age 800°F, 2 hrs +AC | Age 800°F, 4 hrs +AC | Age 800°F, 8 hrs +AC | Age 800°F, 16 hrs +AC | Age 800°F, 24 hrs +AC |
| A | - | - | - | - | - | - | - | - | - |
| B | | | | 1.025 | 1.067 | 1.524 | 1.551 | 1.449 | 1.973 |
| C | | | | 1.001 | 1.001 | 1.002 | 1.002 | 1.002 | 1.002 |
| D | - | - | - | - | - | - | - | - | - |
| E | | | | 1.115 | 1.242 | 1.915 | 1.978 | 1.480 | 1.694 |
| F | - | - | - | - | - | - | - | - | - |
| G | | | | 1.103 | 1.485 | 1.034 | 1.862 | 1.278 | 1.125 |
| H | | | | 1.001 | 1.001 | 1.001 | 1.001 | 1.001 | 1.001 |

FIG. 19

| Material | Homog. + HR + Solution Anneal | Homogenize + Hot Roll + Solution Anneal + Age | | | | | |
|---|---|---|---|---|---|---|---|
| | Various | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 1.007 | 1.013 | 1.029 | 1.684 | > 1.999 | > 1.999 | 1.679 |
| B | 1.000 | 1.003 | 1.009 | 1.256 | 1.234 | 1.015 | 1.002 |
| C | 1.001 | 1.001 | 1.001 | 1.001 | 1.001 | 1.001 | 1.001 |
| D | 1.159 | 1.118 | 1.206 | 1.243 | 1.371 | 1.856 | 1.763 |
| E | 1.001 | 1.003 | 1.012 | 1.217 | 1.281 | 1.903 | 1.750 |
| F | 1.049 | 1.054 | 1.326 | 1.402 | 1.485 | 1.649 | > 1.999 |
| G | 1.167 | 1.245 | 1.096 | 1.620 | > 1.999 | 1.736 | 1.795 |
| H | 1.000 | 1.002 | 1.001 | 1.000 | 1.000 | 1.001 | 1.000 |

FIG. 20

| Material | Homog.+ HR + SA + Cold Roll | | Homogenize + Hot Roll + Sol'n Anneal + Cold Roll + Age (21% CR) | | | | | |
|---|---|---|---|---|---|---|---|---|
| | 21% CR ("½ H") | 37% CR ("H") | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 1.002 | 1.002 | 1.015 | 1.904 | > 1.999 | > 1.999 | 1.762 | 1.501 |
| B | 1.001 | 1.001 | 1.002 | 1.009 | 1.721 | 1.049 | 1.011 | 1.007 |
| C | 1.001 | 1.000 | 1.001 | 1.002 | 1.001 | 1.001 | 1.001 | 1.001 |
| D | 1.090 | 1.091 | 1.124 | 1.713 | > 1.999 | > 1.999 | 1.512 | 1.513 |
| E | 1.001 | 1.001 | 1.014 | 1.392 | 1.941 | 1.972 | 1.756 | 1.843 |
| F | 1.034 | 1.020 | 1.101 | 1.407 | > 1.999 | > 1.999 | 1.544 | 1.836 |
| G | 1.024 | 1.036 | 1.054 | 1.678 | 1.869 | 1.675 | 1.482 | 1.505 |
| H | 1.001 | 1.000 | 1.001 | 1.001 | 1.000 | 1.000 | 1.000 | 1.001 |

FIG. 21

| Material | Homogenize + Hot Roll + Sol'n Anneal + Cold Roll + Age (37% CR) | | | | | |
|---|---|---|---|---|---|---|
| | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 1.031 | 1.916 | > 1.999 | > 1.999 | 1.702 | 1.291 |
| B | 1.008 | 1.197 | 1.746 | 1.034 | 1.013 | 1.004 |
| C | 1.001 | 1.002 | 1.001 | 1.002 | 1.001 | 1.001 |
| D | 1.128 | 1.751 | > 1.999 | 1.681 | 1.456 | 1.432 |
| E | 1.038 | 1.510 | 1.691 | >1.999 | 1.584 | 1.607 |
| F | 1.076 | 1.712 | 1.913 | 1.067 | 1.431 | 1.901 |
| G | 1.176 | 1.718 | 1.883 | 1.671 | 1.507 | 1.328 |
| H | 1.001 | 1.000 | 1.000 | 1.000 | 1.001 | 1.001 |

FIG. 22

| Material | Homogenize + Extrude + Solution Anneal | | | | | | |
|---|---|---|---|---|---|---|---|
| | SA 1295°F, 2 hrs + WQ | SA 1335°F, 2 hrs + WQ | SA 1385°F, 2 hrs + WQ | SA 1430°F, 2 hrs + WQ | SA 1480°F, 2 hrs + WQ | SA 1520°F, 2 hrs + WQ | SA 1570°F, 2 hrs + WQ |
| A | 1.893 | 1.633 | 1.410 | 1.270 | 1.083 | 1.030 | 1.006 |
| B | 1.002 | 1.001 | 1.001 | 1.001 | 1.002 | 1.002 | 1.002 |
| C | 1.000 | 1.000 | 1.000 | 1.000 | 1.000 | 1.000 | 1.000 |
| D | - | - | - | - | - | - | - |
| E | 1.002 | 1.002 | 1.002 | 1.002 | 1.001 | 1.002 | 1.002 |
| F | - | - | - | - | - | - | - |
| G | 1.208 | 1.010 | 1.002 | 1.001 | 1.001 | 1.001 | 1.002 |
| H | 1.000 | 1.000 | 1.000 | 1.000 | 1.000 | 1.000 | 1.000 |

FIG. 23

| Material | As-Cast | Homogenize | | | | | 2-Step Homog. | Homogenize + Hot Upset (~50% Reduction) | | | |
|---|---|---|---|---|---|---|---|---|---|---|---|
| | | 1630° F, 6 hrs + WQ | 1580° F, 6 hrs + WQ | 1525° F, 10 hrs +WQ | 1450° F, 10 hrs + WQ | 1450° F, 14 hrs + WQ | 1450°F, 14 hrs + WQ, + 1525°F, 10 hrs + WQ | 1630° F, 6 hrs + HU + WQ | 1580°F , 6 hrs + HU + WQ | 1525°F , 10 hrs + HU + WQ | 1450°F , 10 hrs + HU + WQ |
| A | < 0.80 | 2.39 | 2.69 | 2.76 | < 0.80 | 2.25 | 2.72 | | | | |
| B | 4.52 | 4.07 | 4.07 | 4.12 | 4.10 | - | - | | | | |
| C | 6.68 | 5.25 | 5.26 | 5.24 | 5.28 | - | - | | | | |
| D | < 0.80 | < 0.80 | < 0.80 | 1.60 | 1.77 | 1.75 | 1.66 | | | | |
| E | < 0.80 | 4.88 | 4.90 | 4.90 | 4.98 | - | - | | | | |
| F | < 0.80 | < 0.80 | < 0.80 | < 0.80 | 1.87 | 1.72 | < 0.80 | | | | |
| G | < 0.80 | 3.78 | 3.79 | 3.81 | 3.79 | 3.84 | 3.86 | | | | |
| H | 6.64 | 6.29 | 6.32 | 6.32 | 6.45 | - | - | | | | |

FIG. 24

| Material | Homogenize | | | Homog. + Sol'n Anneal | | Homogenize + Solution Anneal + Age | | | | | |
|---|---|---|---|---|---|---|---|---|---|---|---|
| | 1580°F, 6 hrs + AC | 1540°F, 6 hrs + AC | 1375°F, 16 hrs + AC | SA 1525°F, 2 hrs +WQ | SA 1400°F, 2 hrs +WQ | Age 600°F, 3 hrs +AC | Age 700°F, 3 hrs +AC | Age 800°F, 3 hrs +AC | Age 900°F, 3 hrs +AC | Age 981°F, 3 hrs +AC | Age 1100°F, 3 hrs +AC |
| A | - | < 0.80 | - | 2.77 | - | 2.87 | 2.60 | < 0.80 | < 0.80 | < 0.80 | < 0.80 |
| B | 4.16 | - | - | 4.02 | - | 4.51 | 4.43 | 4.08 | < 0.80 | 5.93 | 5.90 |
| C | 5.45 | - | - | 5.25 | - | 5.90 | 6.40 | 6.45 | 7.23 | 8.06 | 7.63 |
| D | - | - | 1.91 | - | 1.95 | 1.94 | 1.84 | 1.75 | < 0.80 | < 0.80 | < 0.80 |
| E | 4.90 | - | - | 4.93 | - | 5.19 | 4.94 | 4.76 | < 0.80 | < 0.80 | < 0.80 |
| F | - | - | 1.95 | - | 1.92 | 1.92 | 1.90 | 1.58 | < 0.80 | < 0.80 | < 0.80 |
| G | - | - | 3.84 | - | 3.86 | 3.88 | 3.67 | 3.58 | < 0.80 | < 0.80 | < 0.80 |
| H | 6.78 | - | - | 6.33 | - | 7.12 | 7.90 | 8.61 | 10.10 | 9.79 | 9.36 |

FIG. 25

| Material | Homogenize + Hot Roll (~67% Total Reduction) | Homogenize + Hot Roll + Solution Anneal | | Homogenize + Hot Roll + Solution Anneal* + Age | | | | | |
|---|---|---|---|---|---|---|---|---|---|
| | 1580°F, 6 hrs, AC + 1525°F, 2 hrs + HR + 1525°F, 30 min reheat + HR | SA 1525°F, 5 hrs +Fce Cool | SA 1525°F, 5 hrs +WQ* | Age 800°F, 1 hr +AC | Age 800°F, 2 hrs +AC | Age 800°F, 4 hrs +AC | Age 800°F, 8 hrs +AC | Age 800°F, 16 hrs +AC | Age 800°F, 24 hrs +AC |
| A | - | - | - | - | - | - | - | - | - |
| B | | | | 4.27 | 4.05 | < 0.80 | 4.37 | < 0.80 | < 0.80 |
| C | | | | 6.31 | 6.46 | 6.70 | 6.97 | 7.30 | 7.84 |
| D | - | - | - | - | - | - | - | - | - |
| E | | | | 4.70 | 4.49 | 4.01 | < 0.80 | < 0.80 | < 0.80 |
| F | - | - | - | - | - | - | - | - | - |
| G | | | | 3.79 | 3.53 | 3.18 | < 0.80 | < 0.80 | < 0.80 |
| H | | | | 8.08 | 9.31 | 10.5 | 11.4 | 11.6 | 11.7 |

FIG. 26

| Material | Homog. + HR + Solution Anneal | Homogenize + Hot Roll + Solution Anneal + Age | | | | | |
|---|---|---|---|---|---|---|---|
| | various | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 2.84 | 2.94 | 2.79 | < 0.80 | < 0.80 | < 0.80 | < 0.80 |
| B | 4.11 | 4.83 | 4.74 | 3.95 | < 0.80 | 6.51 | 5.06 |
| C | 5.37 | 6.30 | 6.49 | 6.64 | 8.83 | 8.49 | 7.72 |
| D | < 0.80 | < 0.80 | < 0.80 | < 0.80 | < 0.80 | < 0.80 | < 0.80 |
| E | 4.99 | 5.43 | 5.21 | 4.57 | < 0.80 | < 0.80 | < 0.80 |
| F | 1.52 | 1.56 | 1.56 | < 0.80 | < 0.80 | < 0.80 | < 0.80 |
| G | < 0.80 | < 0.80 | < 0.80 | < 0.80 | < 0.80 | < 0.80 | < 0.80 |
| H | 6.39 | 7.29 | 7.88 | 10.9 | 10.7 | 10.2 | 9.45 |

FIG. 27

| Material | Homog.+ HR + SA + Cold Roll | | Homogenize + Hot Roll + Sol'n Anneal + Cold Roll + Age (21% CR) | | | | | |
|---|---|---|---|---|---|---|---|---|
| | 21% CR ("½ H") | 37% CR ("H") | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 2.80 | 2.80 | 2.84 | < 0.80 | < 0.80 | < 0.80 | < 0.80 | < 0.80 |
| B | 4.14 | 4.11 | 4.50 | 4.49 | < 0.80 | 5.85 | 6.33 | 6.05 |
| C | 5.29 | 5.29 | 5.77 | 6.41 | 7.18 | 8.80 | 8.54 | 7.86 |
| D | < 0.80 | 1.68 | < 0.80 | < 0.80 | < 0.80 | < 0.80 | < 0.80 | < 0.80 |
| E | 4.89 | 4.86 | 5.25 | < 0.80 | < 0.80 | 4.71 | < 0.80 | < 0.80 |
| F | 1.67 | 1.80 | < 0.80 | < 0.80 | < 0.80 | < 0.80 | < 0.80 | < 0.80 |
| G | 3.73 | 3.31 | 3.70 | < 0.80 | < 0.80 | < 0.80 | < 0.80 | < 0.80 |
| H | 6.37 | 6.16 | 6.92 | 7.70 | 9.83 | 10.2 | 9.67 | 9.13 |

FIG. 28

| Material | Homogenize + Hot Roll + Sol'n Anneal + Cold Roll + Age (37% CR) | | | | | |
|---|---|---|---|---|---|---|
| | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 2.74 | < 0.80 | < 0.80 | < 0.80 | < 0.80 | < 0.80 |
| B | 4.55 | < 0.80 | < 0.80 | 6.05 | 6.70 | 6.37 |
| C | 5.93 | 6.65 | 7.91 | 8.89 | 8.59 | 7.96 |
| D | < 0.80 | < 0.80 | < 0.80 | < 0.80 | < 0.80 | < 0.80 |
| E | 5.06 | < 0.80 | < 0.80 | 4.59 | < 0.80 | < 0.80 |
| F | < 0.80 | < 0.80 | < 0.80 | < 0.80 | < 0.80 | < 0.80 |
| G | < 0.80 | < 0.80 | < 0.80 | < 0.80 | < 0.80 | < 0.80 |
| H | 7.11 | 8.32 | 11.4 | 10.7 | 10.1 | 9.30 |

FIG. 29

| Material | Homogenize + Extrude | Homogenize + Extrude + Solution Anneal | | | | | | |
|---|---|---|---|---|---|---|---|---|
| | Homog 1580°F, 6 hrs, AC + 1525°F, 6 hrs min + Extrude | SA 1295°F, 2 hrs + WQ | SA 1335°F, 2 hrs + WQ | SA 1385°F, 2 hrs + WQ | SA 1430°F, 2 hrs + WQ | SA 1480°F, 2 hrs + WQ | SA 1520°F, 2 hrs + WQ | SA 1570°F, 2 hrs + WQ |
| A | < 0.80 | < 0.80 | < 0.80 | < 0.80 | < 0.80 | 2.50 | 2.77 | 2.81 |
| B | 4.35 | 4.24 | 4.40 | 4.39 | 4.14 | 4.11 | 4.12 | 4.12 |
| C | 5.77 | 5.63 | 5.67 | 5.55 | 5.39 | 5.31 | 5.31 | 5.34 |
| D | - | - | - | - | - | - | - | - |
| E | 4.95 | 4.86 | 4.80 | 4.95 | 4.96 | 4.94 | 4.96 | 4.99 |
| F | - | - | - | - | - | - | - | - |
| G | 3.84 | < 0.80 | 3.77 | 3.84 | 3.84 | 3.85 | 3.86 | 3.87 |
| H | 6.77 | 7.65 | 7.10 | 7.10 | 6.58 | 6.36 | 6.35 | 6.37 |

FIG. 30

| Material | As-Cast | Homogenize | | | | | 2-Step Homog. | Homogenize + Hot Upset (~50% Reduction) | | | |
|---|---|---|---|---|---|---|---|---|---|---|---|
| | | 1630°F, 6 hrs + WQ | 1580°F, 6 hrs + WQ | 1525°F, 10 hrs +WQ | 1450°F, 10 hrs + WQ | 1450°F, 14 hrs + WQ | 1450°F, 14 hrs + WQ, + 1525°F, 10 hrs + WQ | 1630°F, 6 hrs + HU + WQ | 1580°F, 6 hrs + HU + WQ | 1525°F, 10 hrs + HU + WQ | 1450°F, 10 hrs + HU + WQ |
| A | 97.9 HRB | 57.5 HRB | 62.8 HRB | 62.4 HRB | 64.2 HRB | 64.5 HRB | 62.4 HRB | N/A | N/A | N/A | N/A |
| B | 94.7 HRB | 59.9 HRB | 58.8 HRB | 51.2 HRB | 59.3 HRB | - | - | N/A | N/A | N/A | N/A |
| C | 98.8 HRB | 57.9 HRB | 54.4 HRB | 54.6 HRB | 57.6 HRB | - | - | N/A | N/A | N/A | N/A |
| D | 69.5 HRB | 75.6 HRB | 66.6 HRB | 48.1 HRB | 51.8 HRB | 56.1 HRB | 53.0 HRB | N/A | N/A | N/A | N/A |
| E | 87.4 HRB | 53.5 HRB | 51.8 HRB | 48.5 HRB | 50.9 HRB | - | - | N/A | N/A | N/A | N/A |
| F | 64.8 HRB | 63.4 HRB | 69.4 HRB | 45.1 HRB | 46.0 HRB | 49.0 HRB | 58.3 HRB | N/A | N/A | N/A | N/A |
| G | 79.1 HRB | 47.9 HRB | 44.4 HRB | 44.8 HRB | 62.9 HRB | 47.4 HRB | 49.0 HRB | N/A | N/A | N/A | N/A |
| H | 93.4 HRB | 76.0 HRB | 63.6 HRB | 62.8 HRB | 49.0 HRB | - | - | N/A | N/A | N/A | N/A |

FIG. 31

| Material | Homogenize | | | Homog. + Sol'n Anneal | | Homogenize + Solution Anneal + Age | | | | | |
|---|---|---|---|---|---|---|---|---|---|---|---|
| | 1580°F, 6 hrs + AC | 1540°F, 6 hrs + AC | 1375°F, 16 hrs + AC | SA 1525°F, 2 hrs +WQ | SA 1400°F, 2 hrs +WQ | Age 600°F, 3 hrs +AC | Age 700°F, 3 hrs +AC | Age 800°F, 3 hrs +AC | Age 900°F, 3 hrs +AC | Age 981°F, 3 hrs +AC | Age 1100°F, 3 hrs +AC |
| A | - | 77.2 HRB | - | 69.1 HRB | - | 80.6 HRB | 76.2 HRB | 100.8 HRB | 102.8 HRB | 21.4 HRC | 95.8 HRB |
| B | 76.1 HRB | - | - | 62.2 HRB | - | 89.5 HRB | 95.6 HRB | 100.6 HRB | 101.0 HRB | 97.0 HRB | 91.8 HRB |
| C | 74.2 HRB | - | - | 62.4 HRB | - | 94.0 HRB | 101.8 HRB | 31.9 HRC | 103.2 HRB | 96.3 HRB | 90.1 HRB |
| D | - | - | 61.2 HRB | - | 61.3 HRB | 65.7 HRB | 66.3 HRB | 80.9 HRB | 97.4 HRB | 97.4 HRB | 92.6 HRB |
| E | 59.4 HRB | - | - | 54.6 HRB | - | 67.6 HRB | 59.0 HRB | 68.5 HRB | 88.8 HRB | 85.1 HRB | 83.7 HRB |
| F | - | - | 54.2 HRB | - | 58.5 HRB | 58.9 HRB | 60.0 HRB | 79.4 HRB | 94.9 HRB | 95.9 HRB | 90.4 HRB |
| G | - | - | 53.8 HRB | - | 52.8 HRB | 62.0 HRB | 59.0 HRB | 75.5 HRB | 95.1 HRB | 93.8 HRB | 88.5 HRB |
| H | 83.0 HRB | - | - | 67.6 HRB | - | 95.2 HRB | 32.6 HRC | 37.5 HRC | 94.0 HRB | 91.9 HRB | 87.5 HRB |

FIG. 32

| Material | Homogenize + Hot Roll (~67% Total Reduction) | Homogenize + Hot Roll + Solution Anneal | | Homogenize + Hot Roll + Solution Anneal* + Age | | | | | |
|---|---|---|---|---|---|---|---|---|---|
| | 1580°F, 6 hrs, AC + 1525°F, 2 hrs + HR + 1525°F, 30 min reheat + HR | SA 1525°F, 5 hrs +Fce Cool | SA 1525°F, 5 hrs +WQ* | Age 800°F, 1 hr +AC | Age 800°F, 2 hrs +AC | Age 800°F, 4 hrs +AC | Age 800°F, 8 hrs +AC | Age 800°F, 16 hrs +AC | Age 800°F, 24 hrs +AC |
| A | - | - | - | - | - | - | - | - | - |
| B | | | | 93.6 HRB | 94.4 HRB | 97.7 HRB | 37.7 HRC | 35.5 HRC | 34.0 HRC |
| C | | | | 29.7 HRC | 28.8 HRC | 30.9 HRC | 32.9 HRC | 30.6 HRC | 33.3 HRC |
| D | - | - | - | - | - | - | - | - | - |
| E | | | | 76.4 HRB | 81.3 HRB | 89.8 HRB | 90.3 HRB | 98.6 HRB | 99.3 HRB |
| F | - | - | - | - | - | - | - | - | - |
| G | | | | 64.2 HRB | 80.8 HRB | 85.0 HRB | 100.9 HRB | 100.3 HRB | 94.1 HRB |
| H | | | | 33.3 HRC | 31.1 HRC | 90.3 HRB | 98.1 HRB | 94.7 HRB | 95.5 HRB |

FIG. 33

| Material | Homog. + HR + Solution Anneal | Homogenize + Hot Roll + Solution Anneal + Age | | | | | |
|---|---|---|---|---|---|---|---|
| | various | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 62.3 HRB | 86.2 HRB | 76.3 HRB | 96.6 HRB | 31.3 HRC | 100.4 HRB | 95.9 HRB |
| B | 64.5 HRB | 94.1 HRB | 96.3 HRB | 28.8 HRC | 102.6 HRB | 97.3 HRB | 92.6 HRB |
| C | 65.0 HRB | 96.5 HRB | 101.0 HRB | 31.3 HRC | 26.1 HRC | 95.0 HRB | 87.8 HRB |
| D | 76.1 HRB | 79.5 HRB | 78.5 HRB | 91.6 HRB | 88.5 HRB | 89.5 HRB | 89.0 HRB |
| E | 54.2 HRB | 73.2 HRB | 60.2 HRB | 71.8 HRB | 92.6 HRB | 87.3 HRB | 83.5 HRB |
| F | 72.0 HRB | 71.9 HRB | 70.9 HRB | 83.8 HRB | 89.3 HRB | 90.8 HRB | 86.6 HRB |
| G | 77.8 HRB | 84.2 HRB | 87.2 HRB | 95.8 HRB | 94.0 HRB | 90.8 HRB | 85.6 HRB |
| H | 66.5 HRB | 95.4 HRB | 30.1 HRC | 101.1 HRB | 97.4 HRB | 91.0 HRB | 86.4 HRB |

FIG. 34

| Material | Homog.+ HR + SA + Cold Roll | | Homogenize + Hot Roll + Sol'n Anneal + Cold Roll + Age (21% CR) | | | | | |
|---|---|---|---|---|---|---|---|---|
| | 21% CR ("½ H") | 37% CR ("H") | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F , 3 hrs +AC |
| A | 93.6 HRB | 96.3 HRB | 98.2 HRB | 40.0 HRC | 39.1 HRC | 35.7 HRC | 27.6 HRC | 22.0 HRC |
| B | 94.6 HRB | 27.6 HRC | 22.4 HRC | 26.4 HRC | 35.7 HRC | 31.5 HRC | 101.5 HRB | 95.6 HRB |
| C | 92.4 HRB | 24.8 HRC | 22.5 HRC | 33.1 HRC | 37.1 HRC | 29.0 HRC | 97.9 HRB | 92.3 HRB |
| D | 94.7 HRB | 28.3 HRC | 98.0 HRB | 27.7 HRC | 31.8 HRC | 29.1 HRC | 22.4 HRC | 96.1 HRB |
| E | 93.3 HRB | 21.2 HRC | 100.2 HRB | 30.7 HRC | 31.1 HRC | 102.0 HRB | 95.8 HRB | 90.9 HRB |
| F | 94.7 HRB | 101.5 HRB | 91.9 HRB | 26.9 HRC | 27.6 HRC | 100.7 HRB | 20.2 HRC | 93.9 HRB |
| G | 90.6 HRB | 25.5 HRC | 97.4 HRB | 27.0 HRC | 28.5 HRC | 100.8 HRB | 96.7 HRB | 88.9 HRB |
| H | 94.6 HRB | 26.7 HRC | 99.1 HRB | 32.3 HRC | 27.6 HRC | 94.7 HRB | 90.8 HRB | 84.6 HRB |

FIG. 35

| Material | Homogenize + Hot Roll + Sol'n Anneal + Cold Roll + Age (37% CR) | | | | | |
|---|---|---|---|---|---|---|
| | Age 600°F, 3 hrs +AC | Age 700°F, 3 hrs +AC | Age 800°F, 3 hrs +AC | Age 900°F, 3 hrs +AC | Age 1000°F, 3 hrs +AC | Age 1100°F, 3 hrs +AC |
| A | 31.0 HRC | 41.2 HRC | 39.3 HRC | 28.8 HRC | 28.1 HRC | 23.2 HRC |
| B | 33.4 HRC | 37.9 HRC | 39.0 HRC | 32.8 HRC | 101.6 HRB | 98.0 HRB |
| C | 33.5 HRC | 39.7 HRC | 38.0 HRC | 29.3 HRC | 99.1 HRB | 94.0 HRB |
| D | 27.5 HRC | 35.2 HRC | 33.4 HRC | 29.7 HRC | 24.1 HRC | 94.0 HRB |
| E | 30.3 HRC | 33.8 HRC | 31.3 HRC | 102.5 HRB | 94.8 HRB | 91.5 HRB |
| F | 25.6 HRC | 32.5 HRC | 32.3 HRC | 27.2 HRC | 22.1 HRC | 91.9 HRB |
| G | 29.4 HRC | 36.4 HRC | 32.2 HRC | 26.7 HRC | 94.6 HRB | 88.4 HRB |
| H | 35.3 HRC | 41.3 HRC | 23.1 HRC | 97.8 HRB | 92.1 HRB | 87.8 HRB |

FIG. 36

| Material | Homogenize + Extrude (88%) | Homogenize + Extrude + Solution Anneal | | | | | | | |
|---|---|---|---|---|---|---|---|---|---|
| | Various | SA 1295°F, 2 hrs + WQ | SA 1335°F, 2 hrs + WQ | SA 1385°F, 2 hrs + WQ | SA 1400°F, 2 hrs + WQ | SA 1430°F, 2 hrs + WQ | SA 1480°F, 2 hrs + WQ | SA 1520°F, 2 hrs + WQ | SA 1570°F, 2 hrs + WQ |
| A | 91.9 HRB | 91.4 HRB | 89.8 HRB | 86.0 HRB | - | 81.9 HRB | 73.2 HRB | 71.7 HRB | 71.7 HRB |
| B | 79.1 HRB | 87.4 HRB | 84.3 HRB | 79.1 HRB | - | 74.4 HRB | 72.0 HRB | 72.6 HRB | 72.7 HRB |
| C | 86.6 HRB | 84.7 HRB | 81.4 HRB | 78.3 HRB | - | 72.3 HRB | 69.5 HRB | 68.7 HRB | 69.4 HRB |
| D | 78.2 HRB | 82.0 HRB | 78.9 HRB | 67.9 HRB | - | 64.2 HRB | 62.9 HRB | - | - |
| E | 59.8 HRB | 68.9 HRB | 60.1 HRB | 58.4 HRB | 58.4 HRB | 59.2 HRB | 59.0 HRB | 59.1 HRB | 59.7 HRB |
| F | 69.6 HRB | 75.0 HRB | 69.8 HRB | 63.9 HRB | - | 61.1 HRB | 60.0 HRB | - | - |
| G | 57.1 HRB | 74.7 HRB | 57.8 HRB | 55.5 HRB | 54.6 HRB | 55.4 HRB | 55.1 HRB | 53.5 HRB | 53.5 HRB |
| H | 80.8 HRB | 83.6 HRB | 81.4 HRB | 79.6 HRB | - | 76.4 HRB | 73.5 HRB | 72.8 HRB | 73.6 HRB |
| J | 82.6 HRB | - | - | - | 54.7 HRB | - | - | - | - |

MAGNETIC COPPER ALLOYS

CROSS-REFERENCE TO RELATED APPLICATIONS

This application claims priority to U.S. Provisional Patent Application Ser. No. 62/169,989, filed on Jun. 2, 2015, and to U.S. Provisional Patent Application Ser. No. 62/134,731, filed on Mar. 18, 2015. The entireties of these applications are hereby fully incorporated by reference herein.

BACKGROUND

The present disclosure relates to magnetic copper-based alloys, in particular copper-nickel-tin-manganese alloys. Also disclosed are various processes for obtaining and/or using such magnetic alloys, including various articles produced therefrom.

Copper-nickel-tin alloys, such as ToughMet® alloys offered by Applicant, Materion Corporation, combine a low coefficient of friction with excellent wear resistance. They are spinodally hardened alloys engineered for high strength and hardness, and resist galling, stress relaxation, corrosion, and erosion. They retain their strength at elevated temperatures, and are easily machined into complex components. These alloys are also non-magnetic.

It would be desirable to provide magnetic copper-based alloys that produce some advantages in certain applications.

BRIEF DESCRIPTION

The present disclosure is directed to magnetic copper alloys, particularly copper-nickel-tin-manganese alloys. These magnetic alloys can be made by processing the alloy under certain conditions. Also included are processes for processing the alloys to adjust the magnetic properties of the alloys while still providing useful mechanical property combinations.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 9 is a table showing whether certain compositions are magnetic after casting, homogenization, and hot upsetting.

FIG. 10 is a table showing whether certain compositions are magnetic after homogenization and solution annealing.

FIG. 11 is a table showing whether certain compositions are magnetic after homogenization and hot rolling.

FIG. 12 is a table showing whether certain compositions are magnetic after homogenization, hot rolling, and solution annealing.

FIG. 13 is a table showing whether certain compositions are magnetic after homogenization, hot rolling, solution annealing, and cold rolling.

FIG. 14 is a table showing whether certain compositions are magnetic after homogenization, hot rolling, solution annealing, cold rolling, and aging.

FIG. 15 is a table showing whether certain compositions are magnetic after homogenization, heating, extrusion, and solution annealing.

FIG. 16 is a table listing the relative magnetic permeabilities for the compositions after the processes of FIG. 9.

FIG. 17 is a table listing the relative magnetic permeabilities for the compositions after the processes of FIG. 10.

FIG. 18 is a table listing the relative magnetic permeabilities for the compositions after the processes of FIG. 11.

FIG. 19 is a table listing the relative magnetic permeabilities for the compositions after the processes of FIG. 12.

FIG. 20 is a table listing the relative magnetic permeabilities for the compositions after the processes of FIG. 13.

FIG. 21 is a table listing the relative magnetic permeabilities for the compositions after the processes of FIG. 14.

FIG. 22 is a table listing the relative magnetic permeabilities for the compositions after the processes of FIG. 15.

FIG. 23 is a table listing the electrical conductivity for the compositions after the processes of FIG. 9.

FIG. 24 is a table listing the electrical conductivity for the compositions after the processes of FIG. 10.

FIG. 25 is a table listing the electrical conductivity for the compositions after the processes of FIG. 11.

FIG. 26 is a table listing the electrical conductivity for the compositions after the processes of FIG. 12.

FIG. 27 is a table listing the electrical conductivity for the compositions after the processes of FIG. 13.

FIG. 28 is a table listing the electrical conductivity for the compositions after the processes of FIG. 14.

FIG. 29 is a table listing the electrical conductivity for the compositions after the processes of FIG. 15.

FIG. 30 is a table listing the hardnesses for the compositions after the processes of FIG. 9.

FIG. 31 is a table listing the hardnesses for the compositions after the processes of FIG. 10.

FIG. 32 is a table listing the hardnesses for the compositions after the processes of FIG. 11.

FIG. 33 is a table listing the hardnesses for the compositions after the processes of FIG. 12.

FIG. 34 is a table listing the hardnesses for the compositions after the processes of FIG. 13.

FIG. 35 is a table listing the hardnesses for the compositions after the processes of FIG. 14.

FIG. 36 is a table listing the hardnesses for the compositions after the processes of FIG. 15.

FIG. 38A is a graph showing the 0.2% offset yield strength versus the manganese content.

FIG. 38B is a graph showing the ultimate tensile strength versus the manganese content.

FIG. 38C is a graph showing the % elongation versus the manganese content.

FIG. 38D is a graph showing the hardness (HRB) versus the manganese content.

FIG. 38E is a graph showing the magnetic attraction distance versus the manganese content.

FIG. 40A is a graph of 0.2% offset yield strength versus aging temperature.

FIG. 40B is a graph of ultimate tensile strength versus aging temperature.

FIG. 40C is a graph of % elongation versus aging temperature.

FIG. 40D is a graph of hardness (HRC) versus aging temperature.

FIG. 40E is a graph of magnetic attraction distance versus aging temperature.

FIG. 60A is the same as FIG. 53, but with three lines showing the orientation of the precipitates. FIG. 60B is the same as FIG. 54A, but with three lines showing the orientation of the precipitates. FIG. 60C is the same as FIG. 54D, but with three lines showing the orientation of the precipitates. FIG. 60D is the same as FIG. 54F, but with three lines showing the orientation of the precipitates. FIG. 60E is the same as FIG. 55A, but with three lines showing the orientation of the precipitates.

DETAILED DESCRIPTION

Figure 1:
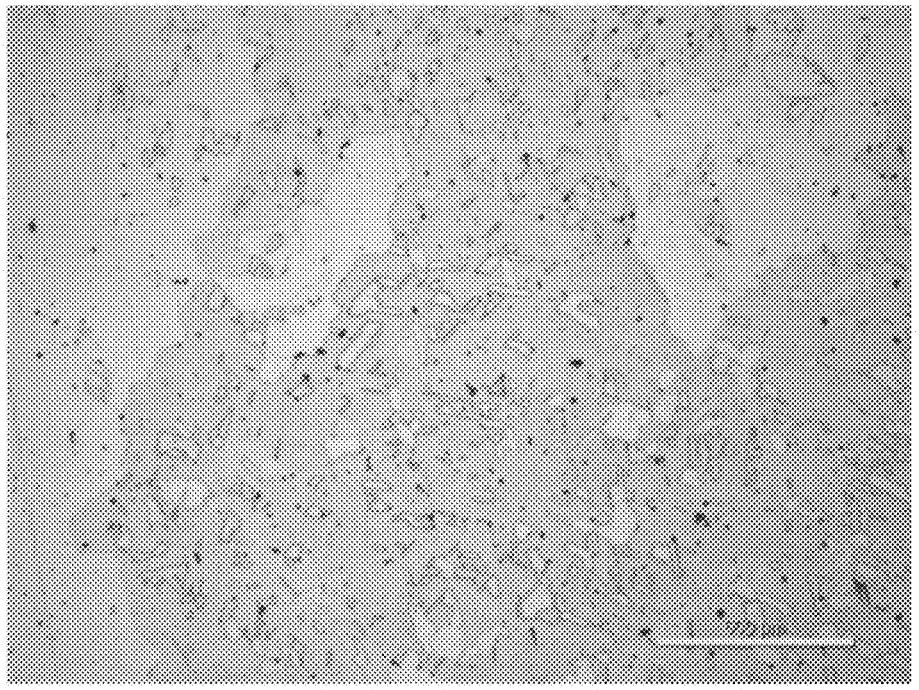
FIG. 1 is a picture of a polished and etched transverse cross-section of a Cu—Ni—Sn—Mn alloy at 50× magnification. Shown also is a 600 micrometer (μm) scale.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

The present disclosure may refer to temperatures for certain process steps. It is noted that these generally refer to the temperature at which the heat source (e.g. furnace) is set, and do not necessarily refer to the temperature which must be attained by the material being exposed to the heat.

The present disclosure relates to copper-nickel-tin-manganese (Cu—Ni—Sn—Mn) alloys that are both magnetic and electrically conductive. The nickel may be present in an amount of from about 8 wt % to about 16 wt %. In more specific embodiments, the nickel is present in amounts of about 14 wt % to about 16 wt %, about 8 wt % to about 10 wt %, or about 10 wt % to about 12 wt %. The tin may be present in an amount of from about 5 wt % to about 9 wt %. In more specific embodiments, the tin is present in amounts of about 7 wt % to about 9 wt %, or about 5 wt % to about 7 wt %. The manganese may be present in an amount of from about 1 wt % to about 21 wt %, or from about 1.9 wt % to about 20 wt %. In more specific embodiments, the manganese is present in amounts of at least 4 wt %, at least 5 wt %, about 4 wt % to about 12 wt %, about 5 wt % to about 21 wt %, or about 19 wt % to about 21 wt %. The balance of the alloy is copper. The alloys may further include one or more other metals such as chromium, silicon, molybdenum, or zinc in minor amounts. For purposes of this disclosure, elements that are present in an amount of less than 0.5 wt % should be considered an impurity, such as iron.

In some specific embodiments, the copper-nickel-tin-manganese alloy contains from about 8 wt % to about 16 wt % nickel, about 5 wt % to about 9 wt % tin, about 1 wt % to about 21 wt % manganese, and balance copper.

In other specific embodiments, the copper-nickel-tin-manganese alloy contains from about 8 wt % to about 16 wt % nickel, about 5 wt % to about 9 wt % tin, about 5 wt % to about 21 wt % manganese, and balance copper.

In different embodiments, the copper-nickel-tin-manganese alloy contains from about 8 wt % to about 16 wt % nickel, about 5 wt % to about 9 wt % tin, about 5 wt % to about 11 wt % manganese, and balance copper.

In yet additional embodiments, the copper-nickel-tin-manganese alloy contains from about 14 wt % to about 16 wt % nickel, about 5 wt % to about 9 wt % tin, about 5 wt % to about 11 wt % manganese, and balance copper.

In more specific embodiments, the copper-nickel-tin-manganese alloy contains from about 14 wt % to about 16 wt % nickel, about 7 wt % to about 9 wt % tin, about 1 wt % to about 21 wt % manganese, and balance copper.

In more specific embodiments, the copper-nickel-tin-manganese alloy contains from about 14 wt % to about 16 wt % nickel, about 7 wt % to about 9 wt % tin, about 4 wt % to about 12 wt % manganese, and balance copper.

In other specific embodiments, the copper-nickel-tin-manganese alloy contains from about 8 wt % to about 10 wt % nickel, about 5 wt % to about 7 wt % tin, about 1 wt % to about 21 wt % manganese, and balance copper.

In other specific embodiments, the copper-nickel-tin-manganese alloy contains from about 8 wt % to about 10 wt % nickel, about 5 wt % to about 7 wt % tin, about 4 wt % to about 21 wt % manganese, and balance copper.

In a few specific embodiments, the copper-nickel-tin-manganese alloy contains from about 10 wt % to about 12 wt % nickel, about 5 wt % to about 7 wt % tin, about 1 wt % to about 21 wt % manganese, and balance copper.

These alloys can be formed by the combination of solid copper, nickel, tin, and manganese in the desired proportions. The preparation of a properly proportioned batch of copper, nickel, tin, and manganese is followed by melting to form the alloy. Alternatively, nickel, tin, and manganese particles can be added to a molten copper bath. The melting may be carried out in a gas-fired, electrical induction, resistance, or arc furnace of a size matched to the desired solidified product configuration. Typically, the melting temperature is at least about 2057° F. with a superheat dependent on the casting process and in the range of 150 to 500° F. An inert atmosphere (e.g., including argon and/or carbon dioxide/monoxide) and/or the use of insulating protective covers (e.g., vermiculite, alumina, and/or graphite) may be utilized to maintain neutral or reducing conditions to protect oxidizable elements.

Reactive metals such as magnesium, calcium, beryllium, zirconium, and/or lithium may be added after initial meltdown to ensure low concentrations of dissolved oxygen. Casting of the alloy may be performed following melt temperature stabilization with appropriate superheat into continuous cast billets or shapes. In addition, casting may also be performed to produce ingots, semi-finished parts, near-net parts, shot, pre-alloyed powder, or other discrete forms.

Alternatively, separate elemental powders can be thermo-mechanically combined to produce the copper-nickel-tin-manganese alloy for raw input materials, semi-finished parts, or near-net parts.

A thin film of the copper-nickel-tin-manganese alloy can also be produced through standard thin film deposition techniques, including but not limited to sputtering or evaporation. The thin film can also be produced by co-sputtering from two or more elemental sputtering targets, or a combination of appropriate binary or ternary alloy sputtering targets, or from sputtering from a monolithic sputtering target that contains all four elements required to be fabricated to achieve the desired proportions in the film. It is acknowledged that specific heat treatment of the thin film may be required to develop and improve the magnetic and material properties of the film.

In some embodiments, the as-cast alloy is magnetic. In particular, such copper-nickel-tin-manganese alloys may contain from about 2 wt % to about 20 wt % of manganese. Whether the copper-based alloy is magnetic can be determined by a semi-quantitative assessment of the attraction force of the alloy in the presence of a powerful rare earth magnet. Alternatively, and more quantitative, is a magnetic attraction distance measurement. Sophisticated magnetic measurement systems such as vibrating sample magnetometry are also useful.

Interestingly, the magnetic and mechanical properties of the as-cast alloy can be changed by additional processing steps. In addition, alloys that were previously magnetic after some processing steps can be rendered non-magnetic by further processing steps, then rendered magnetic again after additional processing. The magnetic property is thus not necessarily inherent to the copper-based alloy itself, and is affected by the processing that is performed. As a result, one can obtain magnetic alloys with desired combinations of magnetic and strength properties such as relative magnetic permeability, electrical conductivity, and hardness (e.g. Rockwell B or C). A customized magnetic response can thus be tailored based on various combinations of homogenizing, solution annealing, aging, hot working, cold working, extrusion, and hot upsetting. In addition, such alloys should have a relatively low elastic modulus on the order of about $15\times10^6$ psi to about $25\times10^6$ psi. Thus, good spring characteristics can be achieved by enabling high elastic strains, on the order of 50% higher than otherwise expected from iron-based alloys or nickel-based alloys.

Homogenizing involves heating the alloy to create a homogeneous structure in the alloy to reduce chemical or metallurgical segregation that can occur as a natural result of solidification. Diffusion of the alloy elements occurs until they are evenly distributed throughout the alloy. This occurs at a temperature that is usually between 80% and 95% of the solidus temperature of the alloy. Homogenization improves plasticity, increases the consistency and the level of mechanical properties, and decreases anisotropy in the alloy.

Solution annealing involves heating a precipitation hardenable alloy to a high enough temperature to convert the microstructure into a single phase. A rapid quench to room temperature leaves the alloy in a supersaturated state that makes the alloy soft and ductile, helps regulate grain size, and prepares the alloy for aging. Subsequent heating of the supersaturated solid solution enables precipitation of the strengthening phase and hardens the alloy.

Age hardening is a heat treatment technique that produces ordering and fine particles (i.e. precipitates) of an impurity phase that impedes the movement of defects in a crystal lattice. This hardens the alloy.

Hot working is a metal forming process in which an alloy is passed through rolls, dies, or is forged to reduce the section of the alloy and to make the desired shape and dimension, at a temperature generally above the recrystallization temperature of the alloy. This generally reduces directionality in mechanical properties, and produces a new equiaxed microstructure, particularly after solution annealing. The degree of hot working performed is indicated in terms of % reduction in thickness, or % reduction in area, and is referred to in this disclosure as merely "% reduction".

Cold working is a metal forming process typically performed near room temperature, in which an alloy is passed through rolls, dies, or is otherwise cold worked to reduce the section of the alloy and to make the section dimensions uniform. This increases the strength of the alloy. The degree of cold working performed is indicated in terms of % reduction in thickness, or % reduction in area, and is referred to in this disclosure as merely "% reduction".

Extrusion is a hot working process in which the alloy of a certain cross-section is forced through a die with a smaller cross-section. This may produce an elongated grain structure in the direction of extrusion, depending on the temperature. The ratio of the final cross-sectional area to the original cross-sectional area can be used to indicate the degree of deformation.

Hot upsetting or upset forging is a process by which workpiece thickness is compressed by application of heat and pressure, which expands its cross section or otherwise changes its shape. This plastically deforms the alloy, and is generally performed above the recrystallization temperature. This improves mechanical properties, improves ductility, further homogenizes the alloy, and refines coarse grains. The percent reduction in thickness is used to indicate the degree of hot upsetting or upset forging performed.

After some heat treatments, the alloy must be cooled to room temperature. This can be done by water quenching, oil quenching, synthetic quenching, air cooling, or furnace cooling. The quench medium selection permits control of the rate of cooling.

In a first set of additional processing steps, after the alloy is cast, the alloy is homogenized for a time period of about 4 hours to about 16 hours at a temperature of about 1400° F. to about 1700° F., and then water quenched or air cooled. This set of steps generally retains magnetism in alloys that have a manganese content of at least 5 wt %, decreases the relative magnetic permeability, can increase the electrical conductivity, and can change the hardness in either direction as desired. Alloys having a lower manganese content generally become non-magnetic upon this set of additional processing steps.

In some alloys, although the first set of additional processing steps removes magnetism, the magnetism can be regained upon a second homogenizing for a time period of about 8 hours to about 12 hours at a temperature of about 1500° F. to about 1600° F. and then water quenching.

Magnetism can also be retained if, after the homogenizing for a time period of about 4 hours to about 16 hours at a temperature of about 1400° F. to about 1700° F., the alloy is hot upset from about 40% to about 60% reduction, and then water quenched.

In a second set of additional processing steps, after the alloy is cast, the alloy is homogenized for a time period of about 5 hours to about 7 hours at a temperature of about 1500° F. to about 1700° F., and then air cooled. This set of steps can retain magnetism in alloys that have a manganese content of at least 5 wt %, particularly a manganese content of about 10 wt % to about 12 wt %.

Interestingly, the magnetism of some copper alloys that are rendered non-magnetic by the homogenizing step of the second set of additional steps can be made magnetic again by subsequently solution annealing the homogenized alloy for a time period of about 1 hour to about 3 hours at a temperature of about 1400° F. to about 1600° F. and then water quenching; aging the annealed alloy for a time period of about 2 hours to about 4 hours at a temperature of about 750° F. to about 1200° F., and then air cooling. Again, this processing can decrease the relative magnetic permeability, can increase the electrical conductivity, and can change the hardness in either direction as desired. In particular embodiments, the electrical conductivity is increased to about 4% IACS.

In a third set of additional processing steps, after the alloy is cast, the alloy is homogenized for a time period of about 5 hours to about 7 hours at a first temperature of about 1500° F. to about 1700° F. and then air cooled. The alloy is then heated for a time period of about 1 hour to about 3 hours at a temperature of about 1400° F. to about 1600° F. (which is usually lower than the homogenization temperature), then hot rolled a first time. If needed, the alloy is reheated for a time period of about 5 minutes to about 60 minutes or more depending upon section size at a temperature of about 1400° F. to about 1600° F., and then hot rolled a second time to achieve a total reduction of about 65% to about 70%. Finally, the alloy is solution annealed for a time period of about 4 hours to about 6 hours at a temperature of about 1400° F. to about 1600° F.; and then cooled by either furnace cooling or water quenching. This set of steps can retain magnetism in alloys that have a manganese content of at least 5 wt %, as well as those having a manganese content of about 4 wt % to about 6 wt %.

After the homogenizing, hot rolling, and solution annealing described in the third set of additional processing steps, the alloy can also be aged for a time period of about 1 hour to about 24 hours at a temperature of about 750° F. to about 850° F. and then air cooled, and still remain magnetic.

In a fourth set of additional processing steps, after the alloy is cast, the alloy is homogenized for a time period of about 4 hours to about 22 hours at a temperature of about 1200° F. to about 1700° F. The alloy is then heated for a time period of about 1 hour to about 3 hours at a temperature of about 1400° F. to about 1600° F., and then is hot rolled to achieve a reduction of about 65% to about 70%. The alloy is then solution annealed for a time period of about 1 hour to about 3 hours at a temperature of about 1200° F. to about 1600° F. and then water quenched. Copper-nickel-tin-manganese alloys having a manganese content of at least 5 wt % can also retain their magnetism after this fourth set of processing steps, particularly those with a manganese content of about 7 wt % to about 21 wt %, or those having a nickel content of about 8 wt % to about 12 wt % and a tin content of about 5 wt % to about 7 wt %.

After the homogenizing, hot rolling, and solution annealing described in the fourth set of additional processing steps, the alloy can also be aged for a time period of about 2 hours to about 4 hours at a temperature of about 750° F. to about 1200° F. and then air cooled, and retain magnetism. This aging step can also re-activate the magnetism of some alloys that are non-magnetic after the homogenizing, hot rolling, and solution annealing processing steps. The combination of the fourth set of additional processing steps with this extra aging step can be considered a fifth set of additional processing steps.

Alternatively, after the homogenizing, hot rolling, and solution annealing described in the fourth set of additional processing steps, the alloy can also be cold rolled to achieve a reduction of about 20% to about 40%, and re-activate magnetism. The combination of the fourth set of additional processing steps with this extra cold rolling step can be considered a sixth set of additional processing steps.

Additionally, after the homogenizing, hot rolling, solution annealing, and cold rolling described in the sixth set of additional processing steps, the alloy can then be aged for a time period of about 2 hours to about 4 hours at a temperature of about 750° F. to about 1200° F., and then air cooled, and re-activate magnetism as well. The combination of the sixth set of additional processing steps with this extra aging step can be considered a seventh set of additional processing steps.

In an eighth set of additional processing steps, after the alloy is cast, the alloy is homogenized for a time period of about 5 hours to about 7 hours, or about 9 hours to 11 hours, or about 18 hours to about 22 hours at a first temperature of about 1200° F. to about 1700° F. and then air cooled. The alloy is then heated for a second time period of about 4 hours or longer, including about 6 hours or longer, at a temperature of about 1200° F. to about 1600° F. The alloy is then extruded to achieve a reduction of about 66% to about 90%. Copper-nickel-tin-manganese alloys having a manganese content of at least 7 wt % can also retain their magnetism after this eighth set of processing steps, particularly those with a manganese content of about 10 wt % to about 12 wt %.

After the homogenizing and extruding steps described in the eighth set of additional processing steps, the alloy can also be solution annealed for a time period of about 1 hour to about 3 hours at a temperature of about 1200° F. to about 1700° F. and then water quenched. Copper-nickel-tin-manganese alloys having a manganese content of at least 7 wt % can also retain their magnetism after this ninth set of processing steps, particularly those with a manganese content of about 10 wt % to about 12 wt %. This solution annealing step can also re-activate the magnetism of some alloys that are non-magnetic after the homogenizing and extruding steps. The combination of the eighth set of additional processing steps with this solution annealing step can be considered a ninth set of additional processing steps.

In a tenth set of processing steps, after the alloy is extruded according to the eighth set of processing steps, the alloy is solution annealed for a time period of about 1 hour to about 3 hours at a temperature of about 1200° F. to about 1700° F. The alloy can optionally then be cold worked to achieve a reduction of about 20% to about 40%. The alloy is then aged for a time period of about 1 hour to about 4 hours at a temperature of about 600° F. to about 1200° F. In more particular embodiments, the aging is performed at temperatures of about 700° F. to about 1100° F., or about 800° F. to about 950° F., and then air cooled.

The alloy can also be heat treated in a magnetic field to change its properties. The alloy is exposed to a magnetic field, and then heated (e.g. in a furnace, by an infrared lamp, or by a laser). This can result in a change in magnetic properties of the alloy, and can be considered an eleventh set of additional processing steps.

The resulting magnetic copper-nickel-tin-manganese alloys can thus have different combinations of values for various properties. The magnetic alloy may have a relative magnetic permeability ($\rho_r$) of at least 1.100, or at least 1.500, or at least 1.900. The magnetic alloy may have a Rockwell hardness B (HRB) of at least 60, at least 70, or at least 80, or at least 90. The magnetic alloy may have a Rockwell hardness C (HRC) of at least 25, at least 30, or at least 35. The magnetic alloy may have a maximum magnetic moment at saturation ($m_s$) of from about 0.4 emu to about 1.5 emu. The magnetic alloy may have a remanence or residual magnetism ($m_r$) of from about 0.1 emu to about 0.6 emu. The magnetic alloy may have a switching field distribution ($\Delta H/Hc$) of from about 0.3 to about 1.0. The magnetic alloy may have a coercivity of from about 45 Oersteds to about 210 Oersteds, or of at least 100 Oersteds, or less than 100 Oersteds. The magnetic alloy may have a squareness, which is calculated as $m_r/m_s$, of from about 0.1 to about 0.5. The magnetic alloy may have a Sigma ($m_s$/mass) of about 4.5 emu/g to about 9.5 emu/g. The magnetic alloy may have an electrical conductivity (% IACS) of from about 1.5% to about 15%, or from about 5% to about 15%. The magnetic alloy may have a 0.2% offset yield strength of from about 20 ksi to about 140 ksi, including from about 80 ksi to about 140 ksi. The magnetic alloy may have an ultimate tensile strength of about 60 ksi to about 150 ksi, including from about 80 ksi to about 150 ksi. The magnetic alloy may have a % elongation of about 4% to about 70%. The magnetic alloy may have a CVN impact strength of at least 2 foot-pounds (ft-lbs) to in excess of 100 ft-lbs when measured according to ASTM E23, using a Charpy V-notch test at room temperature. The magnetic alloy may have a density of about 8 g/cc to about 9 g/cc. The magnetic alloy may have an elastic modulus of about 16 million to about 21 million psi (95% confidence interval). Various combinations of these properties are contemplated.

In particular embodiments, the magnetic alloy may have a relative magnetic permeability ($\mu_r$) of at least 1.100, and a Rockwell hardness B (HRB) of at least 60.

In other embodiments, the magnetic alloy may have a relative magnetic permeability ($\mu_r$) of at least 1.100, and a Rockwell hardness C (HRC) of at least 25.

In some embodiments, the copper-nickel-tin-manganese alloys may also contain cobalt. When cobalt is present, the alloy may contain from about 1 wt % to about 15 wt % cobalt.

The magnetic copper-nickel-tin-manganese alloys can be formed into basic articles such as a strip, rod, tube, wire, bar, plate, shapes, or fabricated articles such as various springs. In particular, it is believed that a magnetic spring would need much less force to move, and would have high elastic strain. Other articles may be selected from the group consisting of a bushing, an instrument housing, a connector, a centralizer, a fastener, a drill collar, a mold for plastic shapes, a welding arm, an electrode, and a certified ingot.

Desirably, the magnetic alloys of the present disclosure have a balance of mechanical strength, ductility, and magnetic behavior. The magnetic properties, such as magnetic attraction distance, coercivity, remanence, maximum magnetic moment at saturation, magnetic permeability, and hysteresis behavior, and the mechanical properties, can be tuned to the desired combinations.

It is believed that the magnetic copper alloys of the present disclosure are in a domain wherein the magnetism of the alloy will vary depending on the heat treatment and the composition of the alloy. In particular, intermetallic precipitates have been observed within the microstructure of some alloys. Thus, the alloys of the present disclosure can be considered as containing discrete dispersed phases within a copper matrix. Without being bound by theory, alternatively, the alloys can be described as Ni—Mn—Sn intermetallic compounds dispersed within a predominantly copper matrix that can also contain nickel and manganese.

FIGS. 53-56C, described further below, show various magnified views of the Cu—Ni—Sn—Mn alloys of the present disclosure. Acicular intermetallic precipitates are seen within grains in these views. As indicated in FIGS. 60A-60F, the precipitates appear as three sets of lines oriented at approximately 60° angles to each other. In these figures, dotted lines are present to emphasize the directions in which the precipitates are oriented. In some embodiments, the precipitates have an aspect ratio of 4:1 to 20:1 when observed perpendicular to the long axis. In other embodiments, the precipitates have an aspect ratio of 1:1 to 4:1 when observed in cross-section.

Several potential applications exist for these magnetic copper alloys. In this regard, they have the normal properties of copper alloys, such as corrosion resistance, electrical conductivity, and antimicrobial properties, as well as being magnetic. Such applications could include magnetic filtration of salt water; low-level electrical heating of water; parts and components for the aquaculture industry; anti-counterfeiting threads for currency; magnetic water softeners; medical devices or surgical instruments, electrocauterizing equipment, positioning devices or instruments; oceanographic devices such as buoys, floats, frames, sleds, cables, fasteners, or low current heating blankets; pigments, coatings, films, or foils for electromagnetic radiation absorption purposes. In addition, other combinations of property characteristics favor applications such as clad, inlaid, and bonded strips and wires; temperature limiting and control devices; magnetic sensors, magnetic sensor targets, and magnetic switching devices; micro-electro-mechanical systems (MEMS), semiconductors, and spin transport electronic devices; magnetic wires for transformers and other electronic devices; EMF/RFI shielding materials, telecommunications devices that need electromagnetic shielding; thin film coatings; composite/hybrid systems that need a magnetic signature; and electromagnetic shielding and thermomagnetic cooling devices for refrigeration or heating.

The following examples are provided to illustrate the alloys, processes, articles, and properties of the present disclosure. The examples are merely illustrative and are not intended to limit the disclosure to the materials, conditions, or process parameters set forth therein.

EXAMPLES

First Set of Examples

Eight compositions, labeled A-H, were tested. Table A below lists the makeup of these eight compositions. In later tests, a ninth composition J was tested, and is also listed here for brevity. Composition H is a commercially available alloy (ToughMet® 3, or "T3"), and Composition J is also commercially available (ToughMet® 2, or "T2"), both from Materion Corporation, Mayfield Heights, Ohio, USA.

TABLE A

| Composition | Ni (wt %) | Sn (wt %) | Mn (wt %) | Cu (wt %) |
|---|---|---|---|---|
| A | 15 | 8 | 11 | 66 |
| B | 15 | 8 | 5 | 72 |
| C | 15 | 8 | 2 | 75 |
| D | 11 | 6 | 20 | 63 |

TABLE A-continued

| Composition | Ni (wt %) | Sn (wt %) | Mn (wt %) | Cu (wt %) |
|---|---|---|---|---|
| E | 9 | 6 | 5 | 80 |
| F | 9 | 6 | 20 | 65 |
| G | 9 | 6 | 8 | 77 |
| H (T3) | 15 | 8 | 0 | 77 |
| J (T2) | 9 | 6 | 0 | 85 |

Full-scale heats of material (in excess of 5000 pounds) were continuously cast as nominal 8-inch diameter castings.

FIG. 9 provides data on whether these eight compositions are magnetic (a) in as-cast form; (b) after one homogenizing step between 1450° F. and 1630° F. for 6 hours to 14 hours; (c) after a second homogenizing step; and (d) after homogenization plus hot upset. "WQ" stands for water quench, and "HU" stands for hot upset to about 50% reduction. Whether the composition showed magnetic tendencies was determined by an assessment of the attraction force of a sample in the presence of a powerful rare earth magnet. As seen here, some alloys that were magnetic in the "as-cast" condition could be "turned off".

FIG. 1 is an etched transverse cross-section at 50× magnification of Composition A after homogenization at 1580° F. for 6 hours and water quenching.

Figure 2:
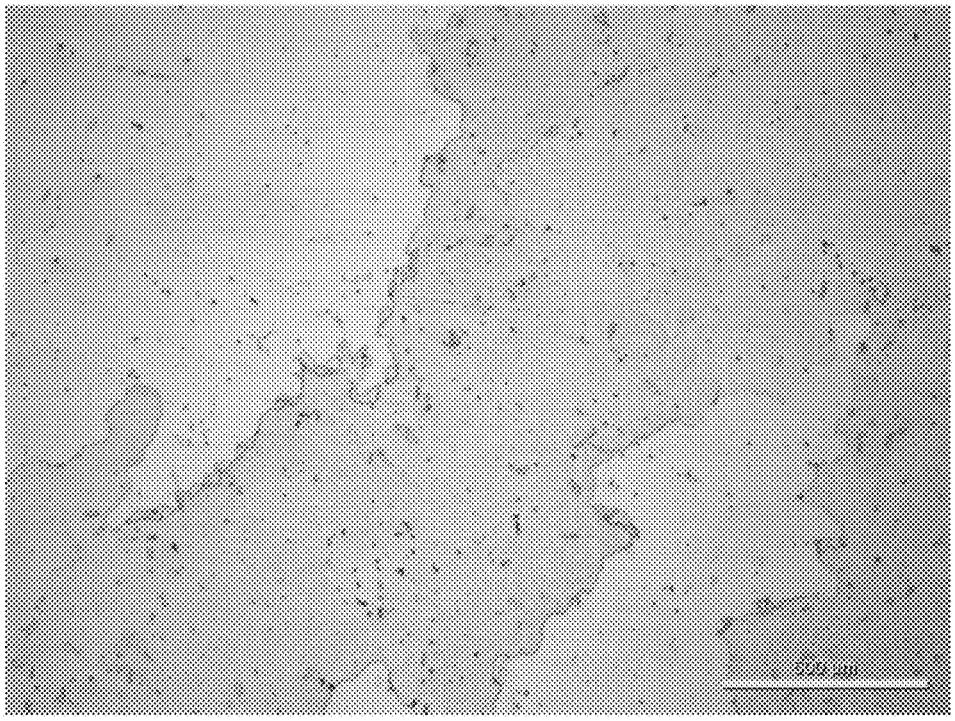
FIG. 2 is a picture of an etched transverse cross-section of a Cu—Ni—Sn—Mn alloy at 50× magnification. Shown also is a 600 μm scale.

FIG. 2 is an etched transverse cross-section at 50× magnification of Composition B after homogenization at 1580° F. for 6 hours and water quenching.

Figure 3:
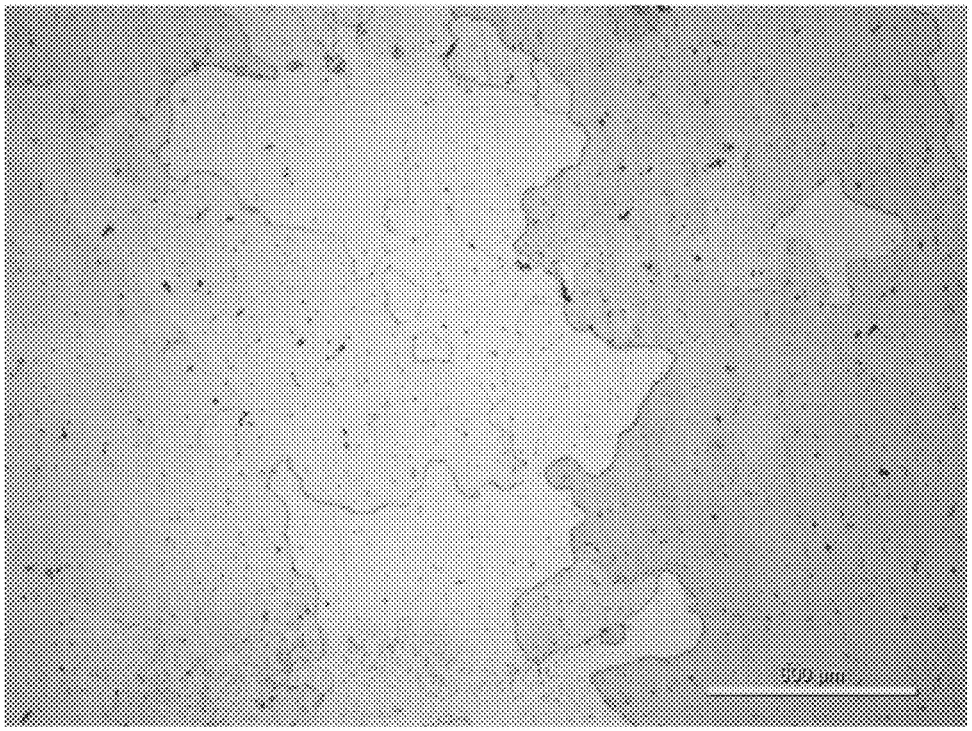
FIG. 3 is a picture of an etched transverse cross-section of a Cu—Ni—Sn—Mn alloy at 50× magnification. Shown also is a 600 μm scale.

FIG. 3 is an etched transverse cross-section at 50× magnification of Composition C after homogenization at 1580° F. for 6 hours and water quenching.

Figure 4:
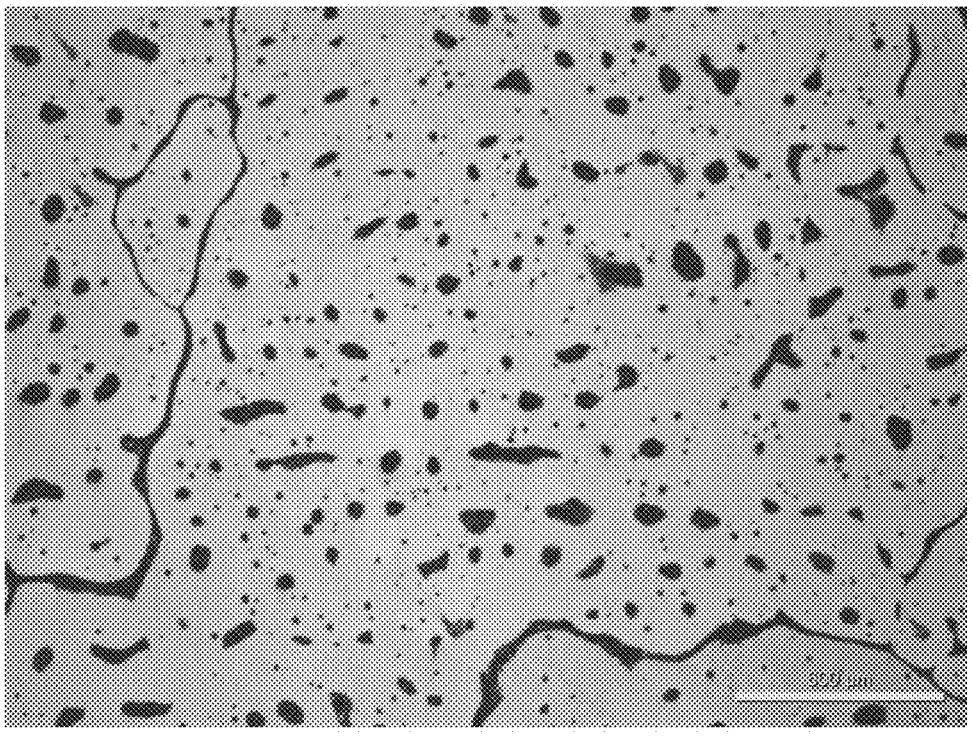
FIG. 4 is a picture of an etched transverse cross-section of a Cu—Ni—Sn—Mn alloy at 50× magnification. Shown also is a 600 μm scale.

FIG. 4 is an etched transverse cross-section at 50× magnification of Composition D after homogenization at 1580° F. for 6 hours and water quenching. Melting is present.

Figure 5:
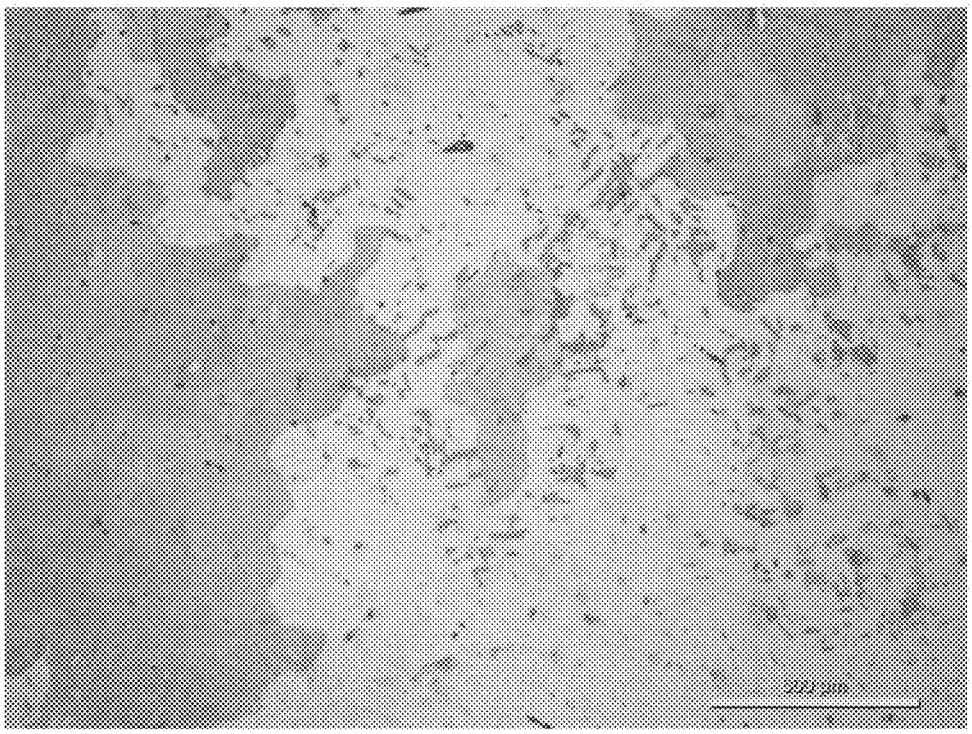
FIG. 5 is a picture of an etched transverse cross-section of a Cu—Ni—Sn—Mn alloy at 50× magnification. Shown also is a 600 μm scale.

FIG. 5 is an etched transverse cross-section at 50× magnification of Composition E after homogenization at 1580° F. for 6 hours and water quenching.

Figure 6:
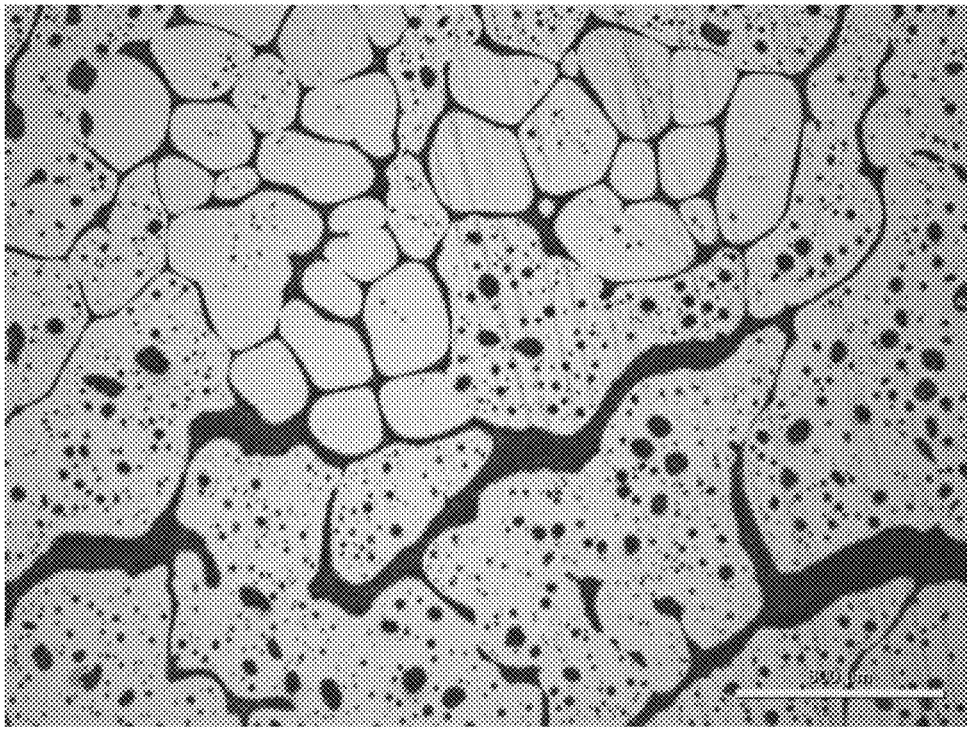
FIG. 6 is a picture of an etched transverse cross-section of a Cu—Ni—Sn—Mn alloy at 50× magnification. Shown also is a 600 μm scale.

FIG. 6 is an etched transverse cross-section at 50× magnification of Composition F after homogenization at 1580° F. for 6 hours and water quenching. Melting is present.

Figure 7:
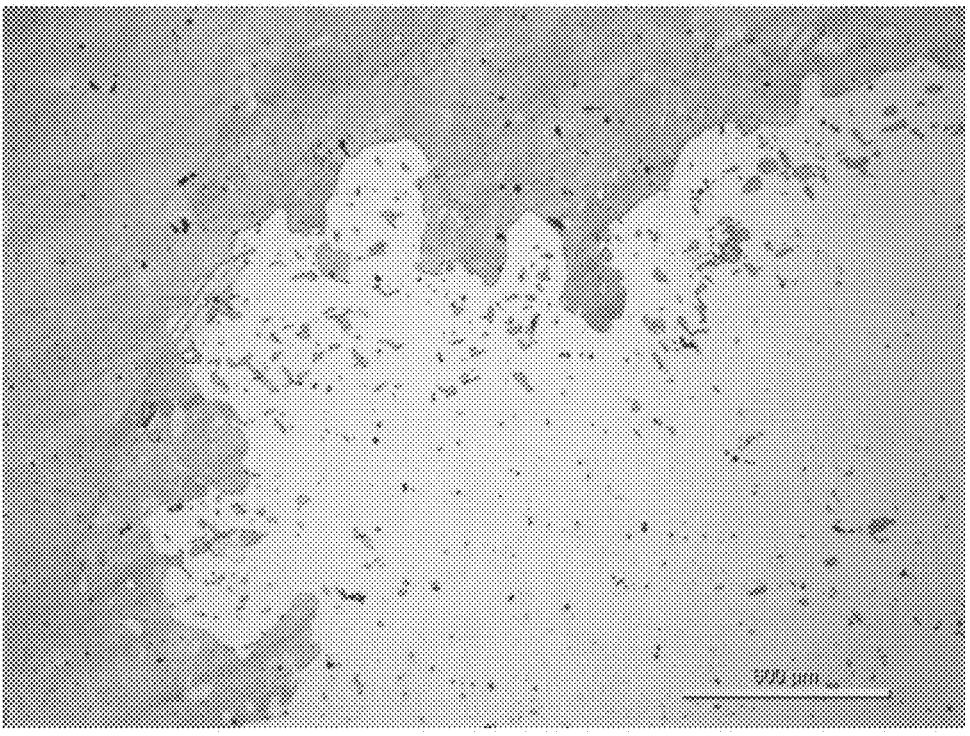
FIG. 7 is a picture of an etched transverse cross-section of a Cu—Ni—Sn—Mn alloy at 50× magnification. Shown also is a 600 μm scale.

FIG. 7 is an etched transverse cross-section at 50× magnification of Composition G after homogenization at 1580° F. for 6 hours and water quenching.

Figure 8:
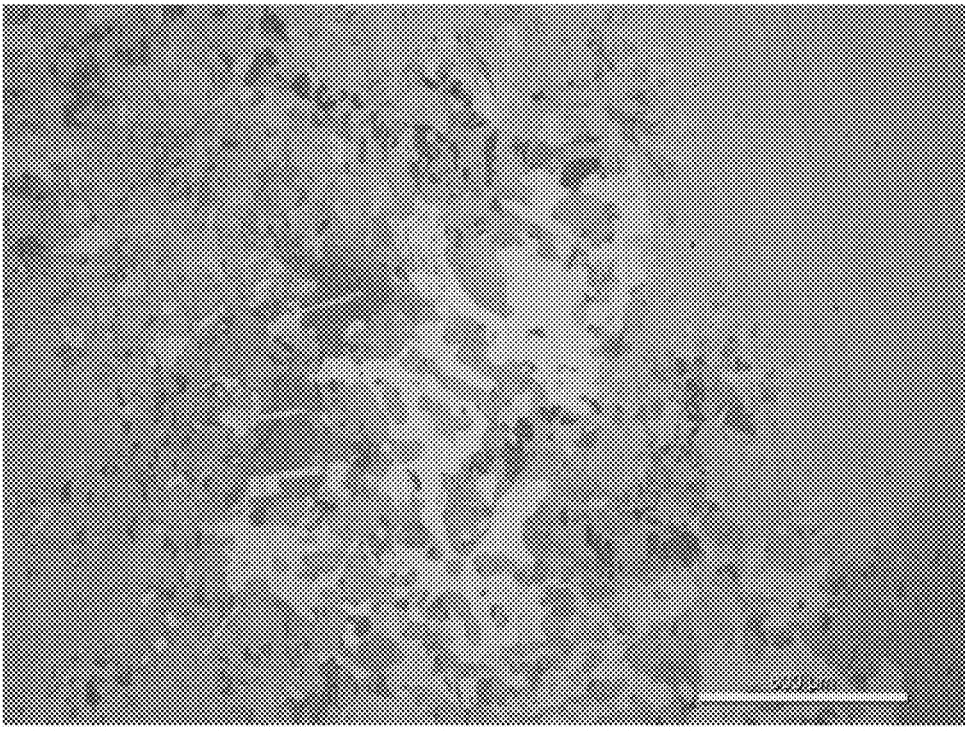
FIG. 8 is a picture of an etched transverse cross-section of a Cu—Ni—Sn alloy at 50× magnification. Shown also is a 600 μm scale.

FIG. 8 is an etched transverse cross-section at 50× magnification of Composition H after homogenization at 1580° F. for 6 hours and water quenching.

FIG. 10 provides data on whether these eight compositions are magnetic after one homogenizing step between 1375° F. and 1580° F. for 6 hours (as indicated by alloy). The homogenized alloy was then solution annealed as indicated. The solution annealed alloy was then aged at 600° F. to 1100° F. for 3 hours. "AC" stands for air cooling. As seen here, there was a magnetic transition at about 750° F. of the aging, when alloys were "turned on" or rendered magnetic again.

FIG. 11 provides data on whether these compositions are magnetic after homogenization, and two hot rolling steps as indicated. In this regard, the hot rolling was not accomplished in one step, and thus the material had to be reheated in order to hot roll to the desired thickness. Next, those homogenized and hot rolled alloys were then solution annealed afterwards at 1525° F. for 5 hours, and then cooled using furnace cooling or water quenching as indicated. The solution annealed and water quenched alloys were then aged afterwards at 800° F. for 1 hour to 24 hours. "Fce cool" stands for furnace cooling. Compositions A, D, and F were not tested. This suggests that the magnetic transition temperature can be engineered by changes in time, temperature, composition, or combinations thereof.

In FIG. 12, initially the eight compositions were homogenized, then hot rolled, then solution annealed for various times and temperatures. Composition A was homogenized at 1540° F. for 8 to 10 hours, then air cooled, then heated to 1475° F. for 2 hours, hot rolled to 67% reduction, then solution annealed at 1525° F. for 2 hours, then water quenched. Compositions B, C, E, and H were homogenized at 1580° F. for 6 hours, then air cooled, then heated to 1500° F. for 2 hours and hot rolled to 67% reduction, then solution annealed at 1525° F. for 2 hours, then water quenched. Compositions D, F, and G were homogenized at 1300° F. for 20 hours without cooling, then directly hot rolled to 67% reduction, then solution annealed at 1400° F. for 2 hours, then water quenched. After these treatments, the now-solution-annealed compositions were aged at 600° F. to 1100° F. for 3 hours, then air cooled. FIG. 12 provides information on whether the alloys were magnetic after such processing. Again, there was a magnetic transition at about 750° F. aging temperature for moderate manganese content.

In FIG. 13, the eight compositions were homogenized, hot rolled, and solution annealed as described in FIG. 12. After the water quenching, the compositions were then cold rolled to either 21% reduction or 37% reduction. The results indicated that cold rolling did not "turn on" the magnetic behavior. Next, the compositions that were cold rolled to 21% reduction were aged at 600° F. to 1100° F. for 3 hours, then air cooled. FIG. 13 provides information on whether the alloys were magnetic after such processing. Again, though, aging did affect the magnetic property.

In FIG. 14, the compositions that were cold rolled to 37% reduction in FIG. 13 were aged at 600° F. to 1100° F. for 3 hours, then air cooled. Similarly, aging did affect the magnetic property.

In FIG. 15, compositions A, B, C, E, G, and H were homogenized at 1580° F. for 6 hours, then air cooled, then heated to 1525° F. for 6 hours minimum, and then extruded to 88% reduction. Compositions D and F were homogenized at 1300° F. for 20 hours, then air cooled, and then extruded to 88% reduction. Compositions D and F were also separately homogenized at 1430° F. for 10 hours, then air cooled, then heated to 1300° F. for 6 hours minimum, and then extruded to 88% reduction. Composition J was homogenized at 1580° F. for 4 hours, then air cooled, then heated to 1500° F. for 6 hours minimum, and then extruded to 88% reduction. The hot extrusion used commercial forward extrusion of an 8-inch diameter billet to a 2⅝ inch diameter rod for compositions A-H. For composition J, the hot extrusion used commercial forward extrusion of a 6-inch diameter billet to a 2 inch diameter rod (89% reduction). The extruded alloys were then solution annealed at 1295° F. to 1650° F. for 2 hours, then water quenched. For the sake of brevity, only half of the solution annealing temperatures are shown in the table. FIG. 15 identifies whether the alloys were magnetic after such processing.

The relative magnetic permeability was measured using a FerroMaster instrument with direct readout, calibrated and operated according to EN 60404-15. A higher value is an indication of the ease of magnetization, to the maximum value of 1.999. Relative magnetic permeabilities greater than 1.999 were beyond the range of the equipment. FIGS. 16-22 list the relative magnetic permeability for the compositions after the processing steps described in FIGS. 9-15.

Electrical conductivity was measured using an eddy current conductivity meter. FIGS. 23-29 list the electrical conductivity (% IACS) for the compositions after the processing steps described in FIGS. 9-15. It is noted that the eddy current is affected by magnetism, and so these readings of the eddy current conductivity meter are not completely accurate for the more highly magnetic alloys/conditions, and only indirectly confirm the magnetic levels of the alloys.

The hardness of the compositions was also measured, using either Rockwell Hardness B or C test methods. FIGS. 30-36 list the hardness for the compositions after the processing steps described in FIGS. 9-15. Desirably, the alloy can have high yield strength and high impact toughness in a wrought product form.

Elastic Modulus

The elastic modulus of Compositions A-J were assessed using customary tensile test algorithms which measure the slope of the stress-strain curve during the first portion of the test. This is usually considered to be a useful estimate that relates to the test material elastic compliance in tension and is independent of alloy heat treatment. As such, the range of elastic modulus as a 95% confidence interval for ALL compositions was 16,000,000 to 21,000,000 psi. Typically, lower modulus values, such as in this range, are good for springs in a variety of applications such as electronic device connectors, compliant platforms, high displacement shielding components for RFI/EMF cabinets or electronic boxes containing devices sensitive to electromagnetic or radio frequency interference or which may radiate such interference. In combination with high yield strength, large displacements are achievable with low force and low spring constant for the compliant device. For comparison, the modulus level for steels and nickel alloys is about 30,000,000 psi, or about 40-90% higher than for the magnetic copper alloys of the present disclosure. Aluminum alloys possess significantly lower elastic moduli (13,000,000 psi) and may not have adequate strength to provide high displacement. Other metals and alloys of, e.g. titanium, can have moduli with great variation depending on orientation due to anisotropic crystalline structure.

Density

The densities of Compositions A-J were estimated using an Archimedes method, mass/dimensions methods, and other similar techniques, but not using one consistent method. The density of all compositions in a wide variety of wrought and heat treated conditions was in the range of about 8 g/cm$^3$ to about 9 g/cm$^3$ (0.30 to 0.33 lbs/in$^3$).

Second Set of Examples

Figure 37:
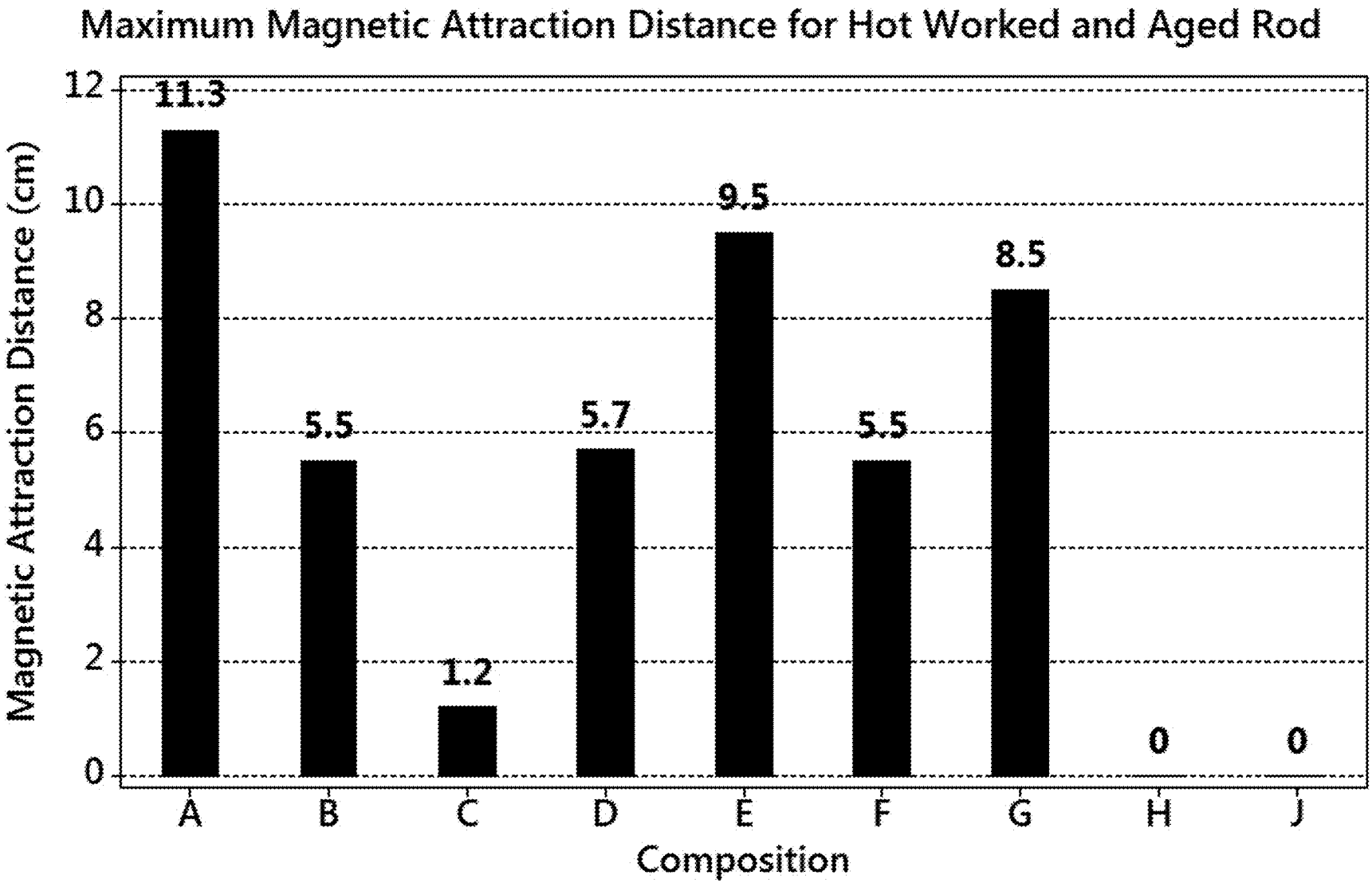
FIG. 37 is a bar graph showing the maximum magnetic attraction distance for several different compositions aged at various temperatures.
Figures 38A, 38B, 38C, 38D:
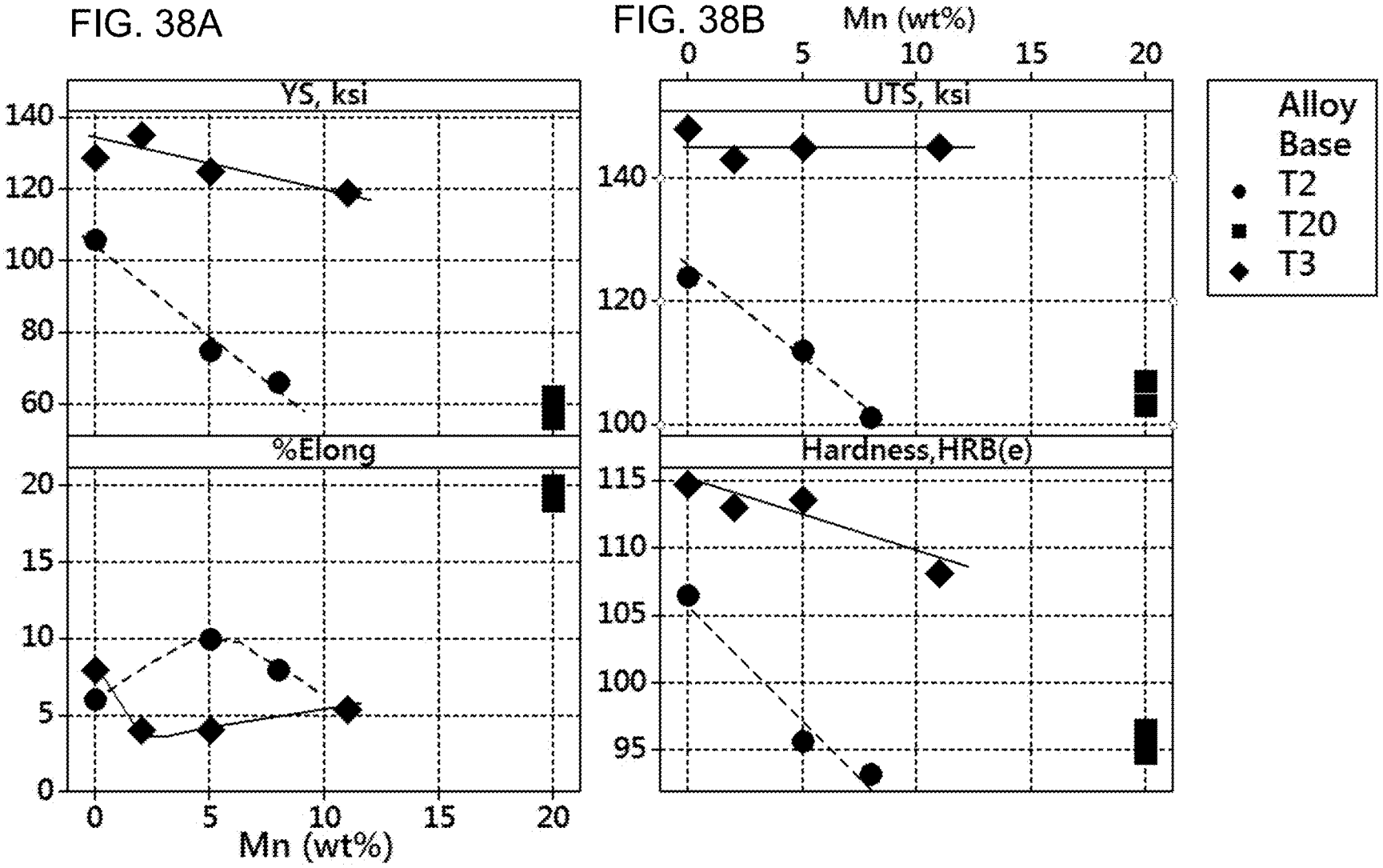
FIGS. 38A-38E are graphs showing the relationship between manganese content and mechanical properties for different Cu—Ni—Sn—Mn alloys.
Figure 38E:
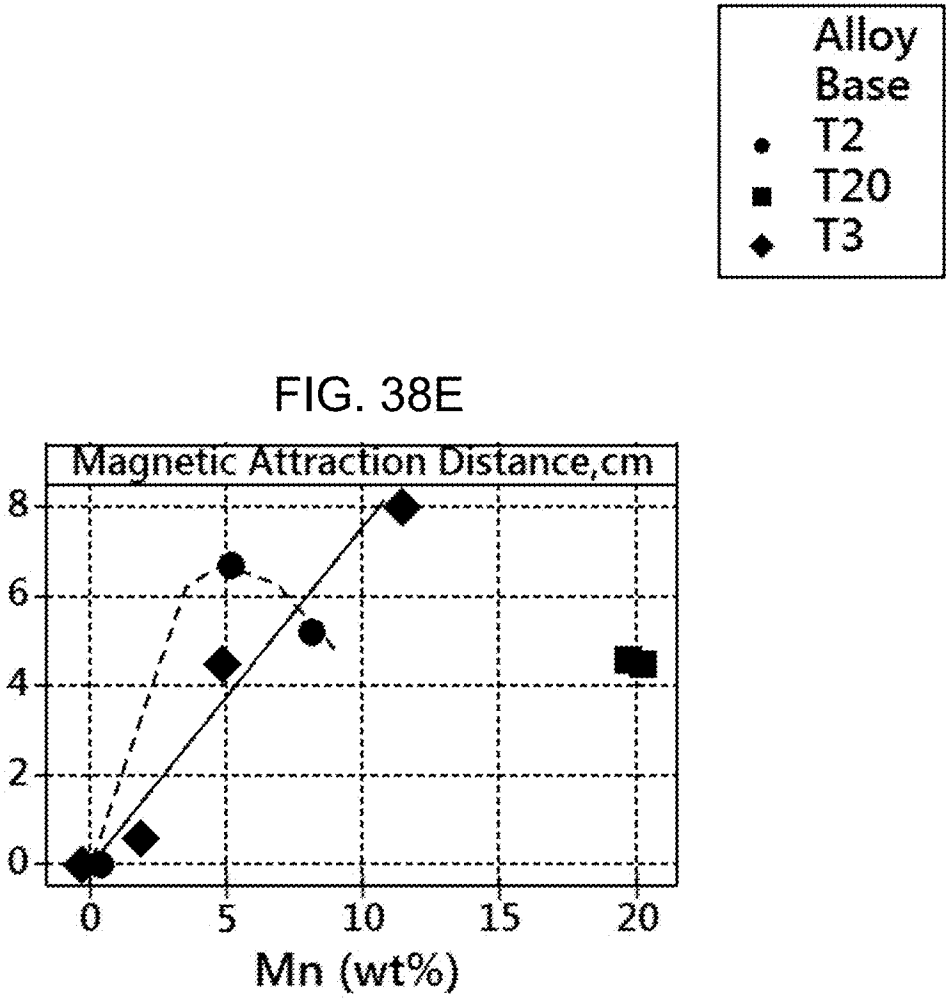

Samples of Compositions A-J were tested for their maximum magnetic attraction distance (MAD, measured in centimeters) after being aged at various temperatures. This was done by measuring the distance at which a powerful rare-earth magnet was affected by the presence of the sample. FIG. 37 shows the maximum MAD attained for each composition. Note that Compositions H and J do not contain manganese, and were measured to have a zero (0 cm) MAD, as expected. Also, for comparison, it is noted that the MAD for a sample of 99.99% nickel, which is a known ferromagnetic material at room temperature, is 9.7 cm.

Third Set of Examples

A set of rods were hot extruded, then subjected to various solution annealing and aging treatments. Magnetic behavior measurements were made on all of these wrought materials by measuring the distance at which a powerful string-suspended rare-earth magnet first moves as the treated sample approaches it. This distance, R (for "Ritzler distance" in cm), has also been called "Magnetic Attraction Distance" (MAD).

A baseline copper-nickel-tin alloy, Cu-15Ni-8Sn (ToughMet® 3, or "T3"), Composition H, is non-magnetic while being capable of heat treatment to ultimate tensile strengths in excess of 140 ksi while retaining usable ductility of at least 5% as measured by tensile elongation. Table B illustrates the maximum strength results for a wide range of alloys with a nominal weight ratio of Ni:Sn~1.9:1, which are compared against the ToughMet® 3.

TABLE B

| Composition | Ni (wt %) | Sn (wt %) | Mn (wt %) | 0.2% YS (ksi) | UTS (ksi) | % Elong | Hardness (HRC) | R (cm) |
|---|---|---|---|---|---|---|---|---|
| H | 15 | 8 | 0 | 129 | 148 | 8 | 34.7 | 0.0 |
| C | 15 | 8 | 2 | 135 | 143 | 4 | 33.6 | 0.6 |
| B | 15 | 8 | 5 | 125 | 145 | 4 | 31.3 | 4.5 |
| A | 15 | 8 | 11 | 119 | 145 | 5.4 | 28.1 | 8.0 |

Table B shows the results of several heat treatment experiments and lists the maximum ultimate tensile strength obtained at a given peak aging temperature. The heat treatments were performed after homogenizing and hot working by extrusion from 8-inch billets to rods having a 2.8-inch diameter. The alloys were solution annealed at a variety of temperatures for 2 hours followed by water quenching. These experiments established a minimum temperature at which complete dissolution of Ni, Sn, and Mn occurred, as indicated by minimum 0.2% offset yield strength (YS), ultimate tensile strength (UTS), and Hardness values. This solution annealing treatment resulted in an equilibrium microstructure consisting of grains, and was devoid of precipitates at grain boundaries or within the grains, such as in FIG. 51A. After the solution annealing step, the alloys were subjected to elevated temperature treatments and then subjected to tensile tests to examine the response to the thermal cycles. The resultant collective properties from the combination of these aging treatments (solution annealing and elevated temperature treatments) are known to those skilled in the art as the "aging response".

There was a general trend for the alloys to react to increasing final heat treatment temperature by exhibiting maxima or minima, depending on heat treatment history. Generally, if a given range of temperatures is applied there will be a showing of "peak" strength or, in the case of elongation, a minimum generally synchronized with the peak strength. For precipitation hardenable alloys, this condition is described as "peak aged at an aging temperature of _____° F. for _____ hrs followed by air cooling". This condition reflects a state of the alloy wherein the distribution of nanostructures creates a unique maximum in strength. It is a characteristic state that uniquely assesses the metallurgical states of the respective alloys, and can be achieved thermodynamically by multiple combinations of temperature (T) and time (t).

Referring now to Table B, it can be said that the Cu-15Ni-8Sn-xMn (T3-based) alloys can achieve a minimum UTS of 140 ksi over a relatively large range of Mn content (0-20 wt %). It was expected that the reduction in total Ni and Sn content as the Mn content increases would deteriorate the aging response. This is because as the total amount of Ni and Sn decreases, the volume of solute to form precipitates or other phases that create strengthening decreases. Surprisingly, increased Mn content did not materially decrease the UTS of the alloy. It appears that the presence of Mn includes an "assisting" effect in the UTS.

This bodes well for the combination of mechanical and magnetic properties of the alloys disclosed herein. The magnetic strength of the alloy increases with increased Mn content, showing an R-distance from 0 to about 11 cm as assessed by the Ritzier measurement system which, again, is designed to show at what distance a rare earth magnet ceases/begins to affect the attraction of the alloy. This is also referred to as the magnetic attraction distance (MAD). It is concluded that the presence of Mn in the alloy affects the magnetic character of the alloy while maintaining high yield strength and ultimate tensile strength, in spite of reductions in the total Ni and Sn content.

Some trends are noteworthy for the T3-based alloys of Table B. The ultimate tensile strength (UTS) is largely unaffected by Mn up to at least 11% Mn (less than about 10 ksi variation). The yield strength is relatively unaffected by increasing Mn, but there does appear to be a slight decrease in YS over the 11% Mn range (about 10 ksi). The ductility (as assessed by elongation in a tension test may show a minimum value between 0 and 11% Mn. The magnetic attraction distance, R, continuously increases up to about 11 cm.

Table C contains the result for several Cu-9Ni-6Sn-xMn (T2-based) alloys (Ni:Sn ratio~1.5) which were characterized for both mechanical properties at the peak aged condition and the respective magnetic strength. In these alloys, there was a marked reduction in peak aged strength with increasing Mn content. Although not completely characterized for the Cu-9Ni-6Sn-xMn alloys, it seems that magnetic strength increases with increasing Mn content, similar to the T3-based alloys in Table B (Ni:Sn ratio~1.9).

TABLE C

| Composition | Ni (wt %) | Sn (wt %) | Mn (wt %) | 0.2% YS (ksi) | UTS (ksi) | % Elong | Hardness (HRB) | R (cm) |
|---|---|---|---|---|---|---|---|---|
| J | 9 | 6 | 0 | 106 | 124 | 6 | 26.5 HRC (estimated 107 HRB) | 0.0 |
| E | 9 | 6 | 5 | 75 | 112 | 10 | 95.7 | 6.7 |
| G | 9 | 6 | 8 | 66 | 101 | 8 | 93.2 | 5.2 |
| F | 9 | 6 | 20 | 62 | 107 | 20 | 96.5 | 4.6 |

Some trends are noteworthy for the T2-based alloys of Table C. The strength properties are markedly decreased by the addition of Mn at the peak aged condition. A loss is seen for yield strength of about 40 ksi and ultimate tensile strength of about 25 ksi. The magnetic parameter, R, exhibits a peak value between 0 and 8% Mn. Unfortunately, composition F, the 20% alloy, provides only limited insight into both mechanical and magnetic characteristics beyond the 8% Mn alloy and was not fully solution annealed prior to determining aging response. This is because the alloy was susceptible to cracking during water quenching immediately after solution annealing in excess of 1385° F.

Referring now to Table D, one composition with Ni:Sn~1.8 (Cu-11Ni-6Sn-20Mn; composition D) showed very low yield strength and ultimate tensile strength at nominally peak aging. There was also a tendency for this composition to crack during solution annealing during the water quench at higher solution annealing temperatures (>1385° F.). This is similar to the behavior of composition F, which may indicate a different metallurgical effect at high Mn content.

TABLE D

| Composition | Ni (wt %) | Sn (wt %) | Mn (wt %) | 0.2% YS (ksi) | UTS (ksi) | % Elong | Hardness (HRB) | R (cm) |
|---|---|---|---|---|---|---|---|---|
| D | 11 | 6 | 20 | 56 | 103 | 19 | 94.8 | 4.5 |

Manganese has an effect on the mechanical properties of the Cu—Ni—Sn system where the ratio of Ni:Sn is in the range of 1.5 to about 1.9. FIGS. 38A-38E are five graphs showing the relationship of the manganese content of the alloys of Tables B, C, and D to various mechanical properties. These graphs show the Cu-15-Ni-8Sn-xMn (T3-based) and Cu-9Ni-6Sn-xMn (T2-based) alloys have peak aged mechanical properties dependent on Mn content.

Figure 39A:
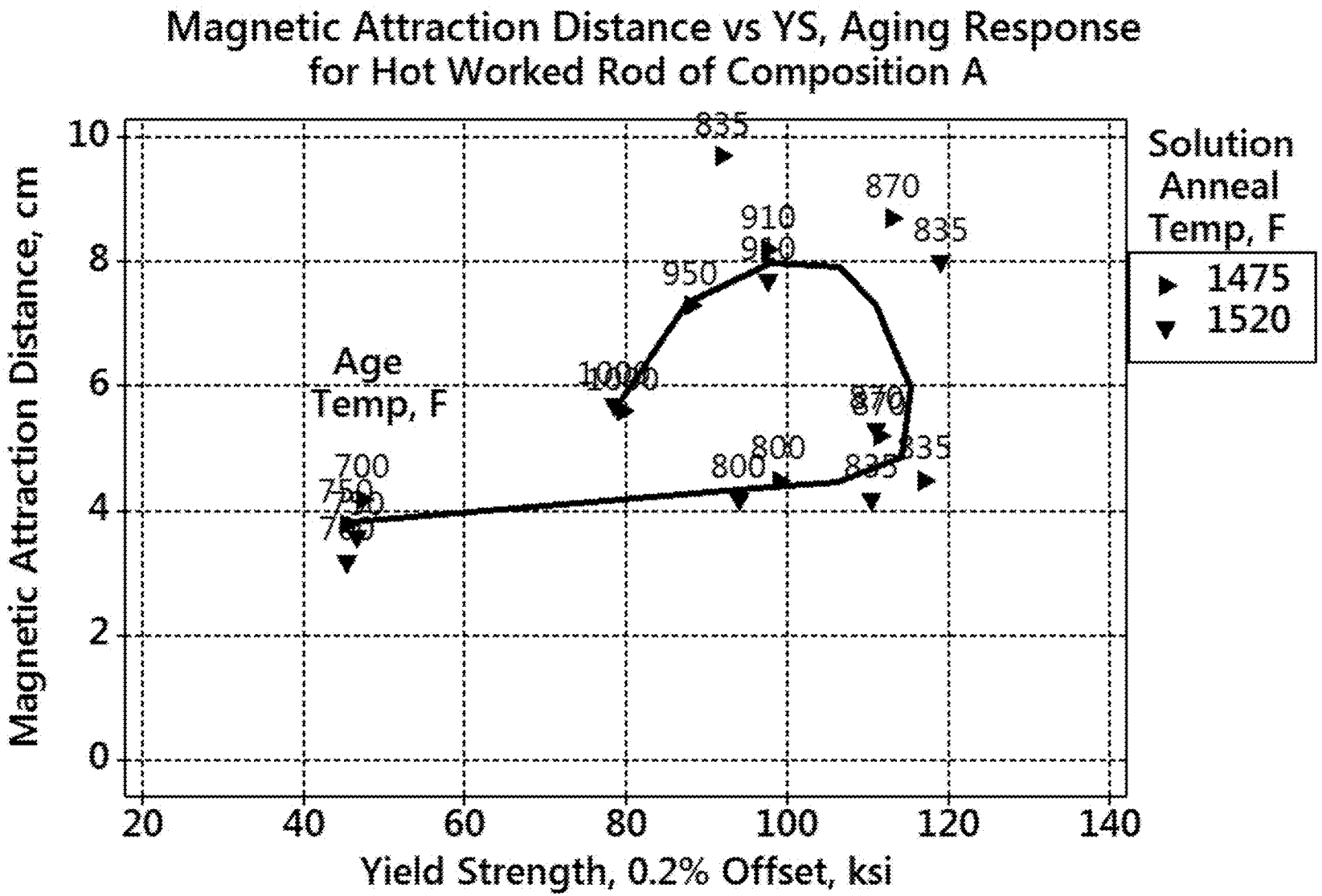
FIG. 39A is a graph of magnetic attraction distance and 0.2% offset yield strength at different aging temperatures for a Cu—Ni—Sn—Mn alloy.

From an engineering perspective, the relationship between structural capability and magnetic behavior is important. FIG. 39A shows an example of the relationship between magnetic attraction distance (MAD) and 0.2% offset yield strength for an as-extruded (as-hot-worked) rod of composition A, Cu-15Ni-8Sn-11Mn using solution annealing treatments of either 1475° F. or 1520° F. for 2 hrs, then water quenching (WQ), followed by aging at progressively increasing temperatures. In this case the respective aging treatments were in the range of about 700° F. to about 1100° F. for 2 hours, followed by air cooling. The solution annealing temperature does not appear to affect the aging response of mechanical and magnetic properties.

The peak aging of composition A occurs at the highest yield strength of about 120 ksi at near 835° F. in FIG. 39A. The magnetic attraction distance maximum occurs at approximately 850°-900° F., which is somewhat on the overaging side of the heat treat response behavior. Thus, the magnetic attraction distance (MAD) peaks at a different temperature than that for peak strength. The plot also shows that for a given yield strength, a higher magnetic attraction, MAD, is available only by overaging for these extruded, solution annealed, and aged materials.

Figure 39B:
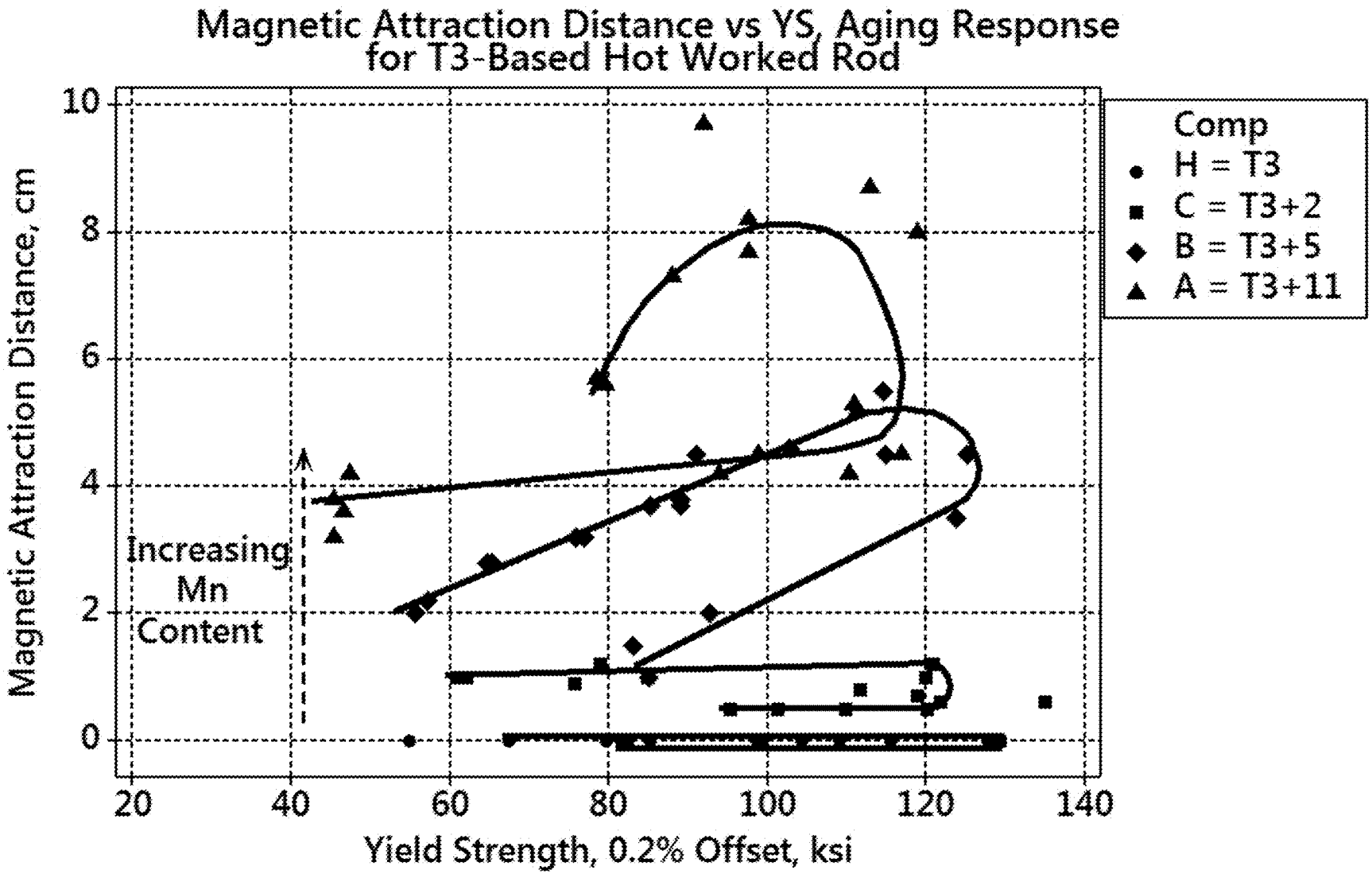
FIG. 39B is a graph of magnetic attraction distance and 0.2% offset yield strength at different aging temperatures for different Cu-15Ni-8Sn-xMn alloys.

Other compositions respond differently, as shown in FIG. 39B; the relationship between magnetic attraction distance (MAD) and 0.2% offset yield strength for four Cu-15Ni-8Sn-xMn alloys is demonstrated, including composition A from FIG. 39A. As can be observed, the system can achieve a wide range of strength-magnetic combinations. This finding shows that the alloys, as a system, can be tailored to solve an engineering problem involving structural and magnetic factors. That is, an application requiring a minimum strength with sufficient magnetic attraction can be satisfied using a broad range of combined choices of alloy compositions, and aging temperatures and times.

Figure 39C:
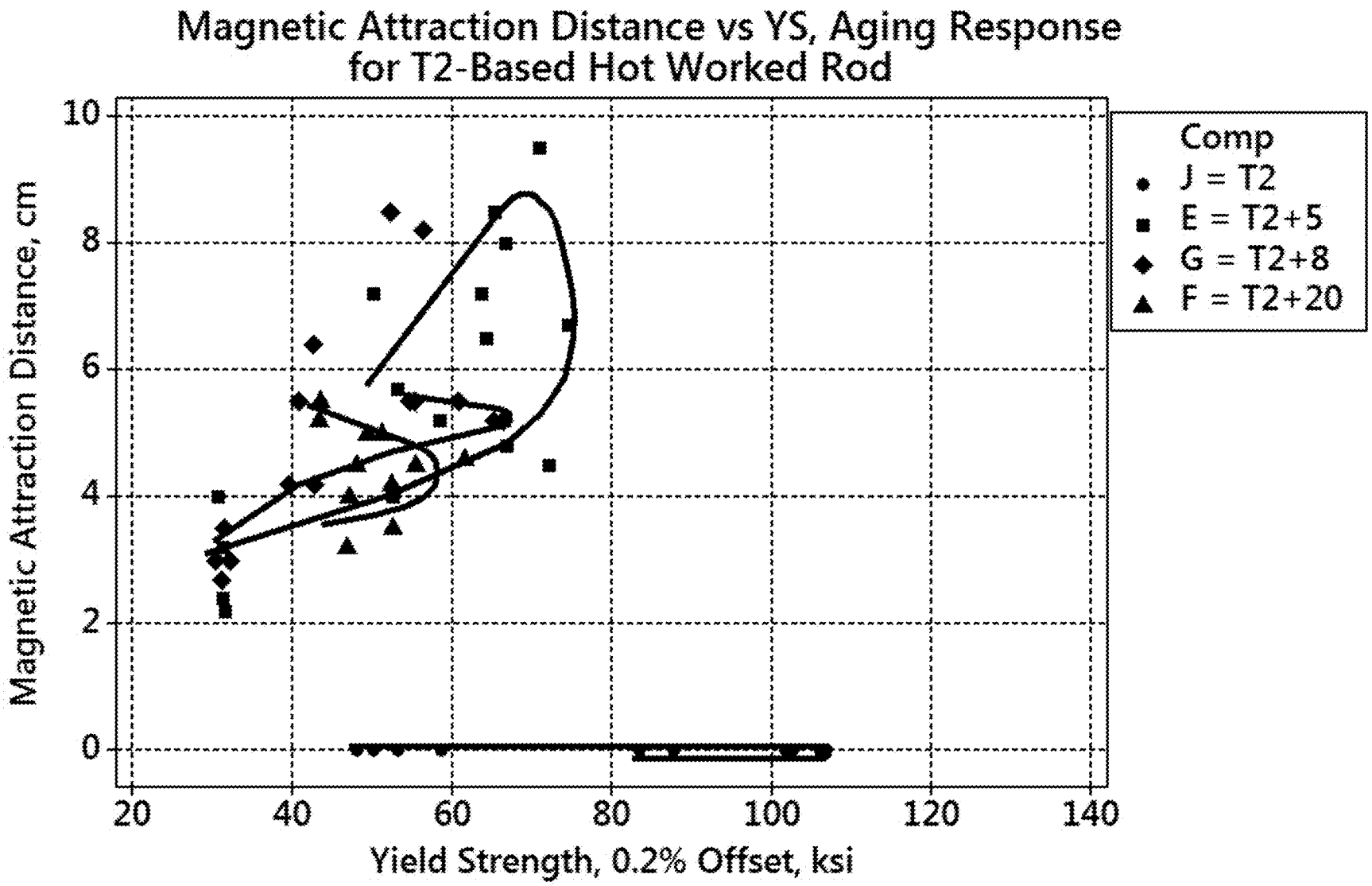
FIG. 39C is a graph of magnetic attraction distance and 0.2% offset yield strength at different aging temperatures for different Cu-9Ni-6Sn-xMn alloys.

FIG. 39C shows the relationship between magnetic attraction distance (MAD) and 0.2% offset yield strength for four Cu-9Ni-6Sn-xMn alloys. The trend for the lower Ni:Sn=1.5 alloys with increasing Mn is similar, but with the exception that yield strength is markedly reduced by the increased Mn. Magnetic attraction distance can be tailored to high values, about as high as that for the Ni:Sn=1.9 alloys.

Figure 39D:
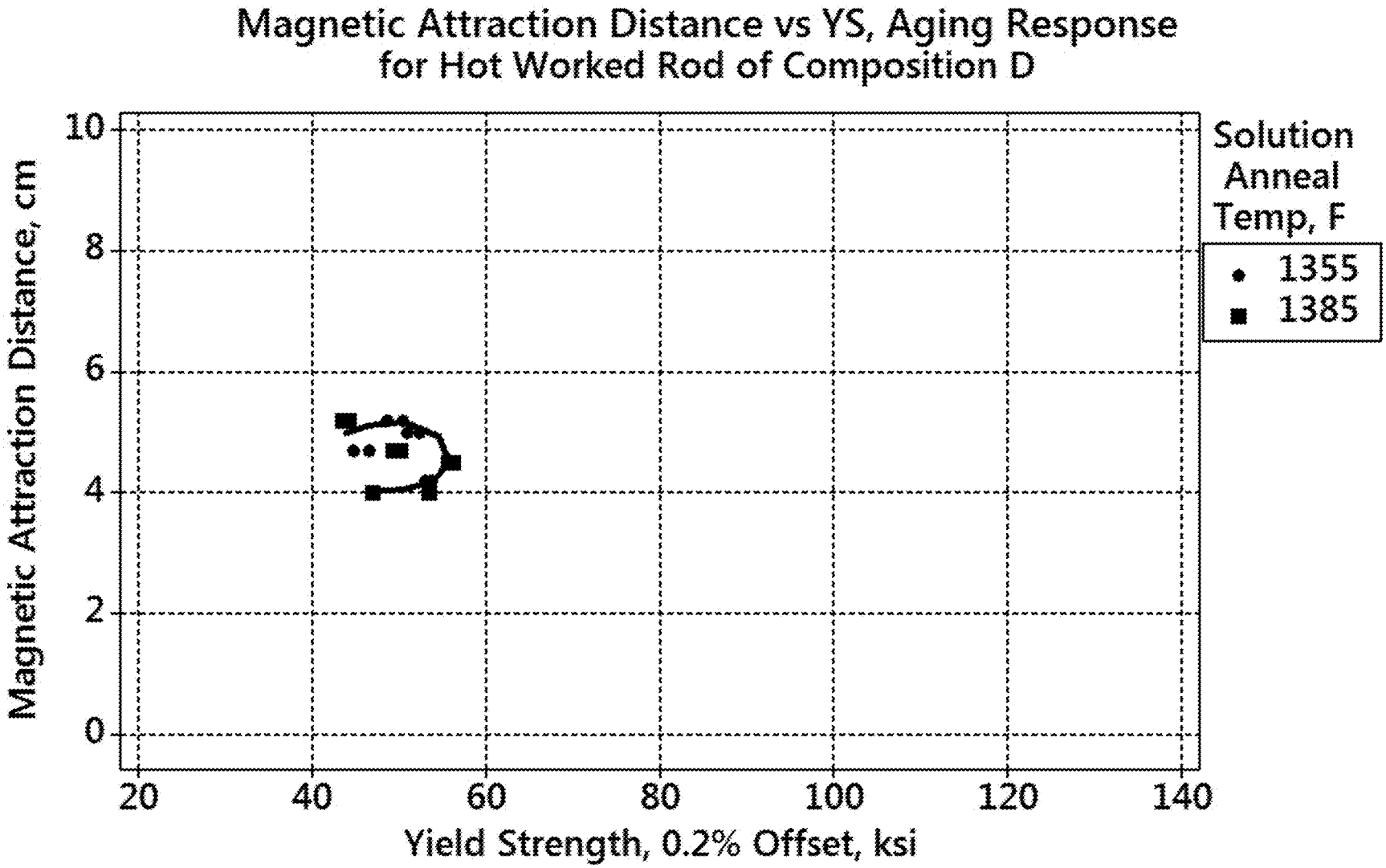
FIG. 39D is a graph of magnetic attraction distance and 0.2% offset yield strength at different aging temperatures for a Cu-11Ni-6Sn-20Mn alloy.

FIG. 39D shows the relationship between magnetic attraction distance (MAD) and 0.2% offset yield strength for the Cu-11 Ni-6Sn-20Mn alloy, composition D. The resulting magnetic attraction distances are similar to those of composition F.

Alloys F (Cu-9Ni-6Sn-20Mn) and D (Cu-11 Ni-6Sn-20Mn) have mid-range values for magnetic attraction distance R, but are very low strength alloys as seen by their YS and UTS in Tables C and D. These alloys were insufficiently solution annealed (due to cracking during water quenching immediately after the solution anneal) but, with a lower quench rate medium, might possess a broader range of strength-magnetic attraction combinations on aging.

Figure 40A:
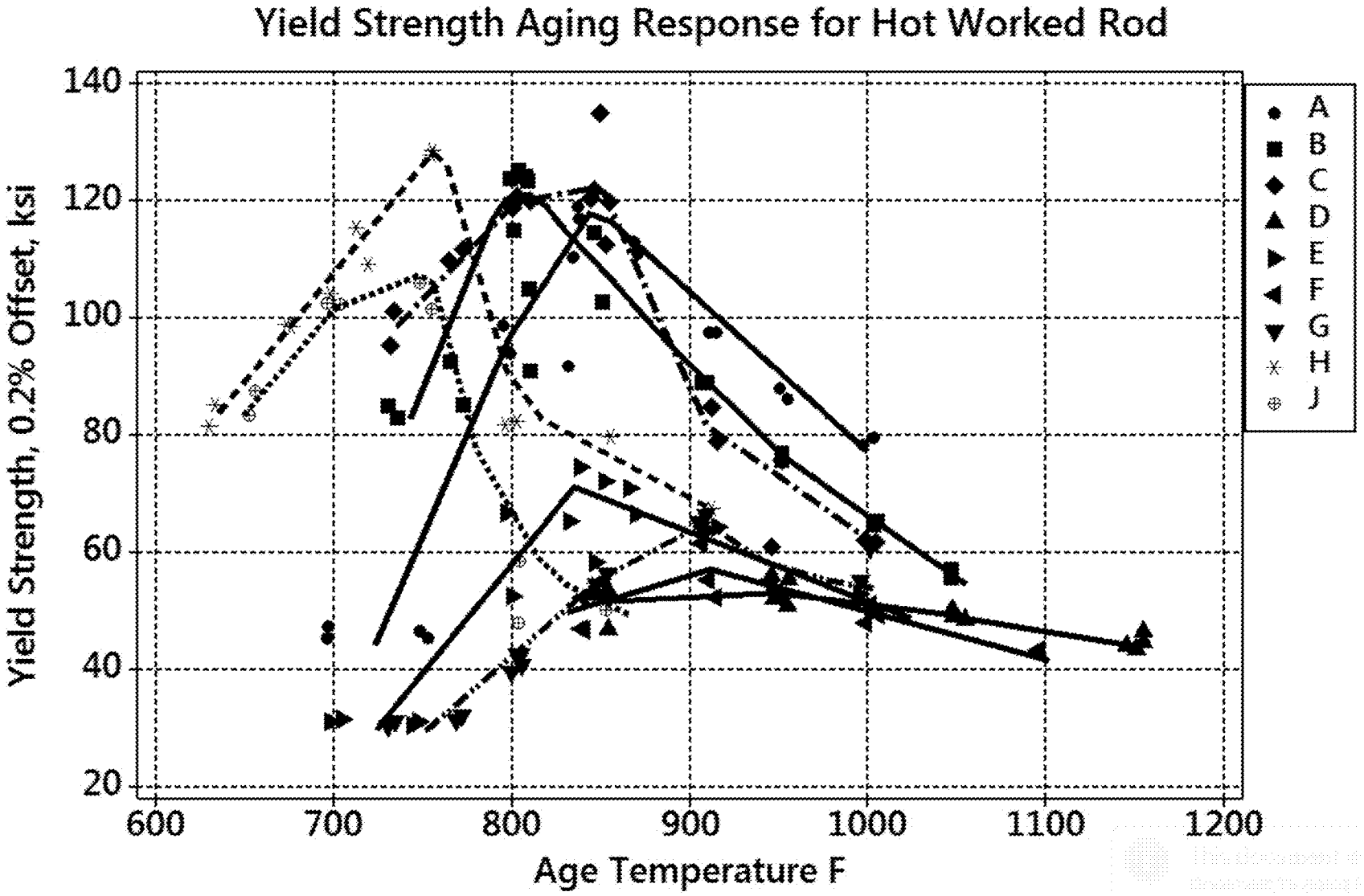
FIGS. 40A-40E are graphs showing the effect of aging temperature on mechanical properties.
Figure 40B:
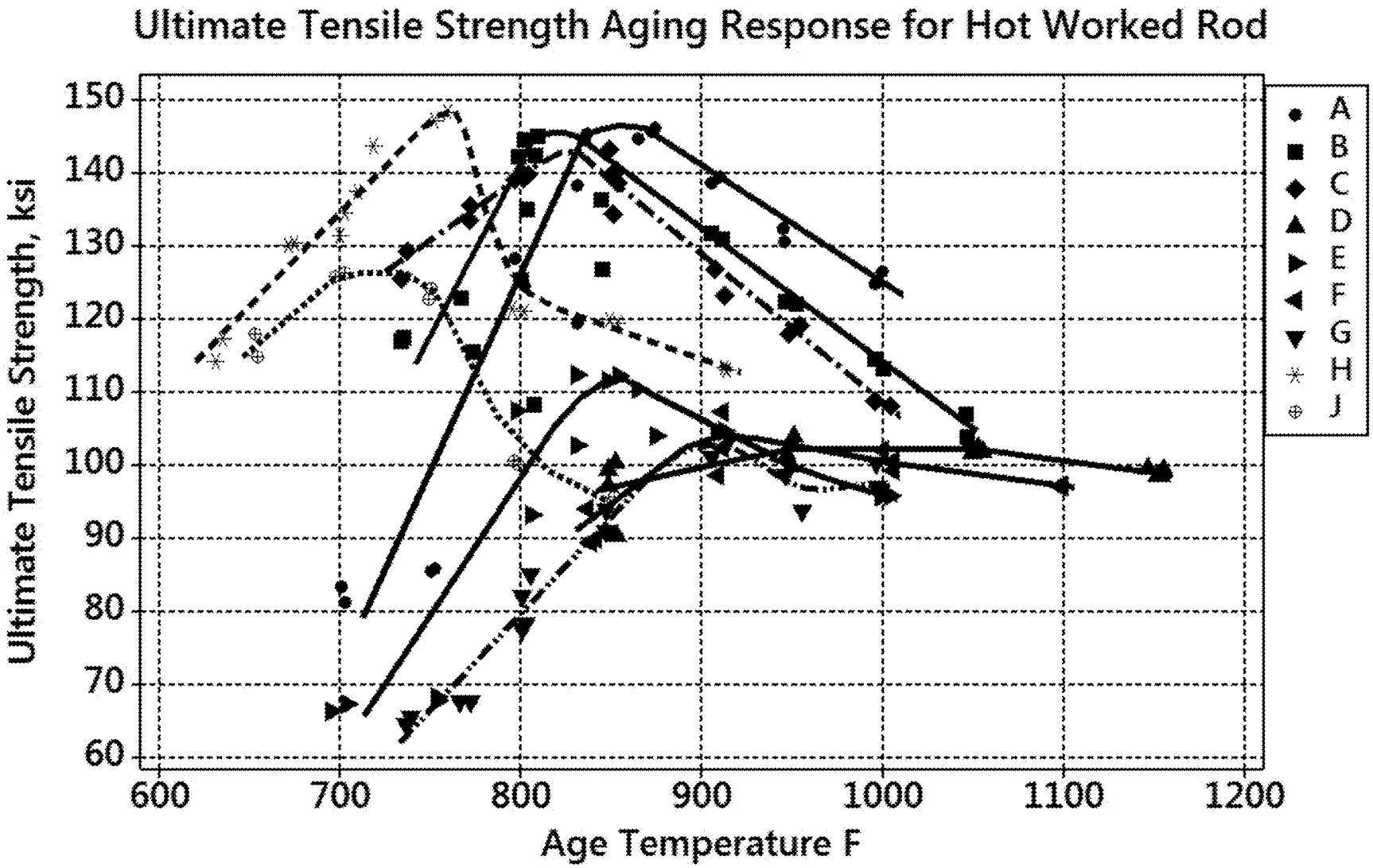
Figure 40C:
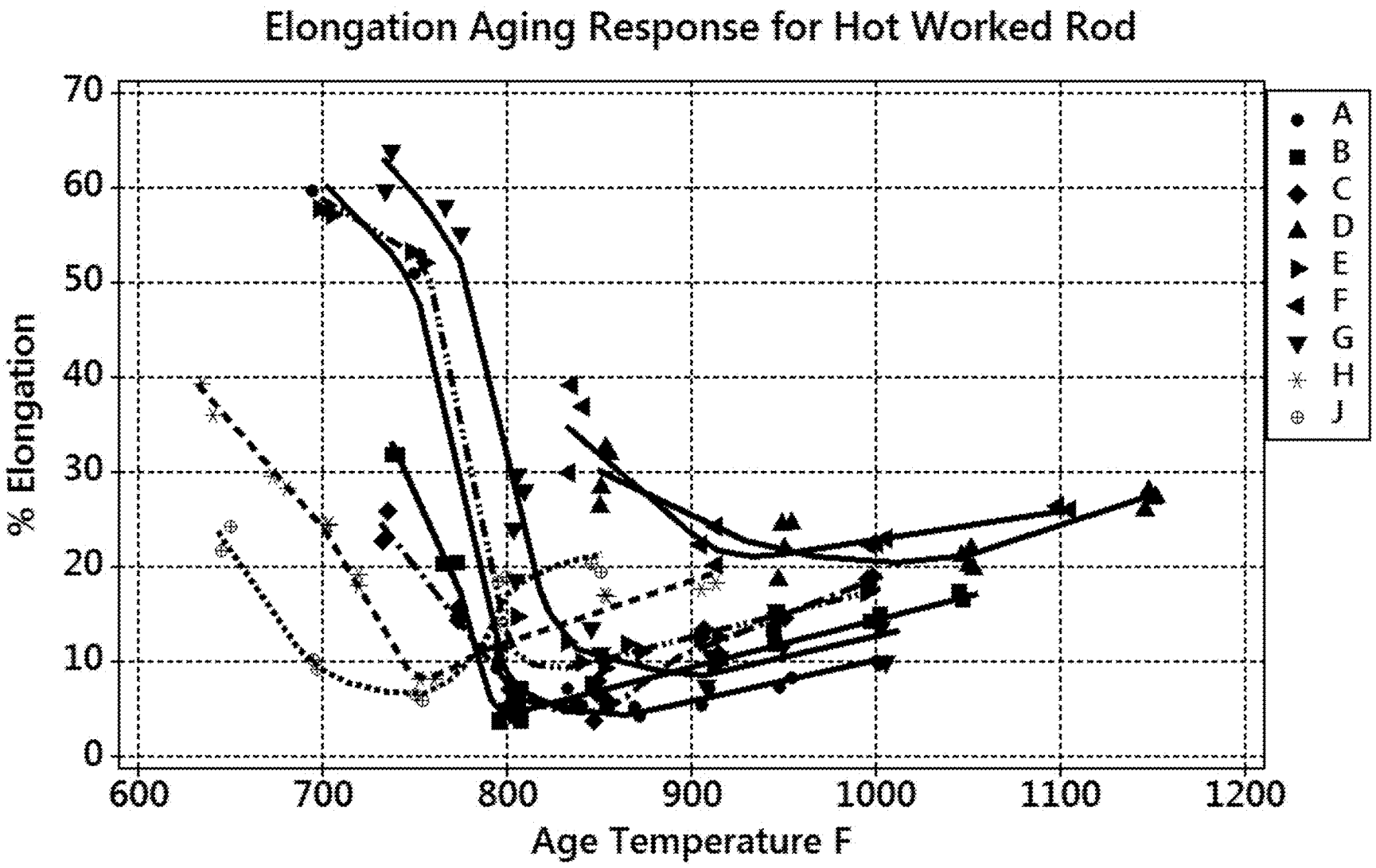
Figure 40D:
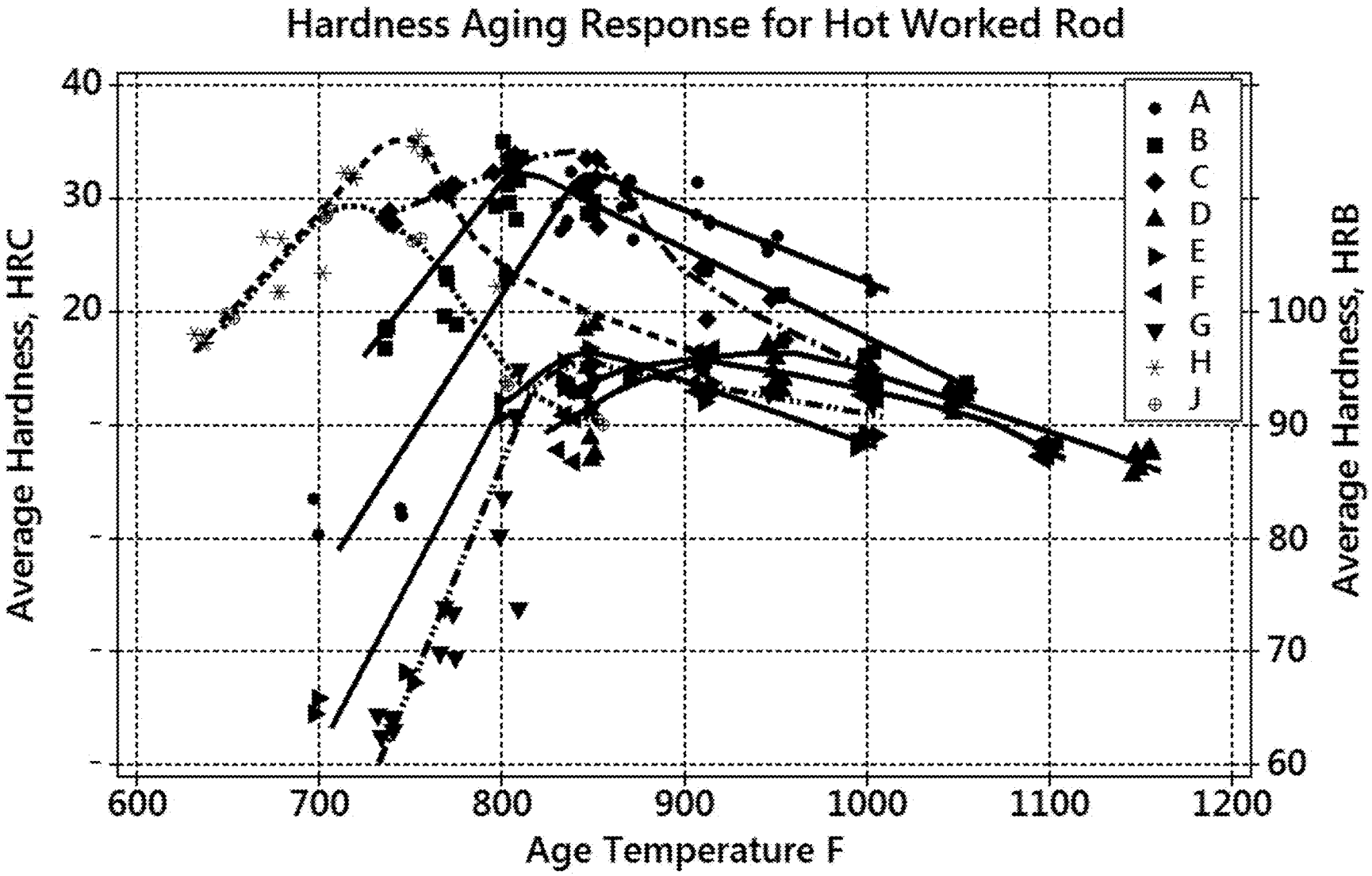
Figure 40E:
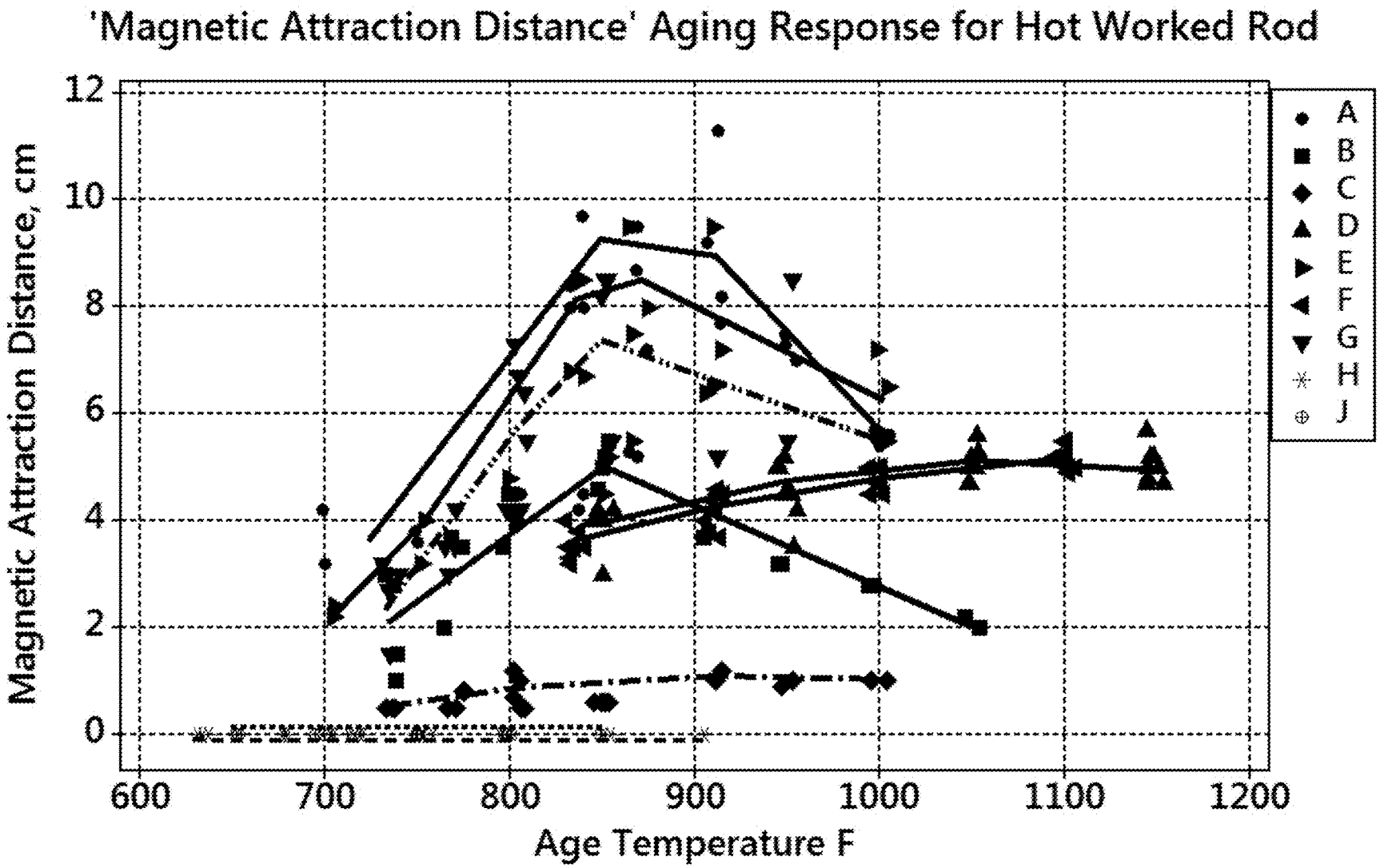

FIGS. 40A to 40E detail the aging responses of all the alloys discussed above. FIG. 40A is a graph of 0.2% offset yield strength versus aging temperature. FIG. 40B is a graph of ultimate tensile strength (UTS) versus aging temperature. FIG. 40C is a graph of % elongation versus aging temperature. FIG. 40D is a graph of hardness (HRC) versus aging temperature. FIG. 40E is a graph of magnetic attraction distance versus aging temperature. Generally, the mechanical properties and magnetic behavior of the compositions attained a maximum, or "peak", value over the aging temperature range, except for Compositions H and J, which are non-magnetic, and except for % elongation in which a minimum value was found.

Together, these graphs show that the peak conditions for both mechanical properties and magnetic attraction distance are not necessarily matched at a single aging temperature. In other words, the magnetic attraction distance may peak at a different temperature than that for peak strength (YS or UTS). This means that the alloys can be tailored to provide a combination of mechanical properties and magnetic properties. For example, an application requiring a minimum mechanical strength and a minimum magnetic attraction distance can be obtained by selecting an appropriate alloy matrix and processing that matrix at a particular aging temperature/time combination. A series of alloys with unique and predictable combinations of strength and magnetic strength can be created by a process which utilizes casting followed by homogenization, hot working, solution annealing and aging at temperatures and times sufficient to achieve a targeted combination of magnetic strength and magnetic attraction.

Fourth Set of Examples

Microstructure Examination

Throughout the processing steps, the microstructures were examined to ensure that each process accomplished its intended function. Microstructural examinations were used as one method to compare and contrast the processing outcomes for the various alloys. Microstructures were examined by eye, and by a variety of methods, such as a stereomicroscopy, optical metallography, confocal laser scanning microscopy (CLSM), scanning electron microscopy (SEM), and a scanning transmission electron microscopy (STEM). Crystal structures were determined using X-ray diffraction (XRD).

Sample preparation for stereomicroscopy, optical metallography, CLSM, SEM, and XRD involved sectioning, then grinding and polishing using progressively finer media in order to create a mirror-finish surface. Samples could be examined in the as-polished condition. In order to enhance certain phases and grain boundaries, the polished samples were then etched using a ferric nitrate, hydrochloric acid, and water solution [$Fe(NO_3)_3$+HCl+$H_2O$]. Samples could then be examined in the etched condition. For STEM, a special sample preparation technique of focused ion beam (FIB) milling was necessary in order to generate Angstroms-thick foil specimens.

Solution Annealing Treatment

Solution annealing was designed to remove the effects of previous working steps, allow constituents to go into solid solution, and through rapid cooling, keep those constituents in solution. Solution annealing could be compared to returning a metal to 'blank slate' condition, from which the metal could be processed any number ways to achieve desired mechanical properties, such as cold working or additional thermal treatments.

Figure 51A:
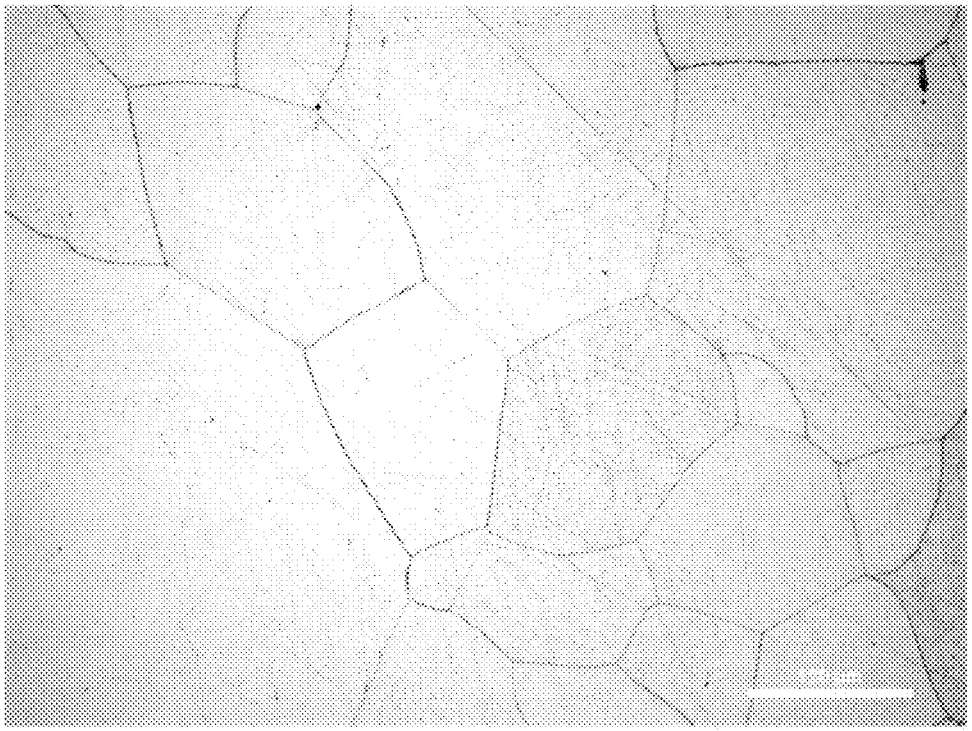
FIG. 51A is an optical image of Composition G, solution annealed at 1500° F., 200× magnification. Shown also is a 120 μm scale.
Figure 51B:
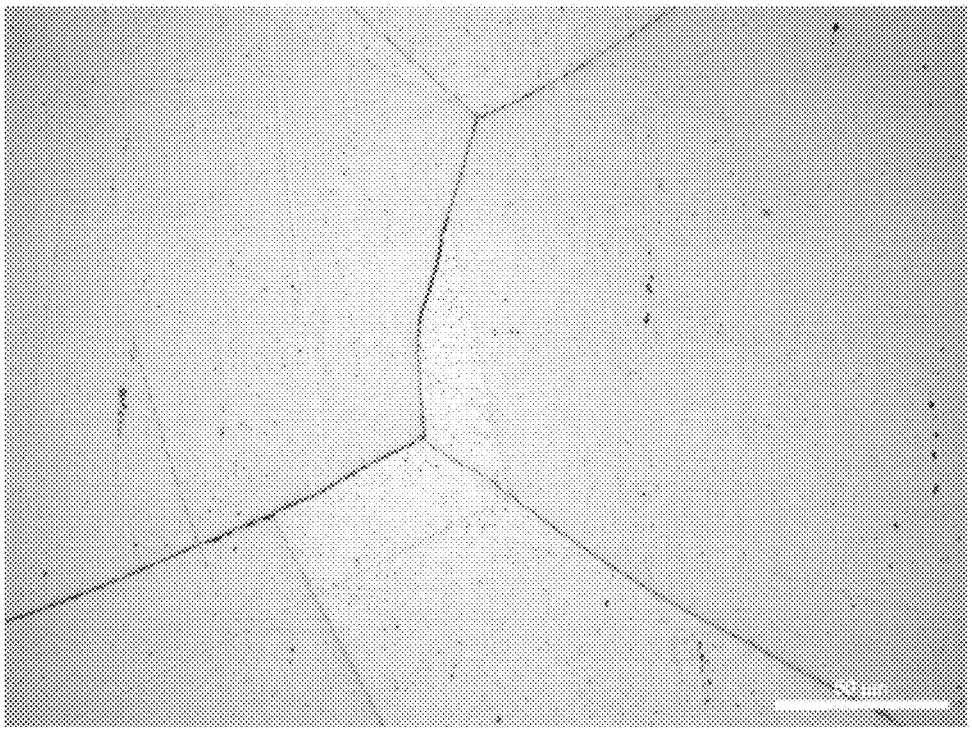
FIG. 51B is an optical image of Composition G, solution annealed at 1500° F., 500× magnification. Shown also is a 50 μm scale.

All compositions were solution annealed at five unique temperatures, and the microstructures were examined by optical microscopy. All solution annealed materials exhibited a largely equiaxed, austenitic microstructure, often containing annealing twins. No precipitates were apparent. FIG. 51A is a longitudinal micrograph of Composition G, which was solution annealed at 1500° F. This particular sample is shown in the etched condition, and the image was taken using a metallograph with bright-field illumination, at 200× magnification. FIG. 51B shows Composition G's microstructure at 500× magnification. These microstructures are representative of all materials examined in the solution annealed condition, showing featureless grain interiors, bounded by twin or grain boundaries.

Figure 52:
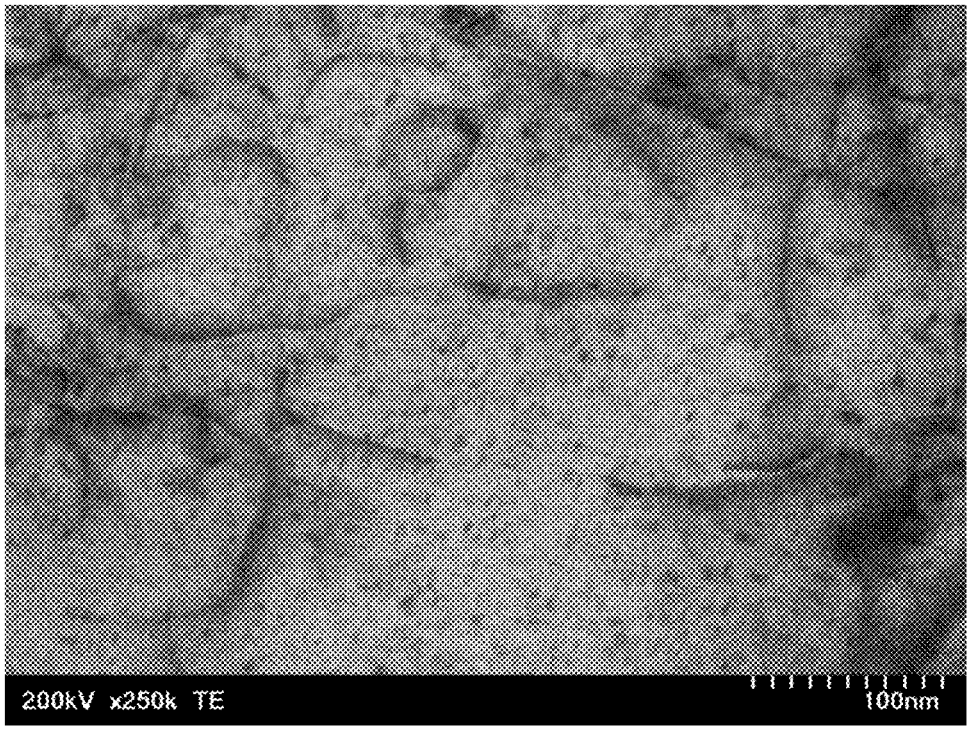
FIG. 52 is a transmitted electron image of Composition A, solution annealed at 1520° F., 250,000× magnification. Shown also is a 100 nm scale.

Next, Composition A, which was solution annealed at 1520° F., was examined by scanning transmission electron microscopy (STEM) using transmitted electron (TE) imaging. FIG. 52 shows the TE image of Composition A at 250,000× magnification. Again, no precipitates were apparent. However, dislocations were noted. Dislocations indicate linear defects in a crystal structure. Line defects are known as edge dislocations; defects in a helix are known as screw dislocations; or a combination of linear and helical defects is known as mixed dislocations.

Age Hardening

Aging was designed to enhance a material's properties through a moderately high temperature heat treatment. The property enhancements from aging are frequently attributed to the precipitation of a constituent, or a phase change.

All compositions were aged at four to nine unique temperatures. The aged materials were tested for mechanical properties, toughness, and hardness, resulting in aging response curves for each property. Those curves are shown above as FIGS. 40A-40E. Three samples of each composition were selected for microstructure examination based upon three positions in the aging curves: low ("underaged"), high ("peak"), and low ("overaged").

In the underaged condition, experimental Composition C and baseline Compositions H and J exhibited a largely equiaxed, austenitic microstructure, similar to the solution annealed samples. From underaging, to peak aging, to overaging, the microstructures of Compositions H and J progressed from occasional pearlitic precipitates at the grain boundaries, to fully transformed pearlitic microstructures.

Conversely, when aged, experimental Compositions A, B, D, E, F, and G exhibited a new intragranular precipitate, appearing as three sets of lines oriented at nominally 60° angles to each other, creating a geometrical pattern when viewed at low magnifications, less than 500×. In grains not containing twins, the uniform geometrical pattern was apparent across the entire grain. Adjacent grains showed geometrical patterns at slightly different orientations. When twins were present, the geometrical pattern within the twin was at a slightly different orientation than the pattern of the parent grain. In some experimental compositions, the perceived amount of the intragranular precipitate increased when going from the underaged, to peak aged, to overaged conditions.

Figure 53:
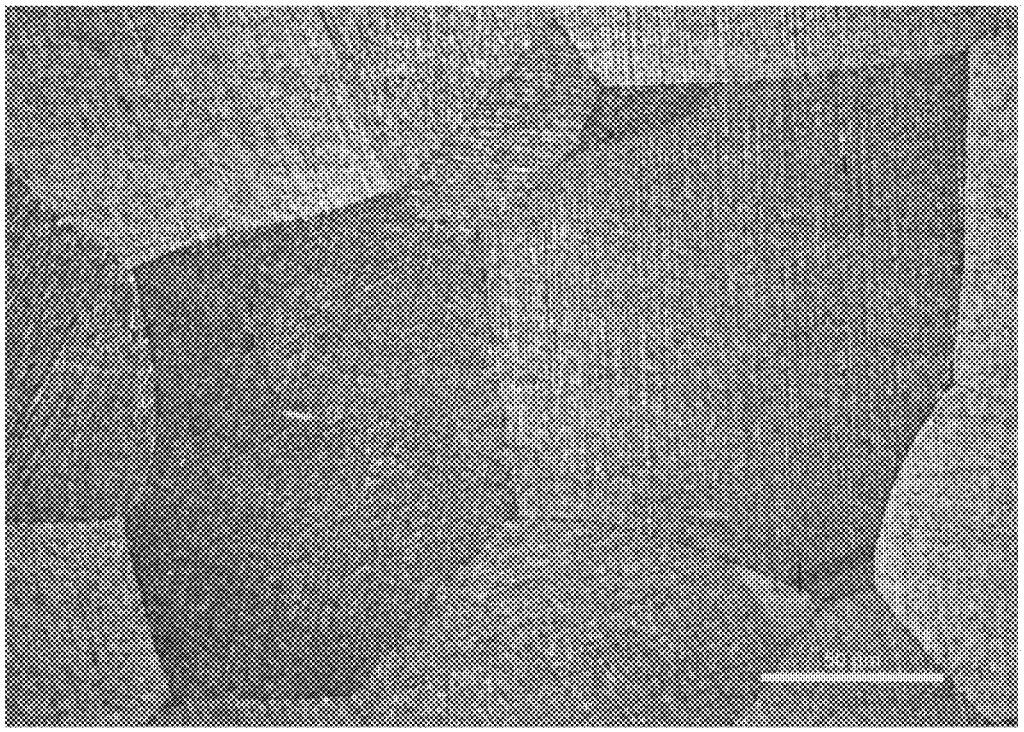
FIG. 53 is an optical image of Composition F, aged at 910° F., 500× magnification. Shown also is a 50 μm scale.

An example of the aged microstructure is shown in FIG. 53. This figure shows Composition F, which was peak aged at 910° F., in the etched condition. The image was taken at 500× magnification using a metallograph with bright-field illumination. The geometrical pattern of the intragranular precipitate appears as closely-spaced dark lines. This microstructure is representative of aged experimental compositions A, B, D, E, F, and G.

Confocal Laser Scanning Microscopy (CLSM) can enhance topographic features due to the 3-dimensional point-by-point laser scans that are reconstructed by a computer into a single image. In order to better visualize the geometrical pattern of the new phase, select samples of experimental Compositions A, F, and G were examined using CLSM.

Figure 54A:
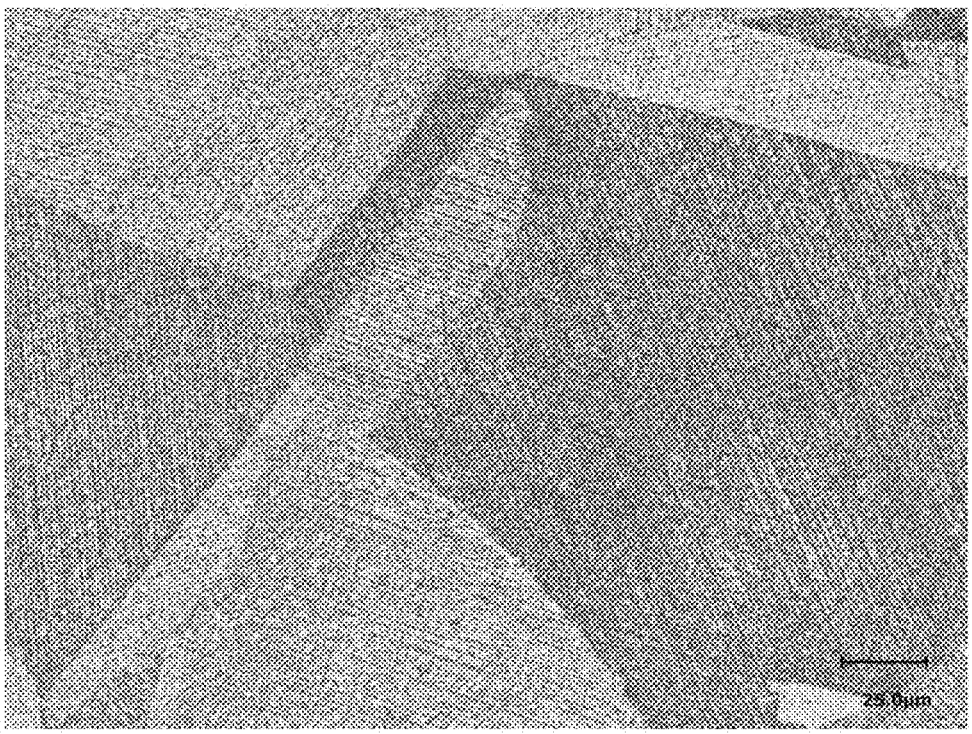
FIG. 54A is a CLSM image of Composition F, aged at 910° F., 500× magnification. Shown also is a 25 μm scale.
Figure 54B:
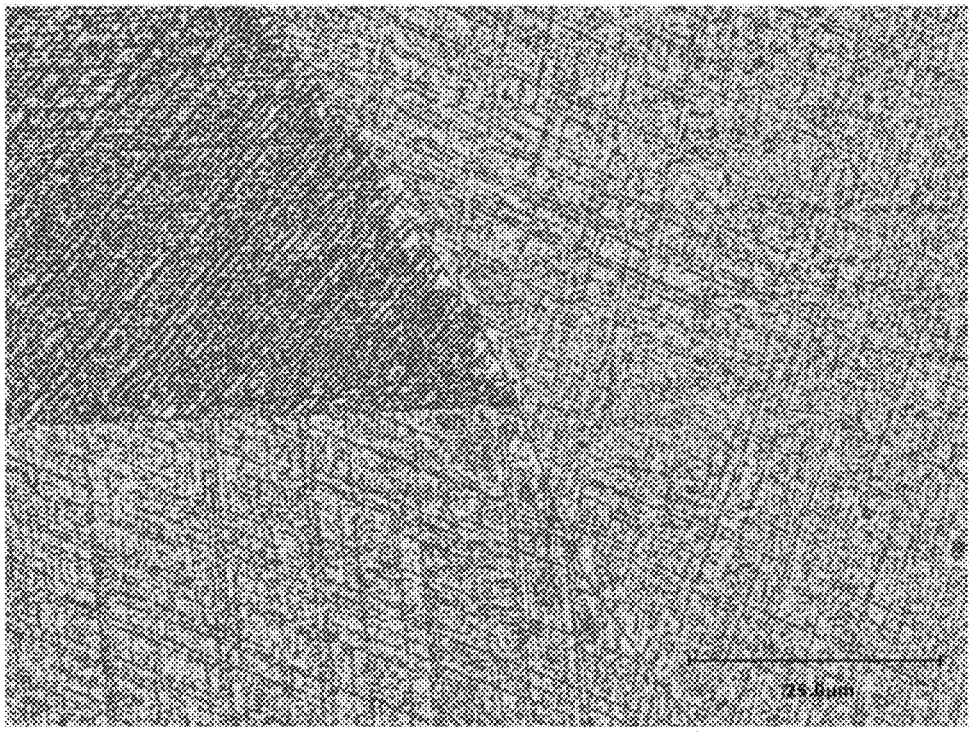
FIG. 54B is a CLSM image of Composition F, aged at 910° F., 1500× magnification. Shown also is a 25 μm scale.

FIG. 54A is the CLSM image of Composition F, peak aged at 910° F., at 500× magnification. FIG. 54B is the CLSM image of Composition F, peak aged at 910° F., at 1500× magnification. At the higher magnification, what previously appeared to be lines, now appear to be tiny, acicular precipitates oriented in a geometrical pattern.

Figure 54C:
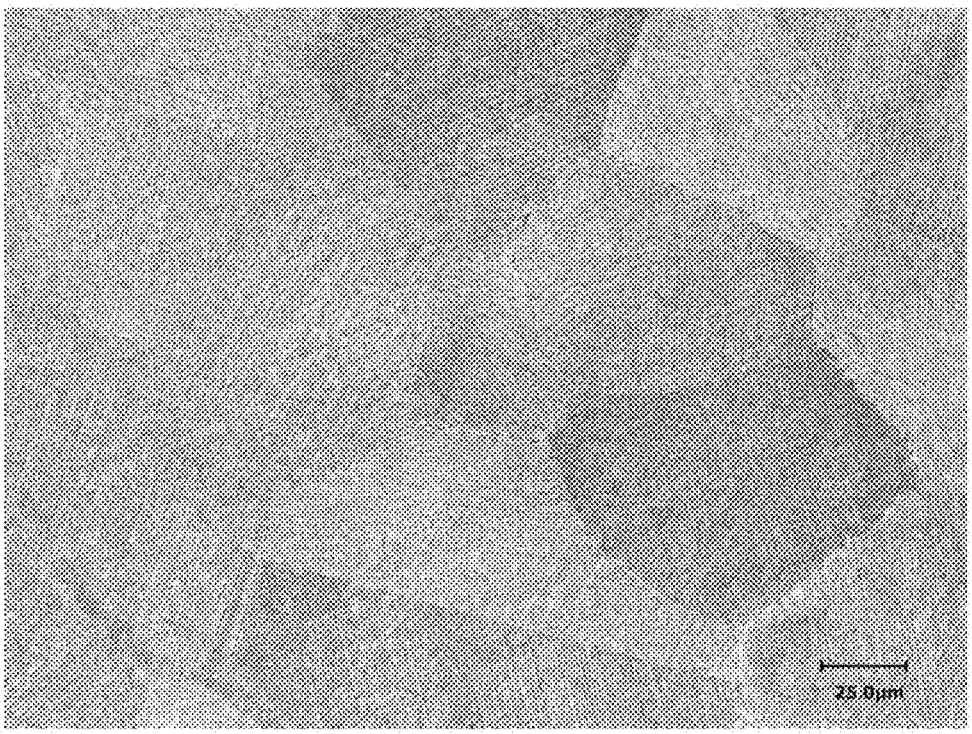
FIG. 54C is a CLSM image of Composition A, aged at 835° F., 500× magnification. Shown also is a 25 μm scale.
Figure 54D:
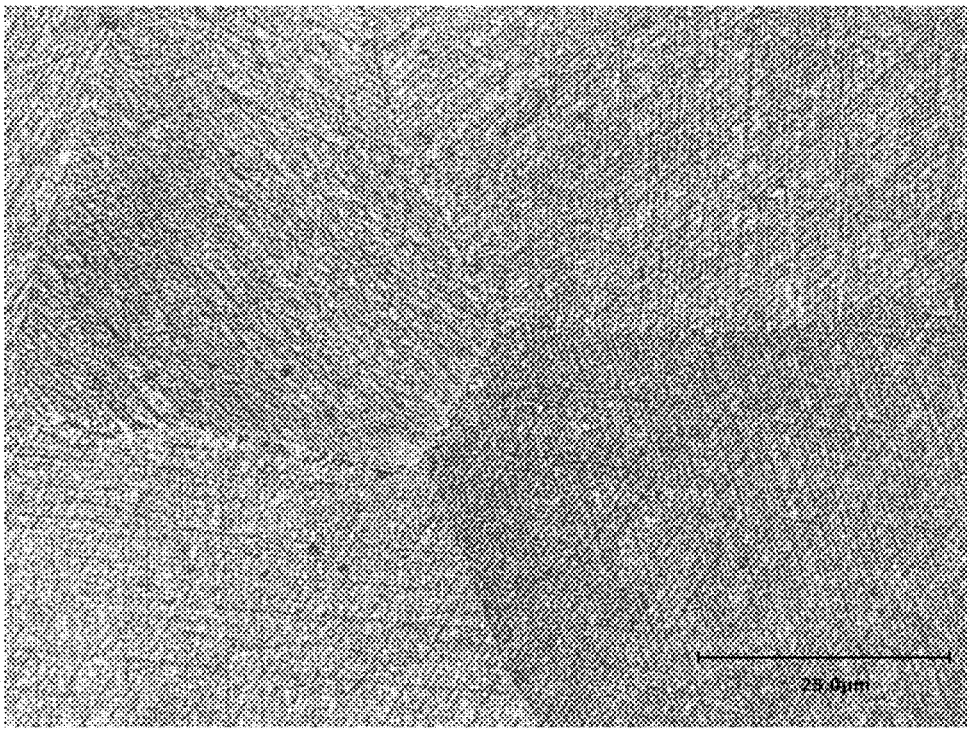
FIG. 54D is a CLSM image of Composition A, aged at 835° F., 1500× magnification. Shown also is a 25 μm scale.

FIG. 54C is the CLSM image of Composition A, peak aged at 835° F., at 500× magnification. FIG. 54D is the CLSM image of Composition A, peak aged at 835° F., at 1500× magnification. The appearance of tiny, acicular precipitates oriented in a geometrical pattern is similar to that of Composition F.

Figure 54E:
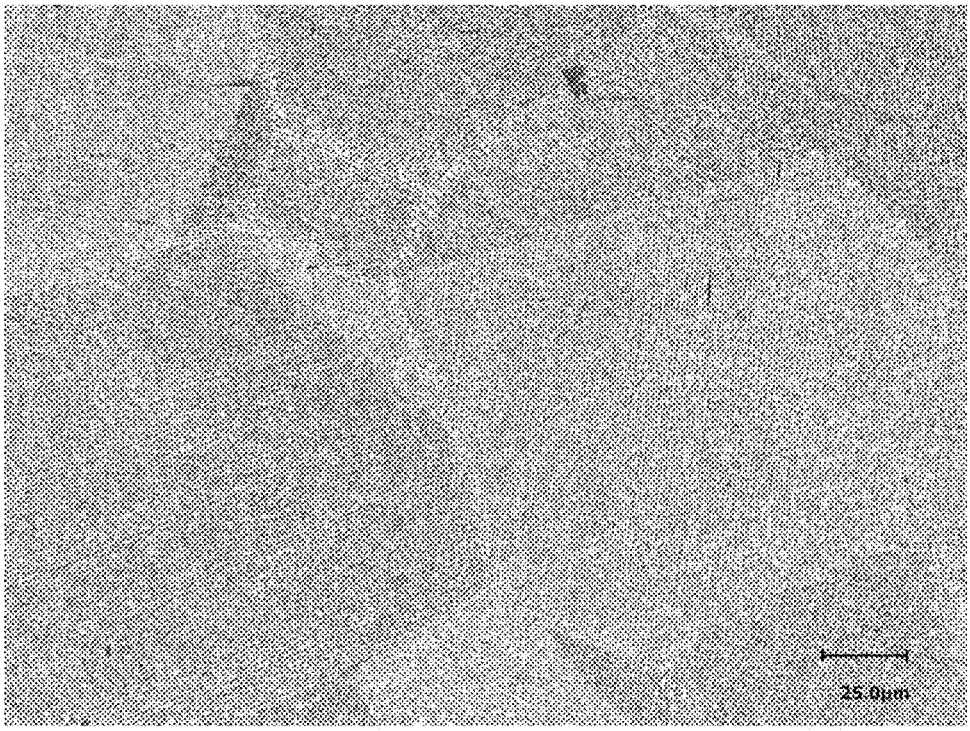
FIG. 54E is a CLSM image of Composition F, over-aged at 1100° F., 500× magnification. Shown also is a 25 μm scale.
Figure 54F:
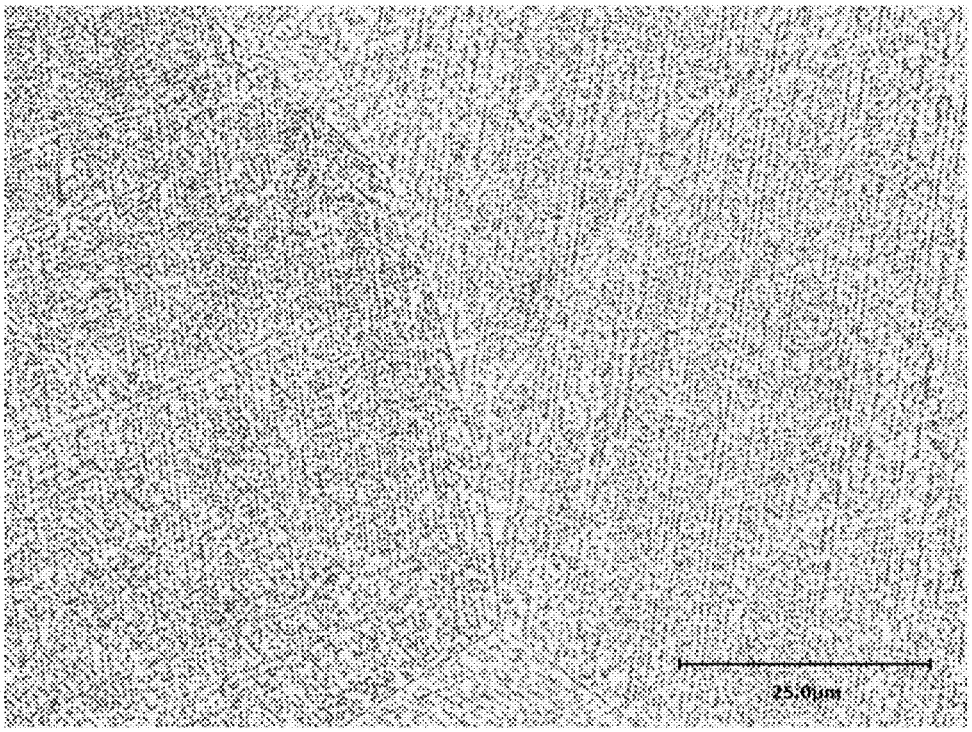
FIG. 54F is a CLSM image of Composition F, over-aged at 1100° F., 1500× magnification. Shown also is a 25 μm scale.

FIG. 54E is the CLSM image of Composition F, over-aged at 1100° F., at 500× magnification. FIG. 54F is the CLSM image of Composition F, over-aged at 1100° F., at 1500× magnification. The acicular nature of the geometrical pattern of the new phase precipitate is especially apparent here.

Figure 55A:
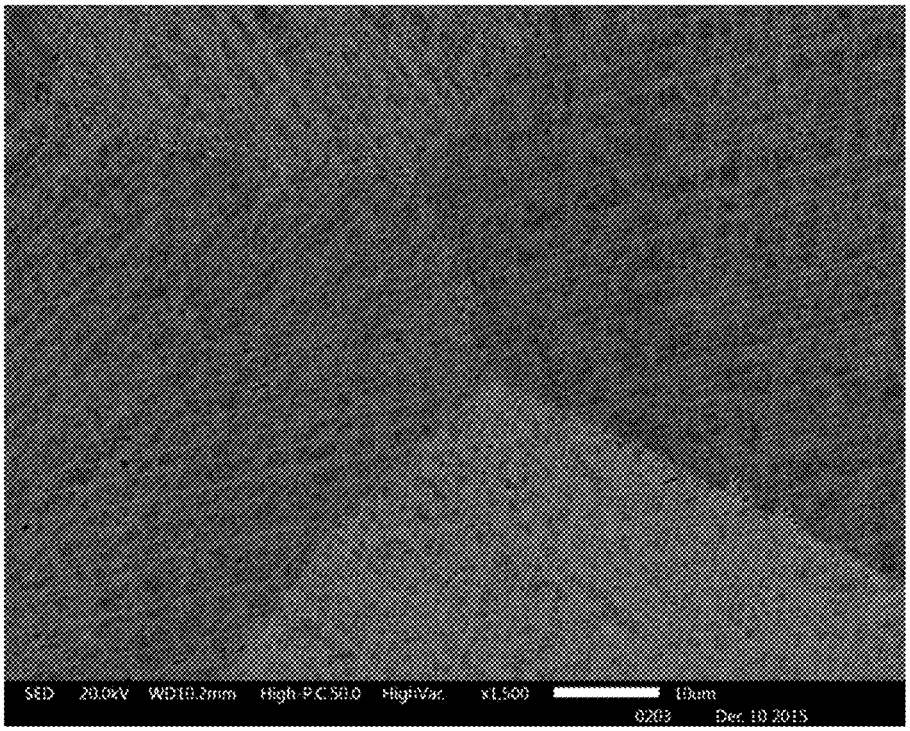
FIG. 55A is an SEM image of Composition A, over-aged at 1000° F., 1500× magnification. Shown also is a 10 μm scale.
Figure 55B:
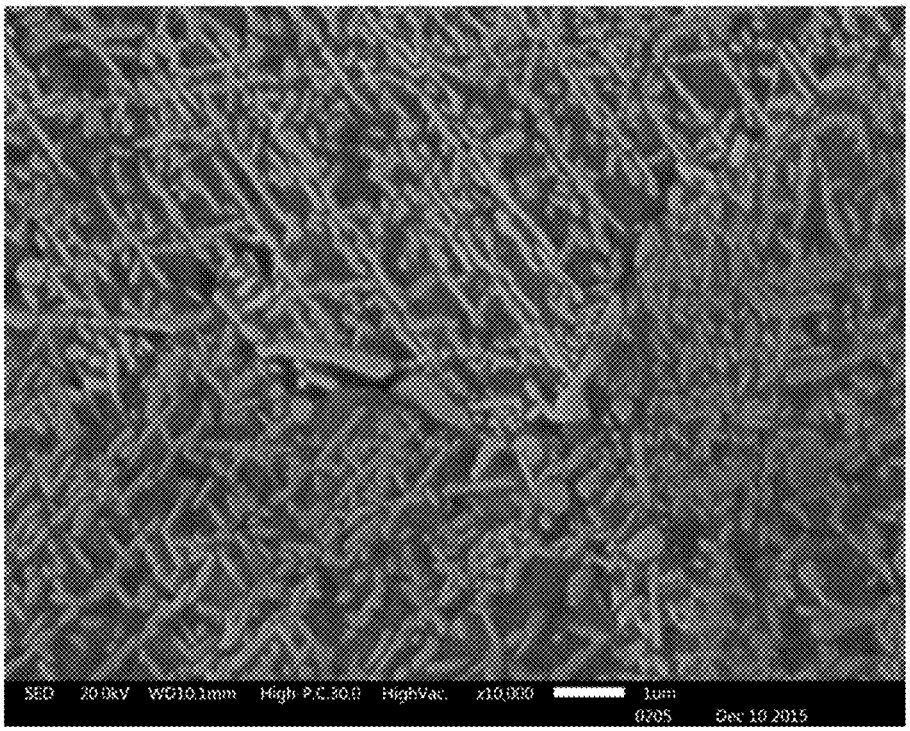
FIG. 55B is an SEM image of Composition A, over-aged at 1000° F., 10,000× magnification. Shown also is a 1 μm scale.

Scanning electron microscopy (SEM) was used to examine the etched, aged samples of experimental Compositions A and F, and baseline Composition H. FIG. 55A is the SEM image of Composition A, over-aged at 1000° F., at 1500× magnification. The geometrical pattern of the precipitate is apparent. FIG. 55B is the SEM image of Composition F, over-aged at 1000° F., at 10,000× magnification. The acicular (needle-shaped) nature of the precipitate within the grains is apparent. Irregularly-shaped precipitates and occasional pearlitic colonies were noted along the grain boundaries in some aged samples.

Figure 55C:
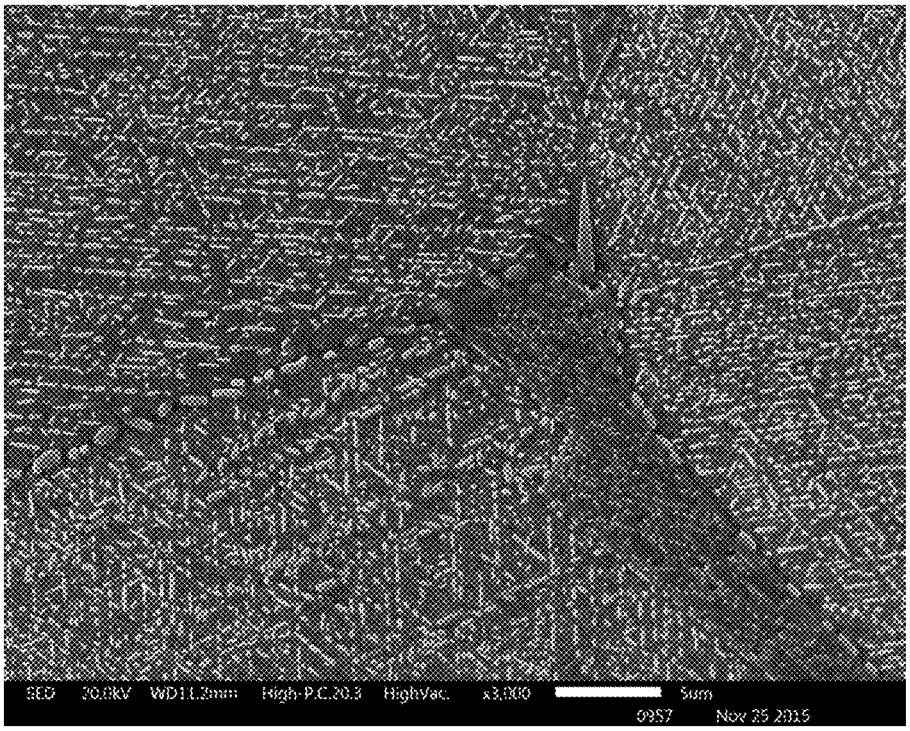
FIG. 55C is an SEM image of Composition F, over-aged at 1100° F., 3000× magnification. Shown also is a 5 μm scale.
Figure 55D:
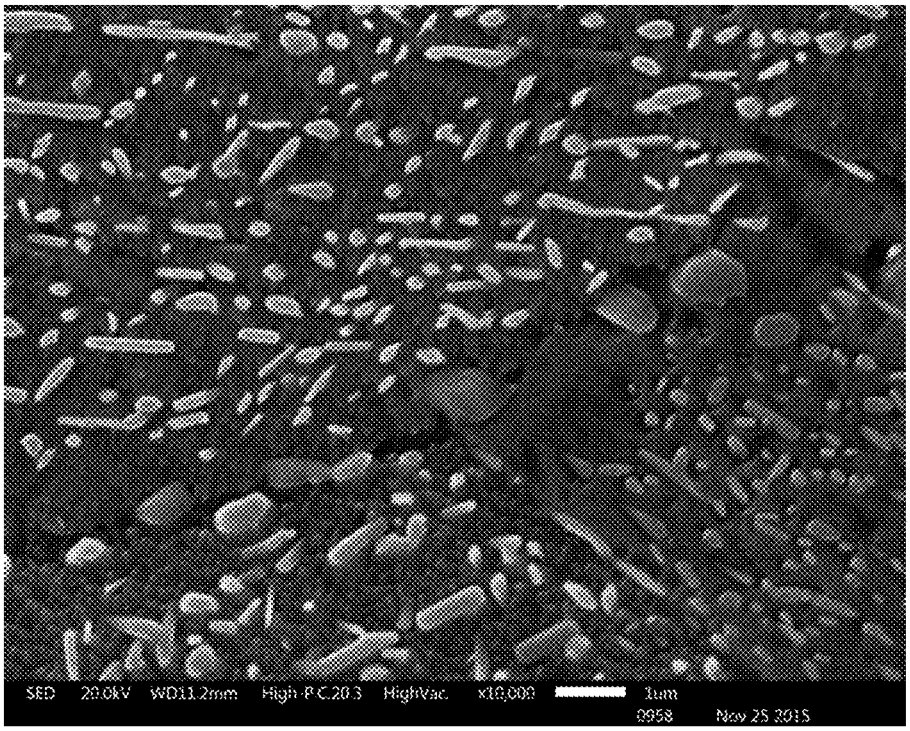
FIG. 55D is an SEM image of Composition F, over-aged at 1100° F., 10,000× magnification. Shown also is a 1 μm scale.

FIG. 55C is the SEM image of Composition F, over-aged at 1100° F., at 3000× magnification. FIG. 55D is the SEM image of Composition F, over-aged at 1100° F., at 10,000× magnification. The same geometrical pattern is seen. Also in FIG. 55C, a twin boundary is observed in the lower grain, alongside the right grain boundary. The acicular nature of the precipitate is again apparent. In FIG. 55D, the light-colored, acicular phase appears to protrude from the dark, etched substrate. Again, irregularly-shaped precipitates are apparent along the grain boundaries.

References have been made above to a "geometrical pattern". In FIGS. 60A-60F, lines have been drawn over the images previously shown in FIGS. 53, 54A-54F, 55A, and 55C to illustrate/confirm the nominal 60° angular relationship of the three sets of lines in the geometrical pattern.

Figure 56A:
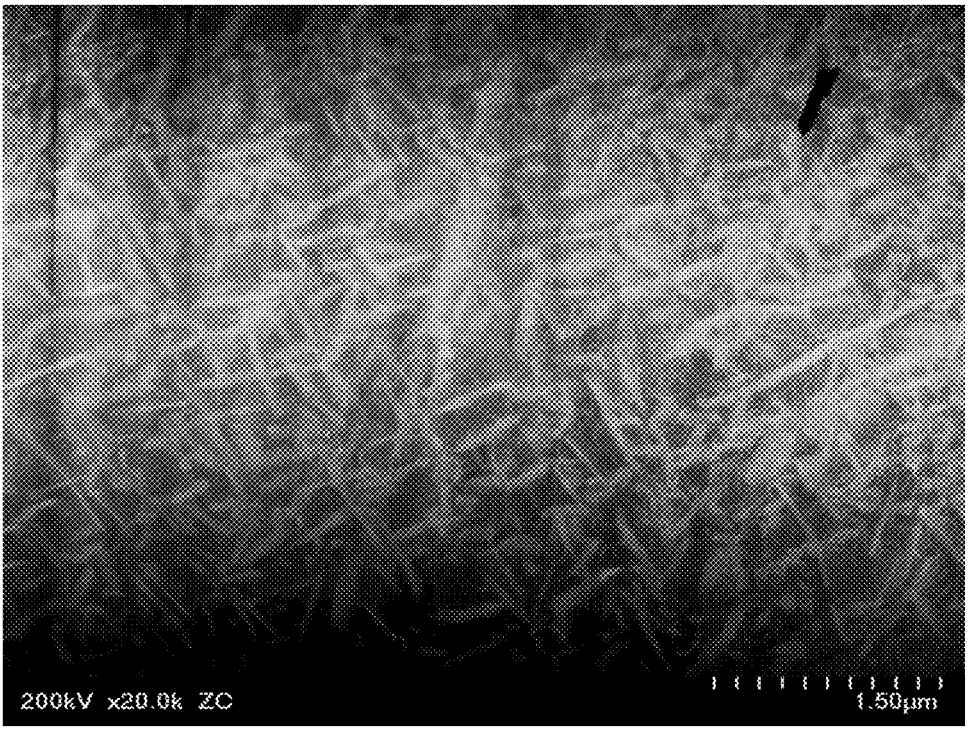
FIG. 56A is a ZC image of Composition A, over-aged at 910° F., 20,000× magnification. Shown also is a 1.5 μm scale.

Next, a sample of experimental Composition A, slightly over-aged at 910° F., was selected for examination by scanning transmission electron microscopy (STEM). The foil sample was examined using transmitted electron (TE) and Z-contrast (ZC; or atomic number contrast) imaging up to 1,800,000× magnification. FIG. 56A shows a 20,000× magnification ZC image of Composition A. The precipitates appear very similar to the SEM images of FIG. 55A and FIG. 55B, however, the precipitates' acicular nature is better able to be visualized by STEM. The lighter color of the precipitates in ZC imaging indicates that the precipitates contain an element (or elements) with a higher atomic number than the substrate.

Figure 56B:
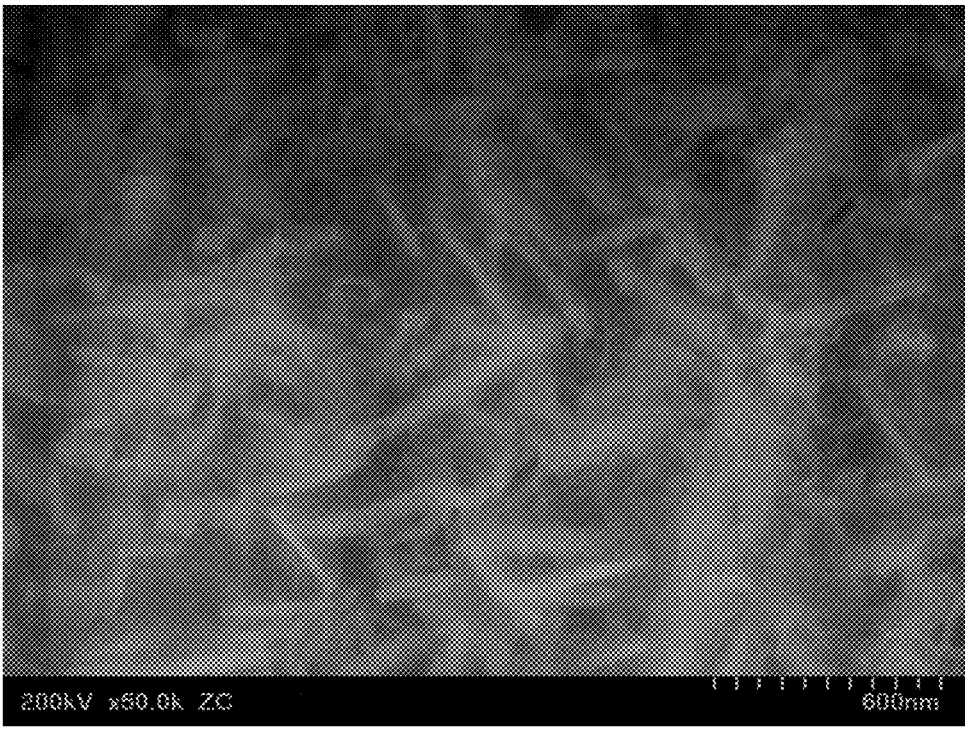
FIG. 56B is a ZC image of Composition A, over-aged at 910° F., 50,000× magnification. Shown also is a 600 nm scale.
Figure 56C:
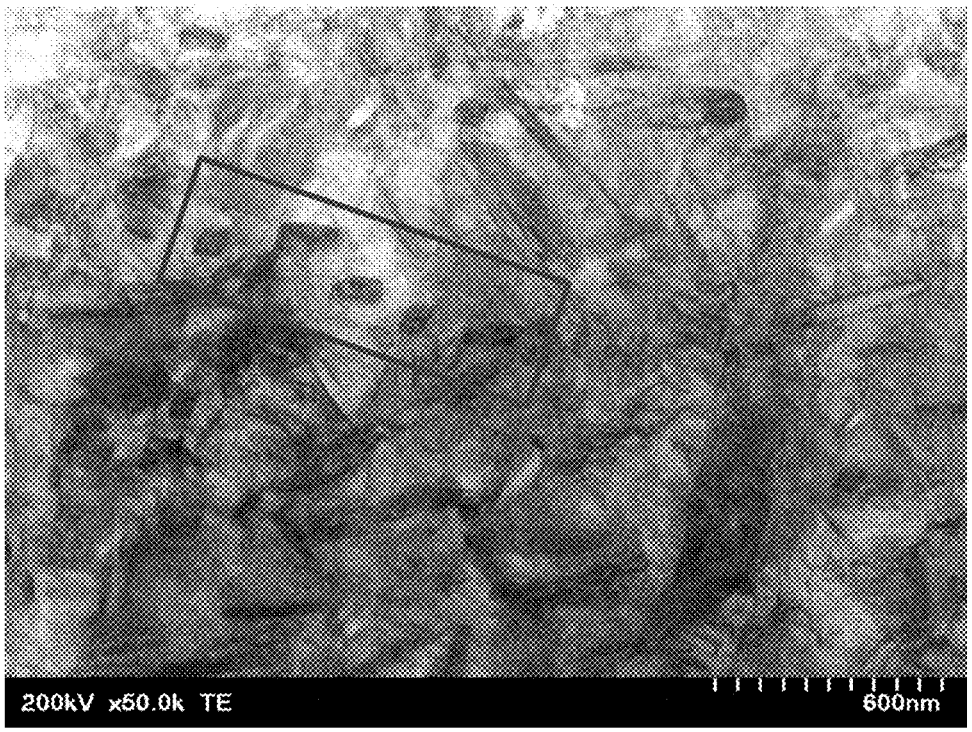
FIG. 56C is a transmitted electron image of Composition A, over-aged at 910° F., 50,000× magnification. Shown also is a 600 nm scale.

FIG. 56B is a 50,000× magnification ZC image of Composition A. FIG. 56C is a 50,000× magnification, except using TE imaging. With the Angstroms-thin nature of the foil sample, the high energy electrons are able to pass through the foil resulting in a TE image similar to a radiograph (X-ray image). A series of about six precipitates in FIG. 56C (encircled by a box) appear to be oriented in an axis nearly pointing toward the viewer (end-on). This perspective suggests that the precipitates are in the shape of flattened rods.

Crystal Structure by X-Ray Diffraction (XRD)

Next, samples were taken for XRD testing from extruded rods. Radial and transverse samples were taken, centered on the mid-radius of the rods. One set of samples was only solution annealed, while a second set of samples was solution annealed and then aged. X-ray diffractometry (XRD) was used to determine the crystallographic structures (atomic arrangement) and lattice parameters (interatomic distances) of these samples. The samples are identified in Table E below. Again, please note that Composition H has no manganese.

TABLE E

| ID No. | Composition | Source | Magnetic Attraction Distance (cm) | SA Temp (° F.) | Age Temp (° F.) |
|---|---|---|---|---|---|
| 14 | A | Rod | 1.7 | 1520 | — |
| 6 | A | Rod | 11.3 | 1475 | 910 |
| 15 | E | Rod | 1.0 | 1400 | — |
| 7 | E | Rod | 9.5 | 1400 | 910 |
| 17 | H | Rod | 0.0 | 1475 | — |
| 16 | H | Rod | 0.0 | 1475 | 715 |

Figure 57:
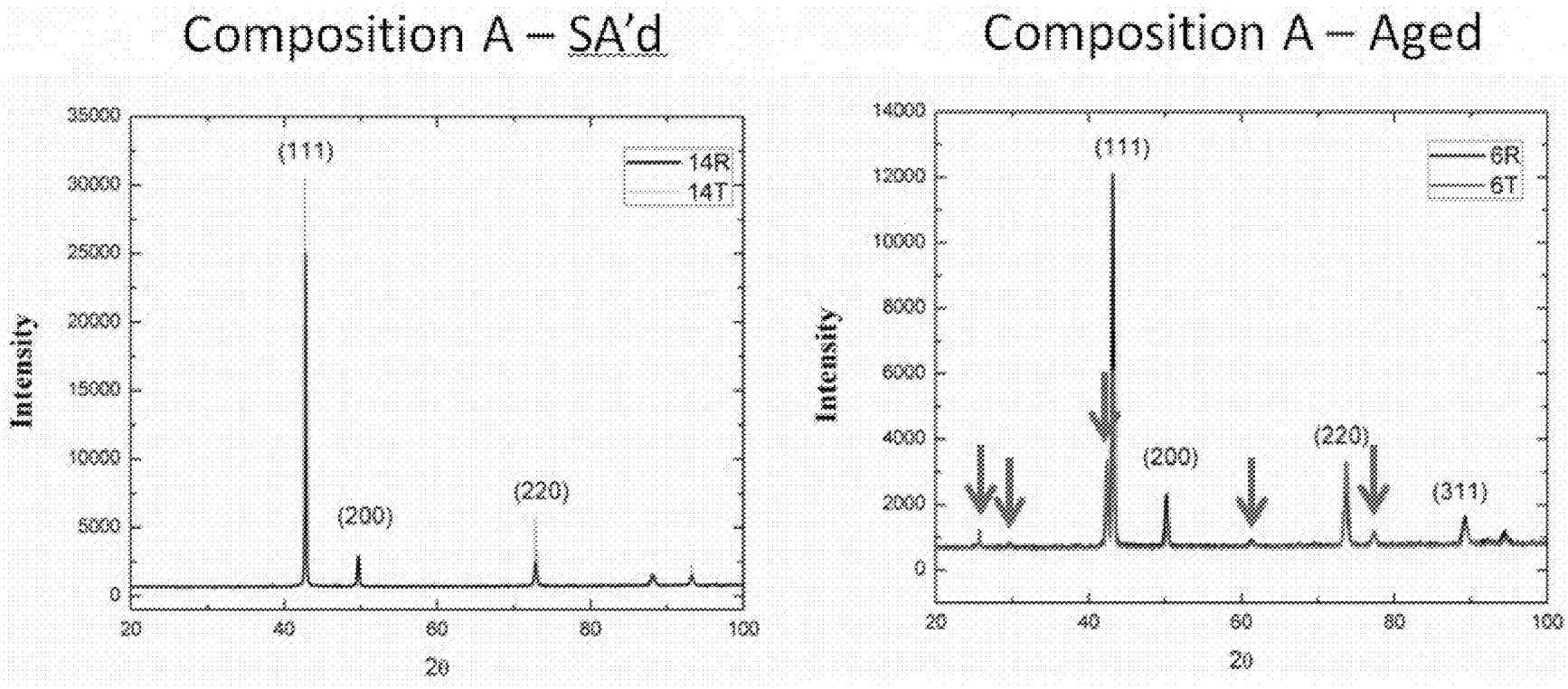
FIG. 57 is a set of two graphs comparing a solution annealed manganese-containing composition (A; unaged) to the same composition after aging, showing a new phase.

FIG. 57 compares Samples 14 and 6 (i.e. Composition A). "R" indicates the radial sample, and "T" indicates the transverse sample. X-ray spectra showed that Composition A exhibited a face-centered cubic (FCC) structure with about a 3.6 Angstrom (A) lattice parameter in the solution annealed condition (see left). However, upon aging, a new FCC phase was apparent with about a 6.1 Å lattice parameter, comprising 14-15% of the structure by weight. The aged sample (Sample 6) has peaks indicating a new phase, marked by arrows in FIG. 57. The peak positions of the new phase are shifted from the parent phase, but the crystallographic planes are the same, indicating that only the lattice parameters are different.

Figure 58:
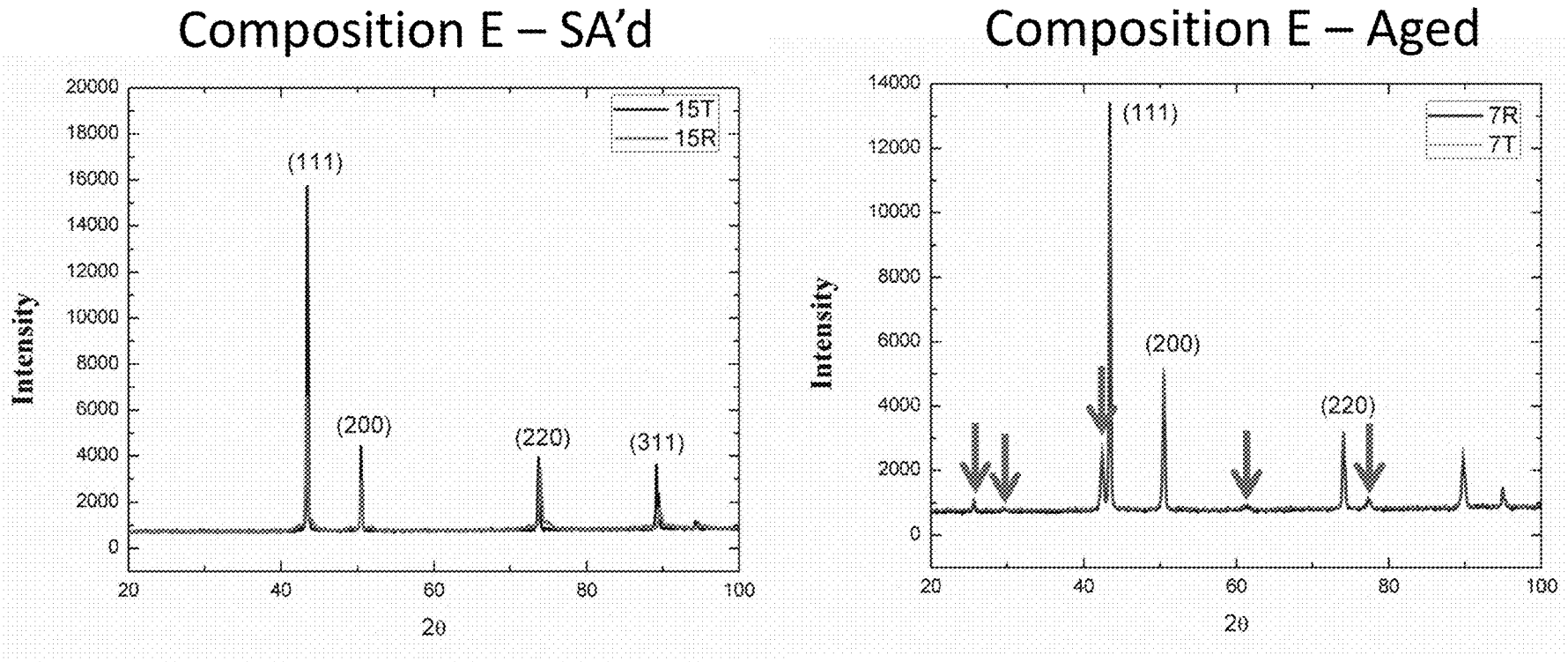
FIG. 58 is a set of two graphs comparing a solution annealed manganese-containing composition (E; unaged) to the same composition after aging, showing a new phase.

FIG. 58 compares Samples 15 and 7 (i.e. Composition E). Composition E also exhibited an FCC structure with about a 3.6 Å lattice parameter in the solution annealed condition (see left). Upon aging composition E, a new FCC phase was apparent with about a 3.0 Å lattice parameter, comprising 10-11% of the structure by weight. The aged sample (Sample 7) has peaks indicating a new phase, marked by arrows in FIG. 58.

Figure 59:
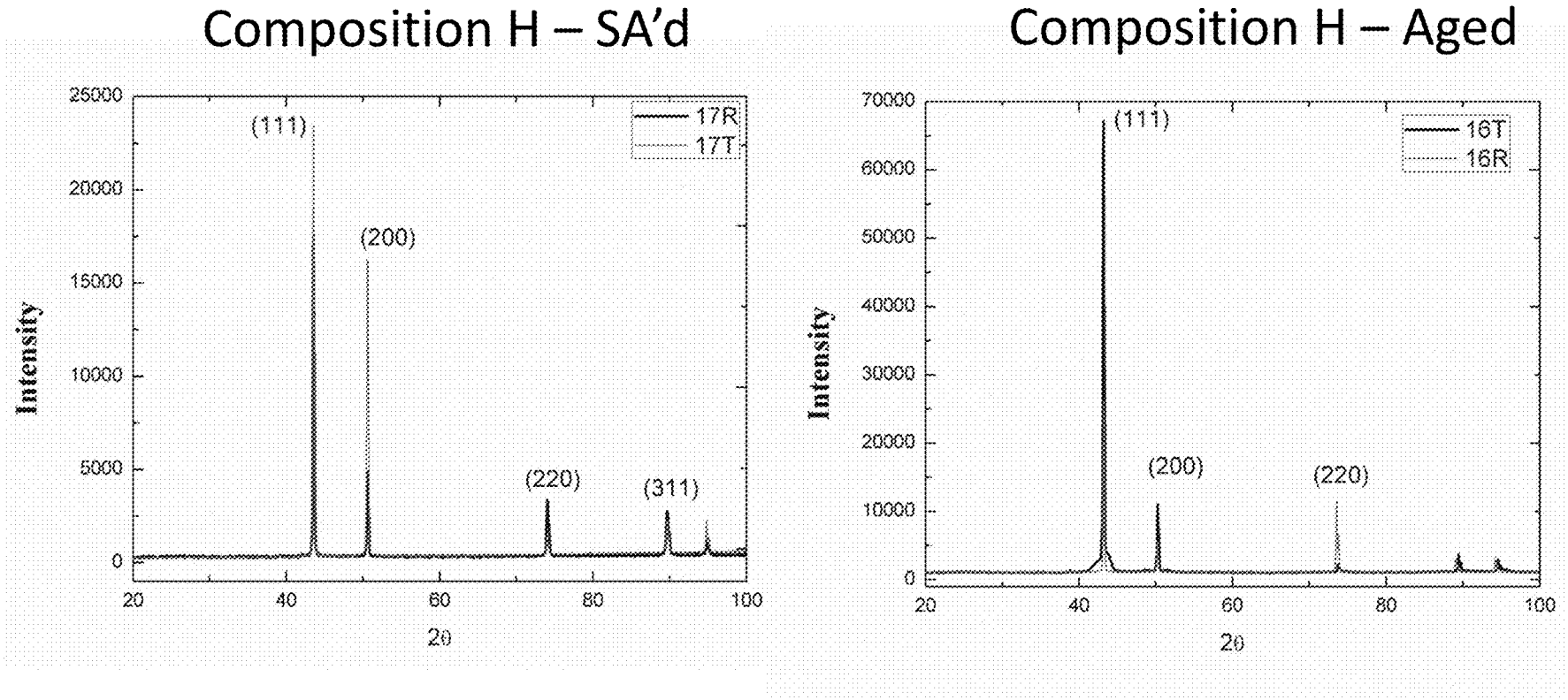
FIG. 59 is a set of two graphs comparing a solution annealed copper-nickel-tin alloy (H; unaged) to the same composition after aging, showing that no new phase has formed by aging (i.e. this alloy is non-magnetic).
Figure 60A:
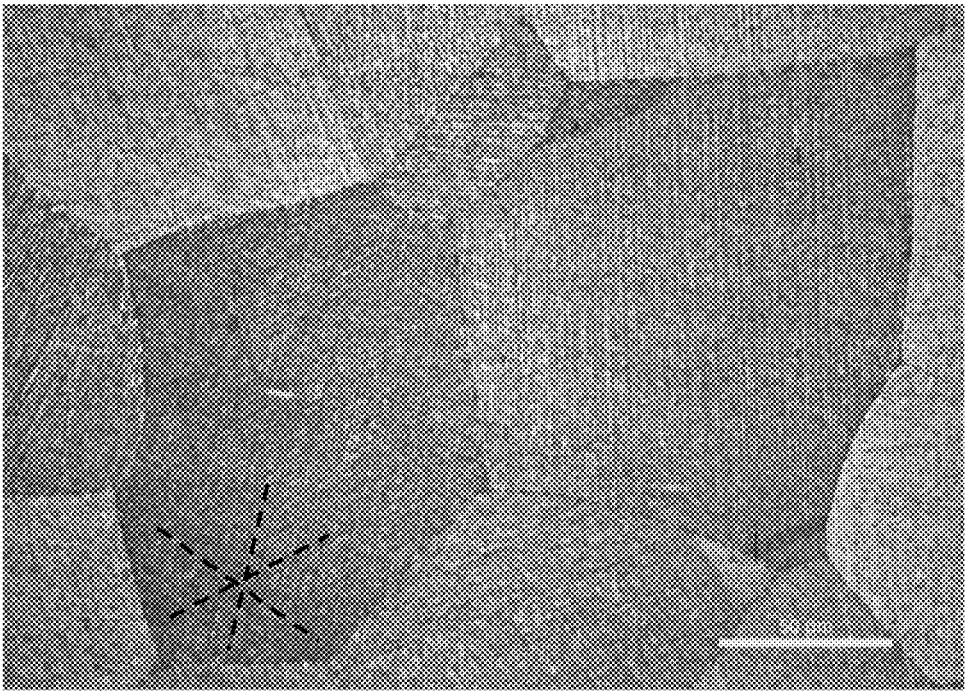
FIGS. 60A-60E are magnified images of the alloys, showing the lines of the precipitates.
Figure 60B:
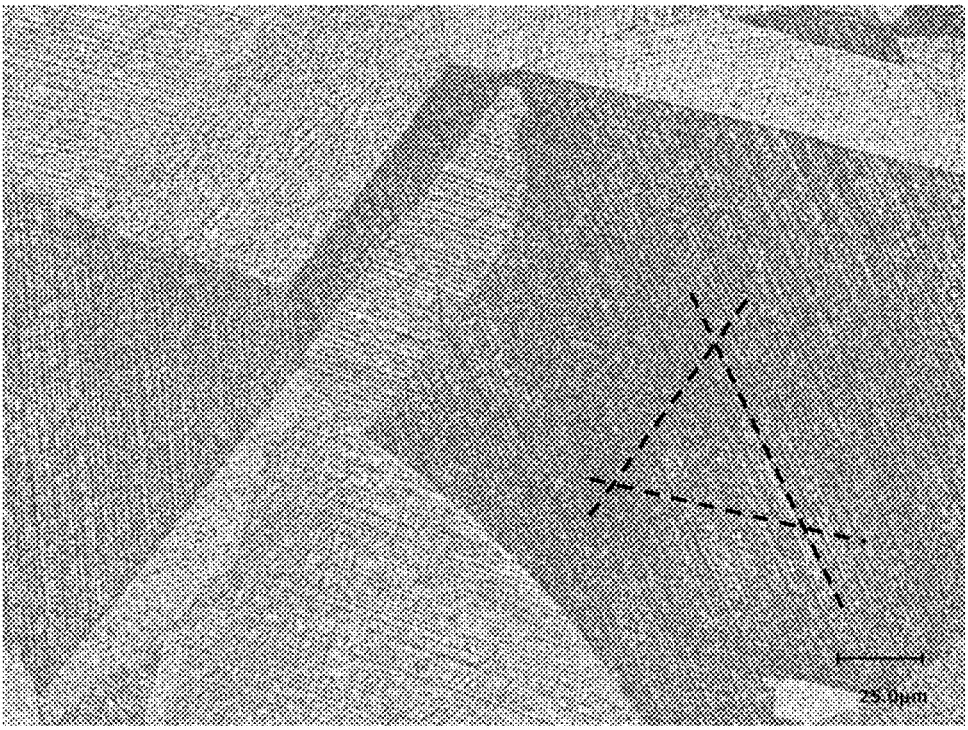
Figure 60C:
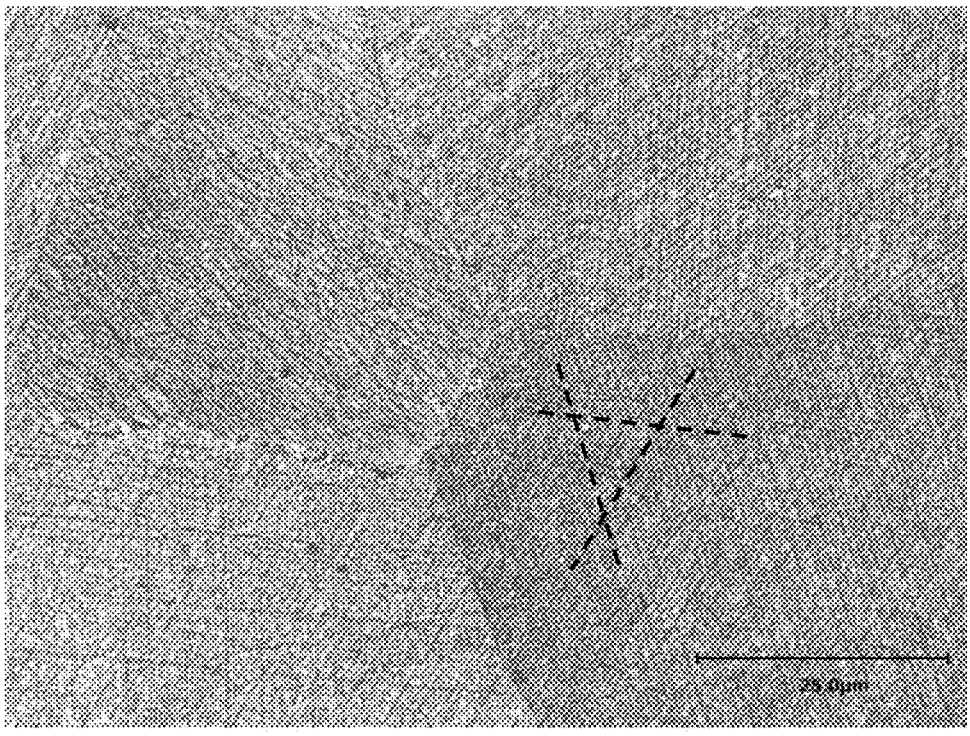
Figure 60D:
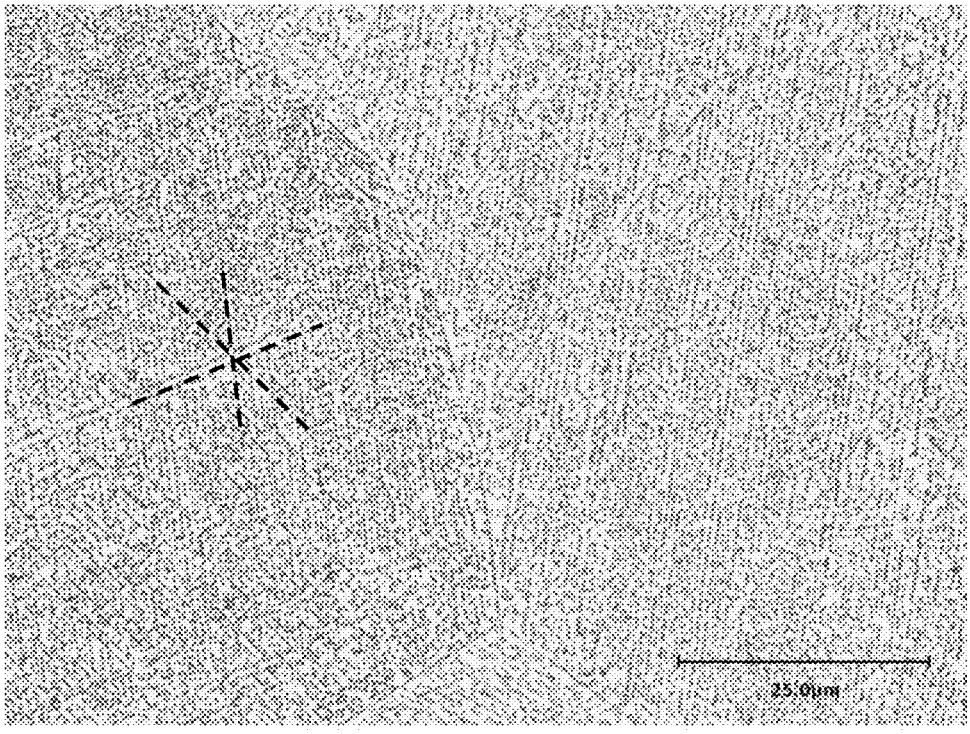
Figure 60E:
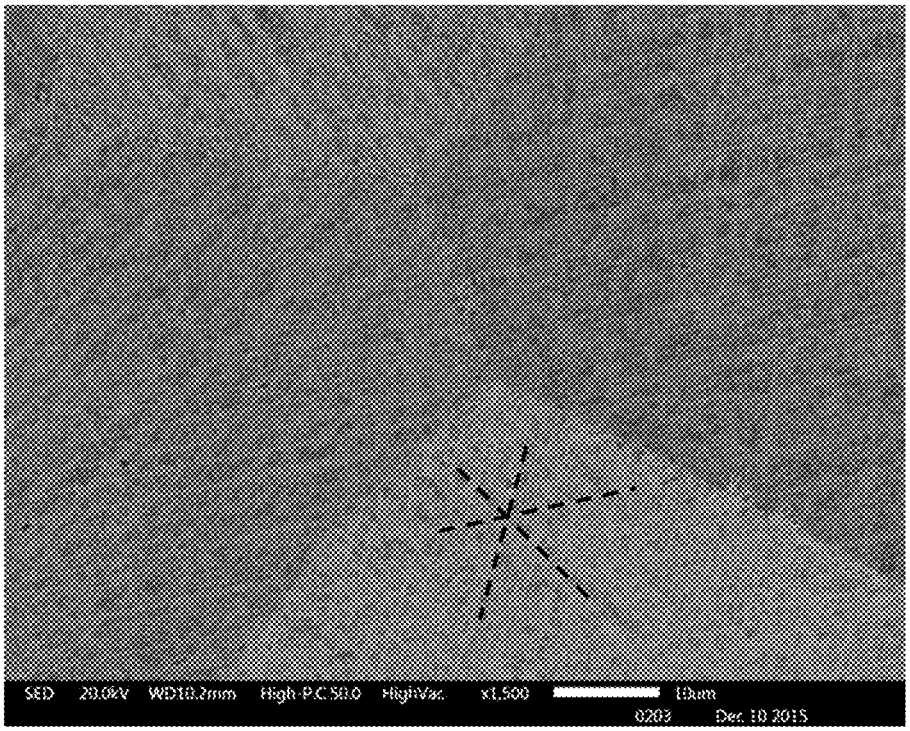
Figure 60F:
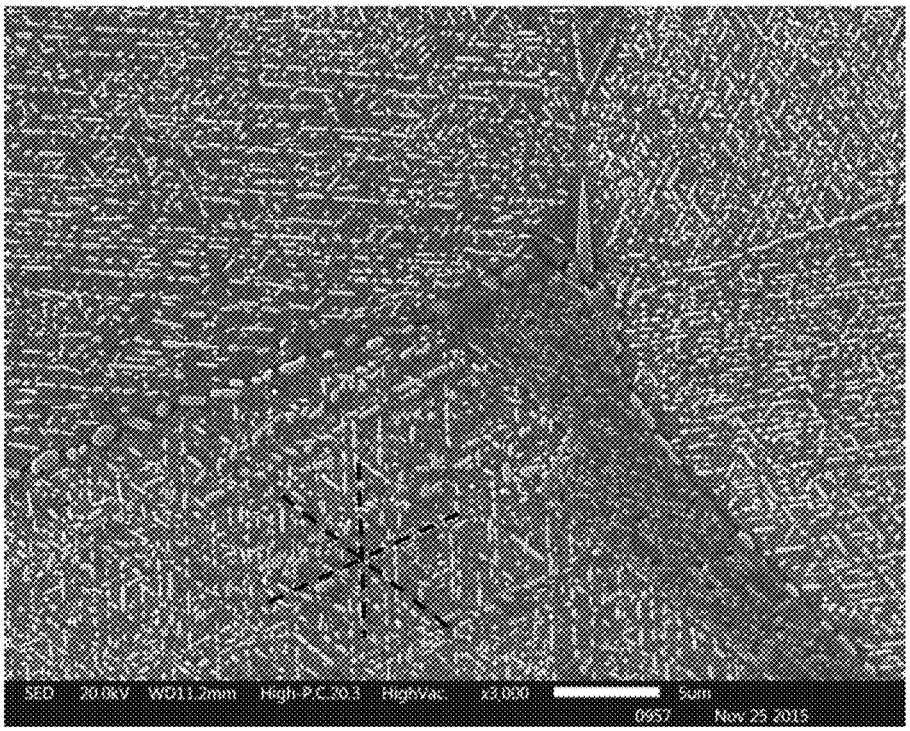
FIG. 60F is the same as FIG. 55C, but with three lines showing the orientation of the precipitates.

Finally, FIG. 59 compares Samples 17 and 16. Composition H exhibited a face-centered cubic (FCC) crystal structure with about a 3.6 angstrom (A) lattice parameter in both the solution annealed and aged conditions. In other words, no new phase is present after aging. In the pairs of spectra shown in FIGS. 57-59, the phases, lattice parameters, and phase percentages were consistent when comparing R and T orientation samples. The new phase identified by XRD in aged compositions A and E relates to the acicular precipitates in a geometrical pattern identified by optical microscopy, CLSM, SEM, and STEM.

Magnetic Attraction Distance (MAD)

Figure 41A:
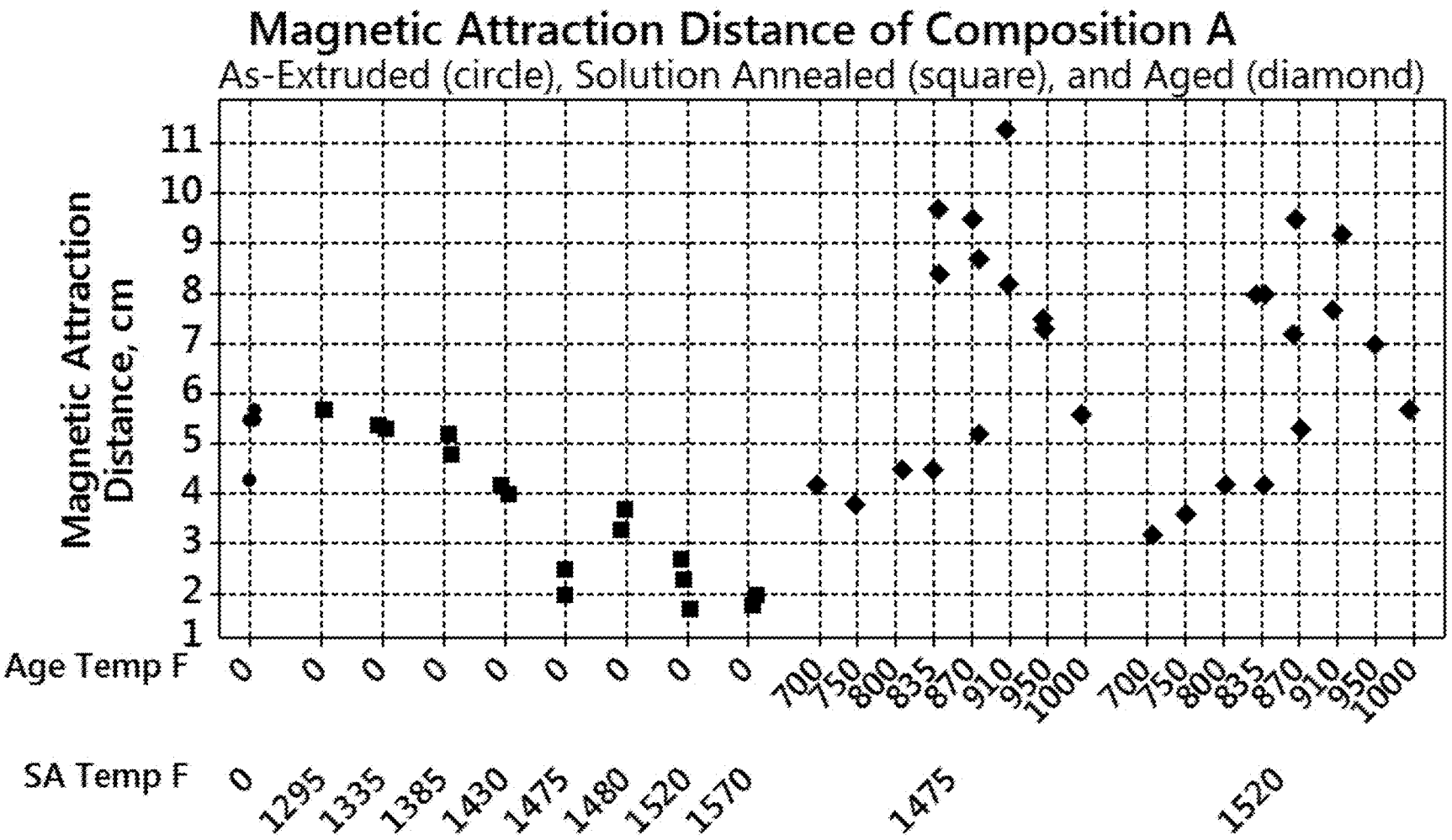
FIG. 41A is a graph showing the magnetic attraction distance for Composition A for different processes.
Figure 41B:
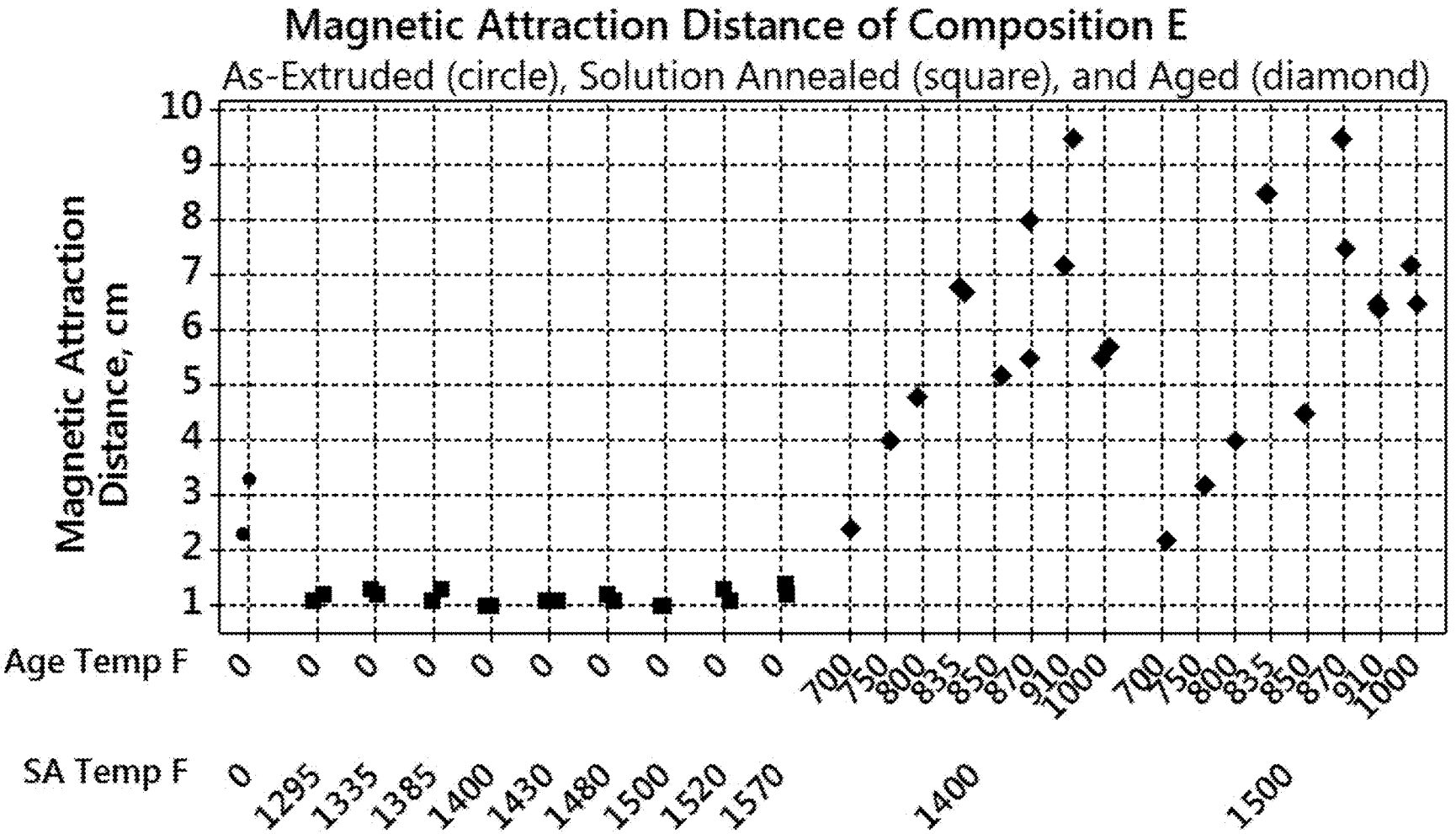
FIG. 41B is a graph showing the magnetic attraction distance for Composition E for different processes.

The MAD of Compositions H, A, and E were measured in the extruded, solution annealed, and aged conditions. Composition H is a non-magnetic alloy (always MAD of 0 cm) capable of aging by spinodal hardening. FIG. 41A shows the magnetic attraction distance (MAD) of Composition A in the as-extruded, solution annealed, and aged conditions. The MAD values are noted to increase dramatically from the solution annealed to the aged conditions. Composition A is an alloy with 11% Mn that appears somewhat magnetic (MAD of 1.7 to 5.7 cm) and has low YS, UTS and hardness in the solution annealed condition, and is more strongly magnetic (MAD values of 3.2 to 11.3 cm) and has increased YS, UTS and hardness in the aged condition. FIG. 41B shows the magnetic attraction distance (MAD) of Composition E in the as-extruded, solution annealed, and aged conditions. Again, the MAD values are noted to increase dramatically from the solution annealed to the aged conditions. Similarly, Composition E is an alloy with 5% Mn that appears slightly magnetic (MAD of 1.0 to 1.4 cm) and has low YS, UTS and hardness in the solution annealed condition, and is more strongly magnetic (MAD values of 2.2 to 9.5 cm) and has increased YS, UTS and hardness in the aged condition.

Summary of Microstructure and Crystal Structure Observations

The microstructure of solution annealed experimental Compositions A-G and baseline Compositions H and J was observed to be austenitic by optical microscopy, and confirmed to have an FCC crystal structure by XRD. The experimental compositions A-G were weakly magnetic in the fully solution-annealed condition. Baseline compositions H and J are non-magnetic (MAD of 0 cm).

Upon aging, experimental Composition C and baseline Compositions H and J remained austenitic. Coincidentally, Composition C is only weakly magnetic in the aged condition, and baseline Compositions H and J are non-magnetic in the aged condition. Conversely, experimental compositions A, B, D, E, F, and G exhibited a new intragranular precipitate in the aged condition. By optical microscopy and lower magnification CLSM, the new precipitate appeared as three sets of dark lines oriented at 60° angles to each other, creating a geometrical pattern. Experimental compositions A, B, D, E, F, and G are notably magnetic (by MAD) in the aged condition.

At magnifications greater than 1,000× in CLSM, SEM, and STEM, the geometrical pattern of the new precipitate was observed to be made up of acicular particles. At a magnification of 50,000× using STEM, the acicular particles appeared to be a flattened rod shape. The crystal structure of this new precipitate (phase) was confirmed to be FCC by XRD. The peak positions of the new precipitate are shifted from those of the parent phase, but the crystallographic planes are the same (both FCC), indicating that the lattice parameters are different.

According to the "ASM Materials Engineering Dictionary", edited by J. R. Davis, published by ASM International in 1982, a 'Widmanstätten structure' is defined as, "A structure characterized by a geometrical pattern resulting from the formation of a new phase along certain crystallographic planes of the parent solid solution. The orientation of the lattice in the new phase is related crystallographically to the orientation of the lattice in the parent phase." The geometrical pattern and FCC crystal structure of the new phase, compared to the FCC crystal structure of the parent phase, suggest that the new phase is distributed in a Widmanstätten pattern. The increase in magnetic behavior by MAD from 'none' or 'weak' to notably magnetic also coincides with the presence of the new intragranular phase in the aged condition, suggesting that the new phase influences the magnetic behavior of experimental compositions A, B, D, E, F, and G.

When developing peak or overaged properties in compositions with a manganese content greater than 2 percent, there is a tendency for the new precipitate to become prominently present. The new precipitate appears to be uniformly distributed within the grains (i.e. intragranularly). In a metallographic planar view, three principal directions of "lines" are seen, undoubtedly linked to the crystallography. At moderate magnifications (>1,000×), the geometrical pattern of lines is revealed to be comprised of precipitates of acicular bars. At moderate magnifications, the acicular precipitates appear somewhat oval in cross-section, but at high magnifications (>30,000×), the cross-section of the acicular precipitates appears to be more faceted, possibly rectangular or parallelogram-shaped. In cross-section, the precipitates have a width-to-thickness aspect ratio of about 1:1 to about 3:1. The precipitates have a length-to-thickness aspect ratio of about 9:1. It should be noted the precipitates are not platelet, spheroid, lathe, or cuboid in shape.

Fifth Set of Examples

The characterization of basic magnetic properties can be conducted using vibrating sample magnetometry (VSM). During VSM, a magnetic field is applied to the vibrating sample using an electromagnet, and the magnetic moment of the sample can be calculated from the induced voltage in the pickup coil. A sample's magnetic hysteresis behavior can be determined as a magnetic field is applied, first in one direction, and then reversed to the opposite direction. Some key properties that are derived from a magnetic hysteresis loop are: (1) the maximum magnetic moment at saturation, $m_s$; (2) the "remanence", $m_r$, the remanent magnetic moment of the sample after the external magnetic field is removed (or a sample's ability to keep its magnetization); and (3) the "coercivity", $H_c$, the magnetic field strength or magnetizing force required to demagnetize the sample. Other magnetic characteristics may be derived from these key properties, such as squareness ($m_r/m_s$) and switching field distribution (SFD; $\Delta H/H_c$).

Rolled plate and extruded rod, both in the aged condition, were screened using MAD and select samples were tested by VSM in 3 orientations. The samples represented 5 compositions, in 2 forms (plate and rod), and a variety of processing parameters. For the extruded rod, the samples originated from the mid-radius, and were properly oriented to the 3 principle directions (longitudinal, transverse, and radial). Samples 1-13 are identified in Table F below. "SA Temp" refers to the solution annealing temperature. "CR" refers to the percentage of cold rolling.

TABLE F

| ID No. | Composition | Form | Density (g/cc) | Magnetic Attraction Distance (cm) | SA Temp (° F.) | CR (%) | Age Temp (° F.) |
|---|---|---|---|---|---|---|---|
| 1 | A | Rod | | 9.7 | 1475 | 0 | 835 |
| 2 | A | Rod | | 9.5 | 1520 | 0 | 870 |
| 3 | E | Rod | 8.78 | 9.5 | 1500 | 0 | 870 |
| 4 | G | Rod | 8.62 | 8.5 | 1400 | 0 | 850 |
| 5 | G | Rod | 8.65 | 8.5 | 1500 | 0 | 850 |
| 6 | A | Rod | 8.61 | 11.3 | 1475 | 0 | 910 |
| 7 | E | Rod | 8.78 | 9.5 | 1400 | 0 | 910 |
| 8 | A | Plate | 8.66 | 8.8 | 1525 | 0 | 900 |
| 9 | A | Plate | 8.61 | 6.7 | 1525 | 21 | 800 |
| 10 | D | Plate | 8.23 | 6.9 | 1400 | 21 | 800 |
| 11 | E | Plate | 8.83 | 7.3 | 1525 | 21 | 900 |
| 12 | F | Plate | 8.17 | 7.6 | 1400 | 21 | 800 |
| 13 | A | Plate | | 7.2 | 1525 | 37 | 900 |

Figure 42:
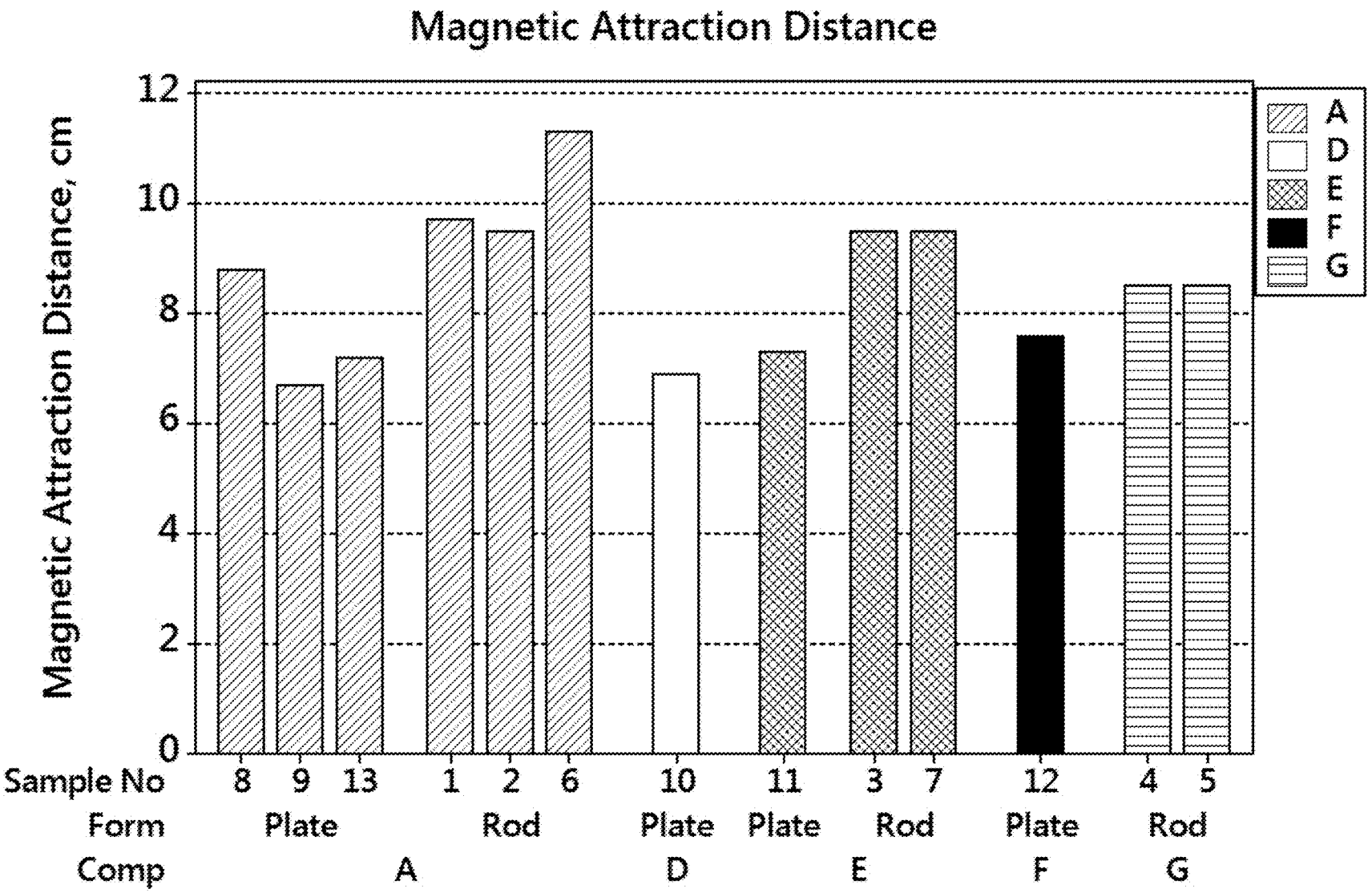
FIG. 42 is a graph showing the magnetic attraction distance for various forms (rod, rolled plate) and compositions.

FIG. 42 is a bar graph showing the magnetic attraction distances organized by both form (rod/plate) and by composition. As seen here, generally the rod form had higher magnetic attraction distances than the plate form.

Figure 43:
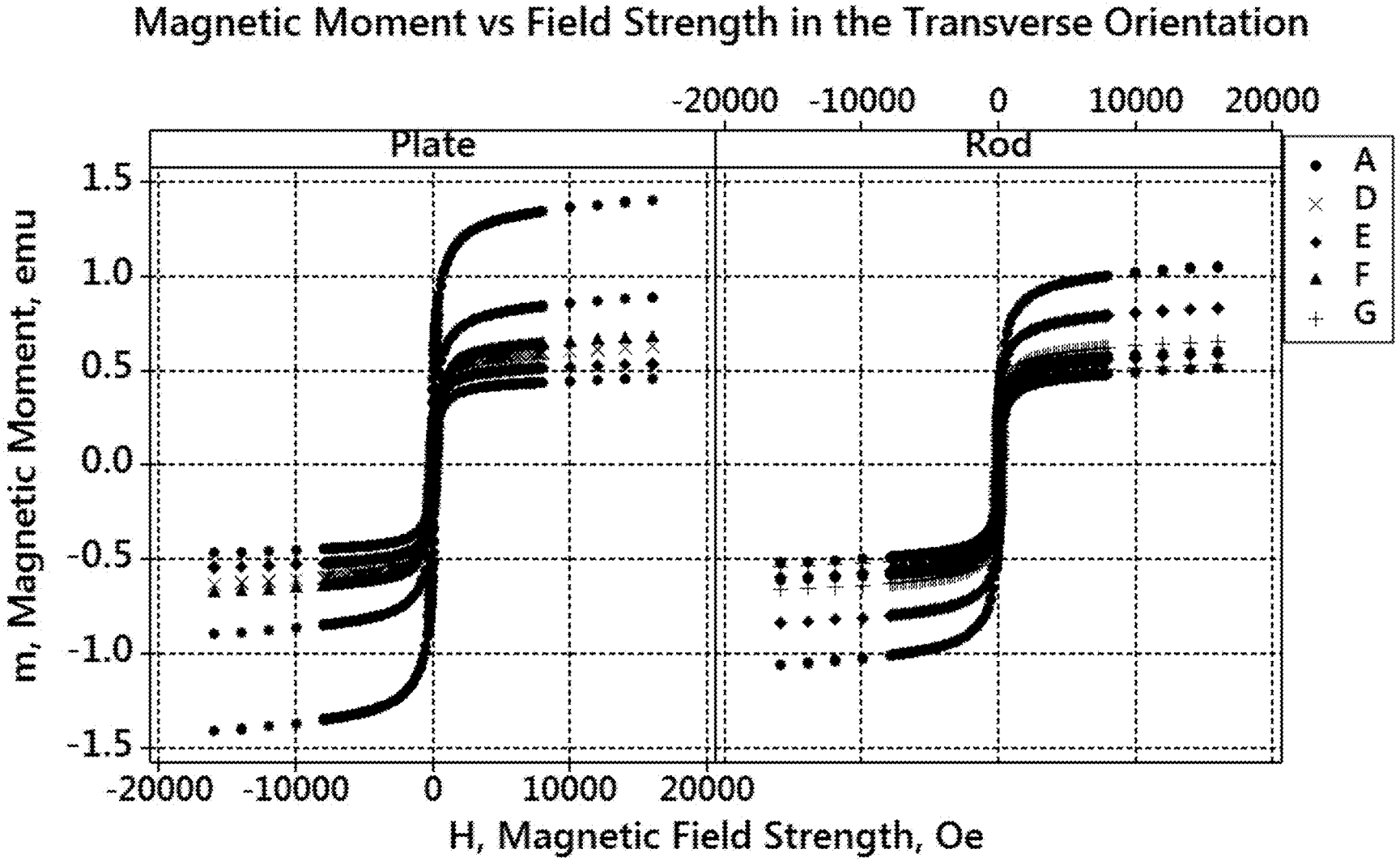
FIG. 43 is a set of two graphs showing the magnetic moment (emu) versus applied magnetic field strength for the samples of FIG. 42 categorized by the form (rod vs. plate).

The hysteresis loops were fairly similar in the longitudinal, transverse, and perpendicular (radial) orientations. For simplicity, only the data for the transverse orientation is presented. FIG. 43 is a graph showing the magnetic moment (m, in emu) versus the magnetic field strength (H, in Oersted) for each sample, i.e. the hysteresis curves, categorized by the form (rod vs. plate). All samples exhibited measurable magnetic behavior, and showed narrow hysteresis loops, which suggest that little energy is lost when reversing the magnetizing force (applied field).

Figure 44:
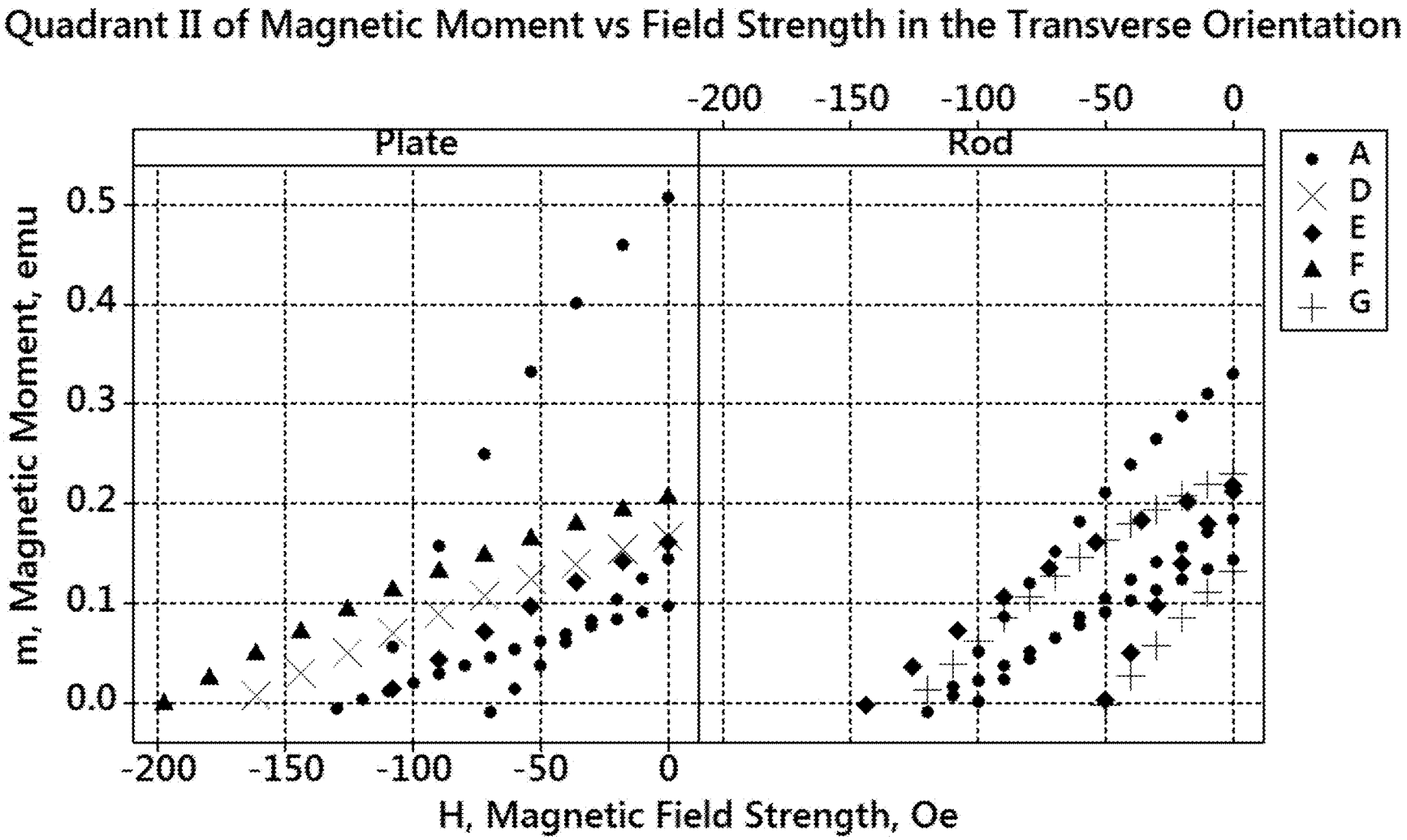
FIG. 44 is a set of two graphs showing the demagnetization curve (Quadrant II) for the samples of FIG. 42 categorized by the form (rod vs. plate).

A popular way to show the key magnetic properties is to plot only the second quadrant of a hysteresis loop. The data in this quadrant is called the "demagnetization curve" for the material, and contains the basic property information of the material's remanence and coercivity. The remanence or remanent magnetic moment ($m_r$) is where the curve crosses the y-axis, and the coercivity ($H_c$) is the absolute value of where the curve crosses the x-axis. FIG. 44 is a set of two graphs showing the demagnetization curves for the samples separated by the form (rod vs. plate). Table G below lists magnetic properties in the transverse orientation for one sample with the highest remanence from each of the 5 compositions ("Comp") tested (regardless of sample form and processing), along with the other key properties. "$m_s$" is the maximum magnetic moment at saturation. "SQ" is the squareness. "Sigma" is the maximum magnetic moment at saturation per unit mass. "SFD" is the switching field distribution. "MAD" is the associated magnetic attraction distance.

TABLE G

| Comp | ID No. | Form | $m_r$ (emu) | $H_c$ (Oe) | $m_s$ (emu) | SQ ($m_r/m_s$) | Sigma (emu/g) | SFD ($\Delta H/H_c$) | MAD (cm) |
|---|---|---|---|---|---|---|---|---|---|
| A | 8 | Plate | 0.5087 | 117.9 | 1.406 | 0.3619 | 8.688 | 0.7896 | 8.8 |
| D | 10 | Plate | 0.1679 | 167.8 | 0.6299 | 0.2666 | 6.644 | 0.8043 | 6.9 |
| E | 7 | Rod | 0.2185 | 142.9 | 0.5912 | 0.3696 | 5.010 | 0.7354 | 9.5 |
| F | 12 | Plate | 0.2069 | 197.8 | 0.6797 | 0.3044 | 6.247 | 0.7601 | 7.6 |
| G | 4 | Rod | 0.2309 | 125.4 | 0.6567 | 0.3516 | 4.800 | 0.7646 | 8.5 |

Figure 45:
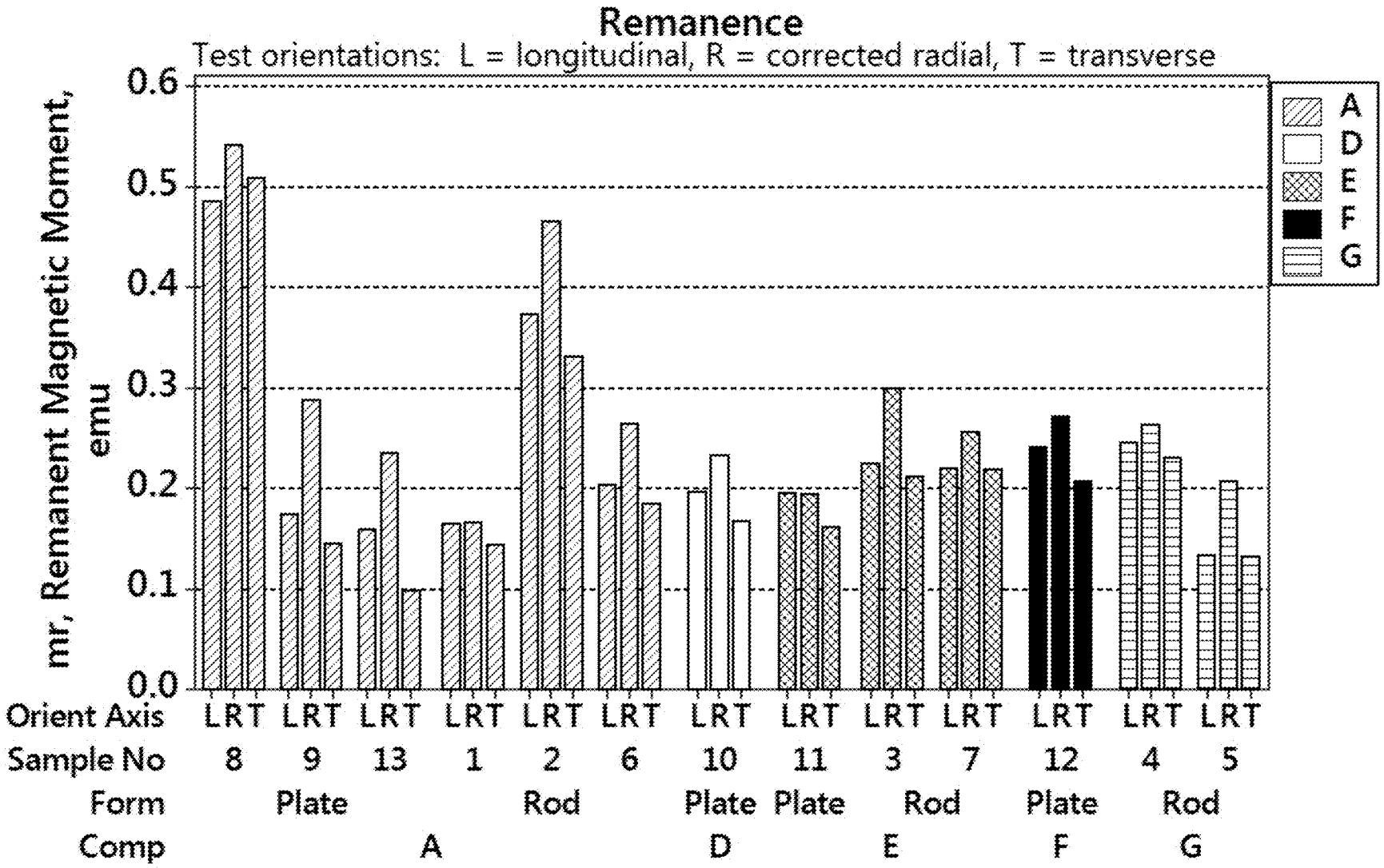
FIG. 45 is a bar graph showing the remanence, or remnant magnetic moment, for the samples of FIG. 42.
Figure 46:
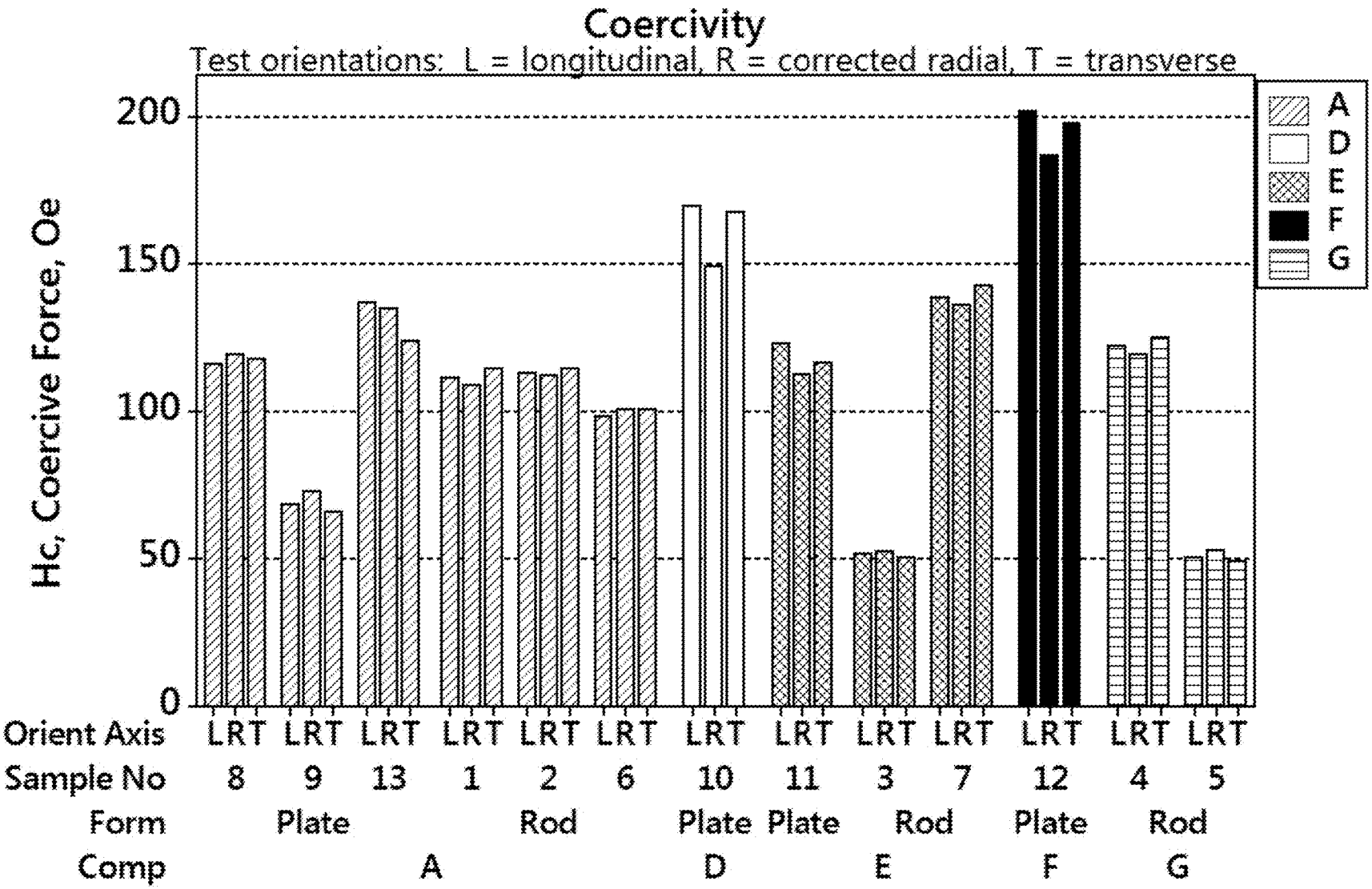
FIG. 46 is a bar graph showing the coercivity, or coercive force (Oersted), for the samples of FIG. 42.
Figure 47:
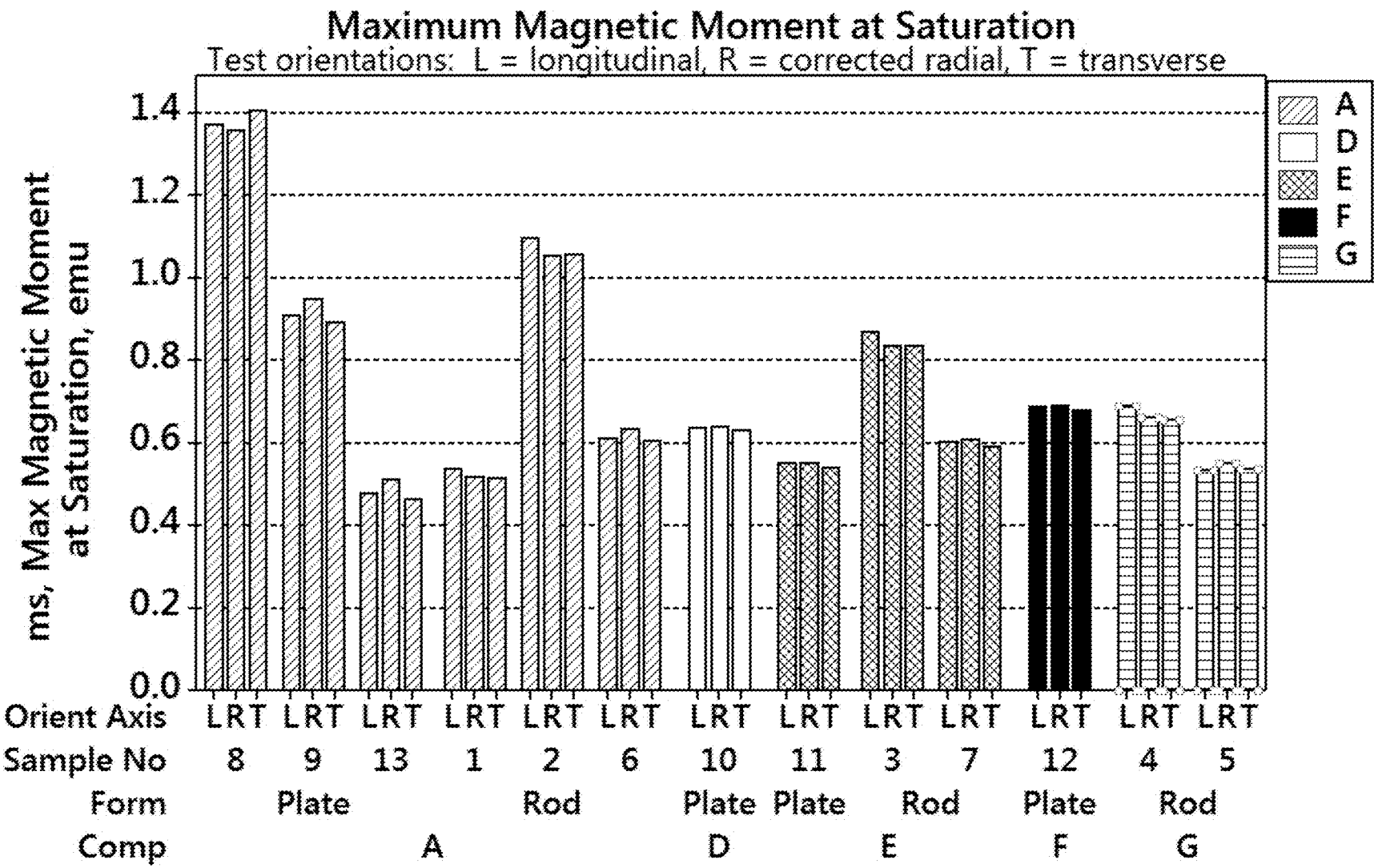
FIG. 47 is a bar graph showing the maximum magnetic moment at saturation (emu) for the samples of FIG. 42.
Figure 48:
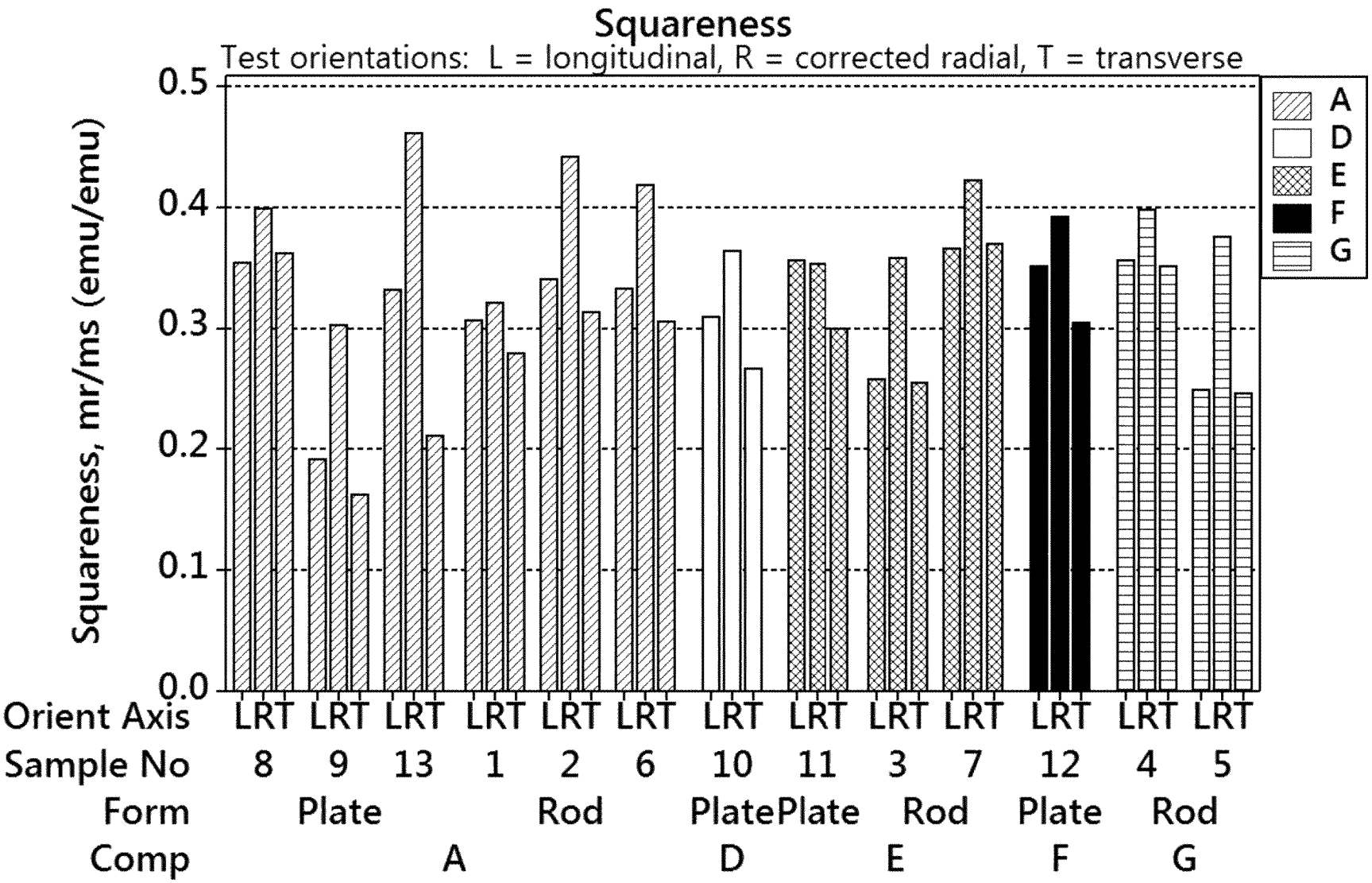
FIG. 48 is a bar graph showing the squareness (remanence divided by maximum magnetic moment at saturation) for the samples of FIG. 42.
Figure 49:
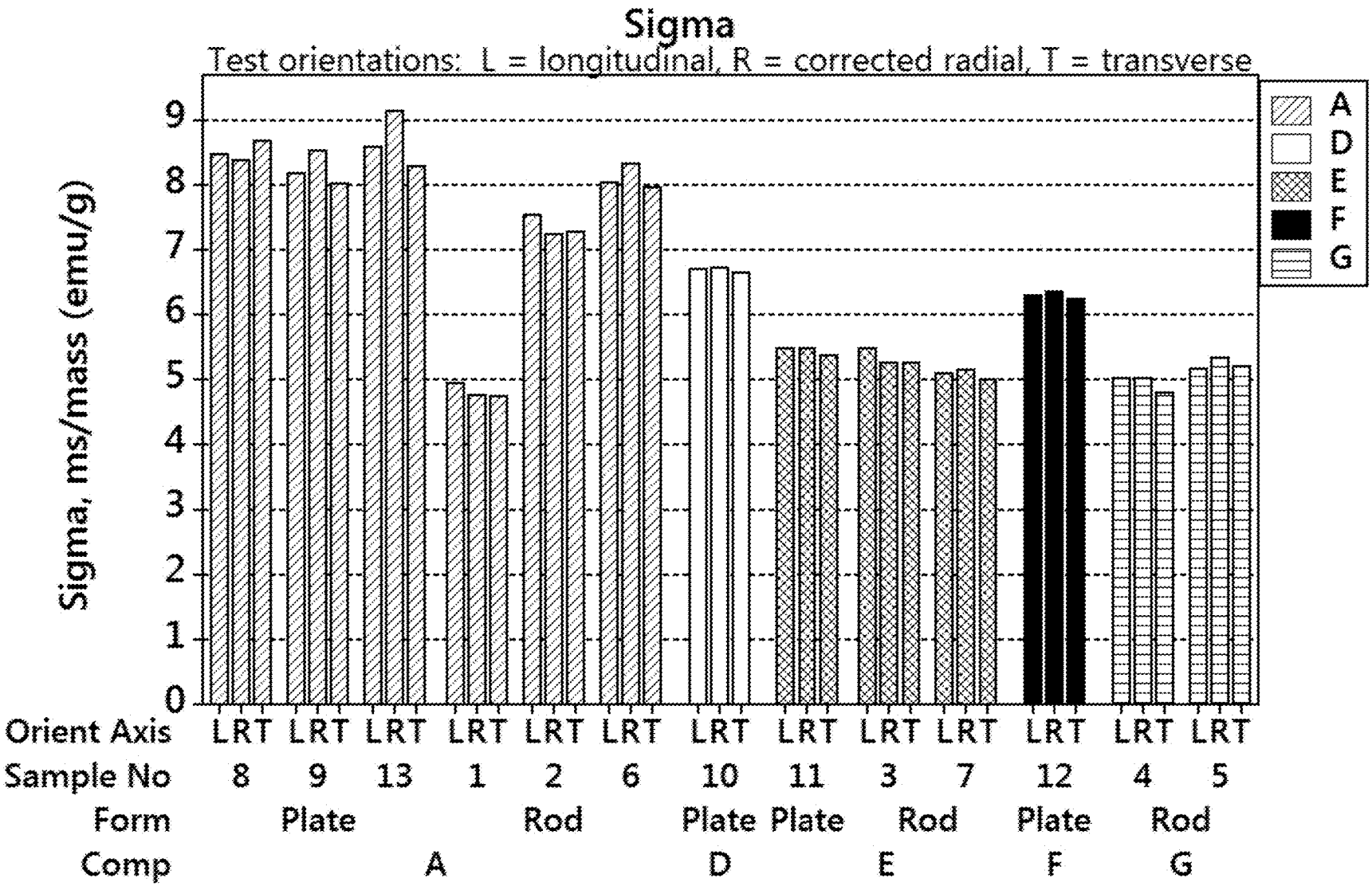
FIG. 49 is a bar graph showing Sigma (maximum magnetic moment at saturation divided by mass) for the samples of FIG. 42.
Figure 50:
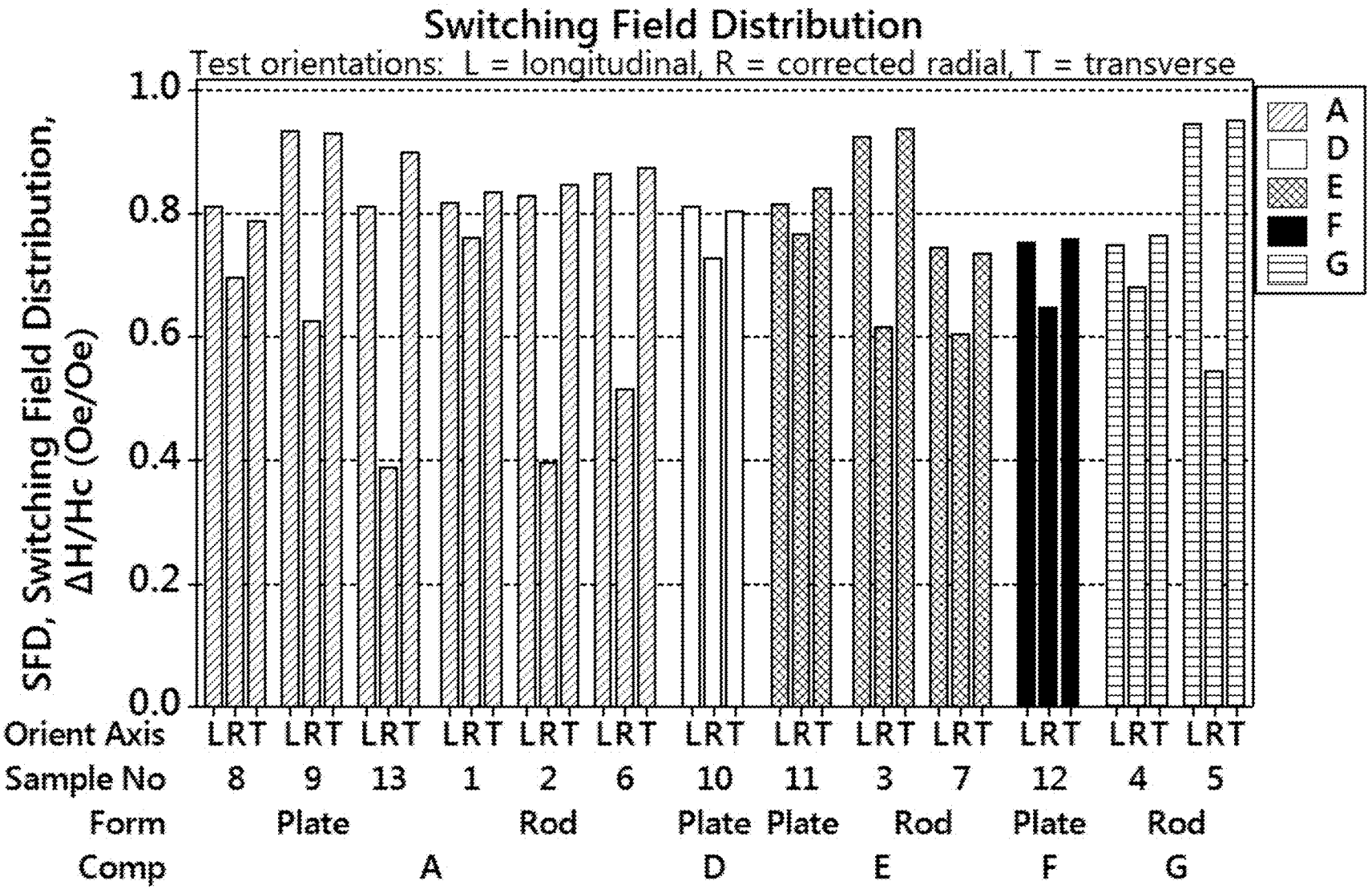
FIG. 50 is a bar graph showing the switching field distribution (ΔH/Hc) for the samples of FIG. 42.

FIGS. 45-50 are bar graphs showing various measurements for the samples listed in Table F, in all three orientations (longitudinal, radial, and transverse). FIG. 45 is a bar graph showing the remanence or remanent magnetic moment ($m_r$) for the samples. The values ranged from about 0.1 emu to about 0.6 emu. FIG. 46 is a bar graph showing the coercivity ($H_c$) for the samples. The values ranged from about 45 Oersteds to about 210 Oersteds. FIG. 47 is a bar graph showing the maximum magnetic moment at saturation ($m_e$) for the samples. The values ranged from about 0.4 emu to about 1.5 emu. FIG. 48 is a bar graph showing the squareness for the samples. The values ranged from about 0.1 to about 0.5. FIG. 49 is a bar graph showing the Sigma for the samples. The values ranged from about 4.5 emu/g to about 9.5 emu/g. FIG. 50 is a bar graph showing the switching field distribution (ΔH/Hc) for the samples. The values ranged from about 0.3 to about 1.0.

Curie Temperature Data

VSM was also used to determine the Curie temperature of the plate and rod samples. The Curie temperature is the temperature in which a ferromagnetic material becomes paramagnetic. Before thermomagnetic testing, the samples were magnetized in a high magnetic field of 72 kiloOersted (kOe) in the longitudinal axis. Each sample was placed in a vacuum or an inert protective environment while the sample was heated from room temperature to 1650° F. in a +10 kOe magnetic field applied in the longitudinal direction. Magnetization (M) was recorded as a function of temperature (T). The resulting M-T thermomagnetic curves were used to estimate the Curie temperature. The error in the Curie temperature is up to ±40° F. A table of the estimated Curie temperature is shown in Table G. Note that samples 10 and 12 (composition D and F plate samples, respectively) melted during the test.

TABLE G

| ID No. | Composition | Form | Estimated Curie Temperature, ° F. |
|---|---|---|---|
| 6 | A | Rod | 174 |
| 8 | A | Plate | 176 |
| 9 | A | Plate | 176 |
| 10 | D* | Plate | 203 |
| 3 | E | Rod | 176 |
| 7 | E | Rod | 172 |
| 11 | E | Plate | 162 |
| 12 | F* | Plate | 203 |
| 4 | G | Rod | 189 |
| 5 | G | Rod | 172 |

*Samples melted during testing

Sixth Set of Examples

Some copper-nickel-tin-manganese-cobalt alloys were made. As listed in Table H below, two cobalt-containing alloys were found to be magnetic in the as-cast condition. Thus, the presence of cobalt was not detrimental to magnetism.

TABLE H

| Composition | Cu (wt %) | Ni (wt %) | Sn (wt %) | Mn (wt %) | Co (wt %) | Magnetic? |
|---|---|---|---|---|---|---|
| F | 65 | 9 | 6 | 20 | 0 | Y |
| F6 | 68 | 9 | 3 | 20 | 13 | Y |
| F7 | 68 | 8 | 4 | 20 | 1 | Y |

Seventh Set of Examples

Selected aged samples of two compositions were heat treated in the presence of powerful rare earth magnets. In doing so, the material is thermally treated in a uniform magnetic field. It is believed that this process reinforces the orientation of the magnetic domains at elevated temperature, thereby enhancing the magnetic properties at room temperature. The samples were oriented parallel to a uniform magnetic field of 3000 gauss. Samples were heated, held for about 20 minutes, and then slowly cooled to room temperature. The samples were then tested in the longitudinal orientation using VSM.

When magnetic treatment was specified, two treatments were performed on each composition, one in which the magnetic field was applied as described above, and one in which no magnetic field was applied. Heat treatment conditions included those below and above the respective Curie temperatures, and at several elevated temperatures. Sample ID No. 12 was made of Composition F, which had relatively high $m_s$, $m_r$, and $H_c$, and also had a very high Mn concentration. Sample ID No. 13 was made of Composition A, which had a moderately high $H_c$ and a moderate Mn concentration. At heat treatment conditions about 120° F. below and about 300° F. above the respective Curie temperatures, and at about 212° F., about 345° F., and about 570° F., very little difference (about 0-12% change) in the magnetic properties was found between those treated in an applied magnetic field, and those treated without an applied magnetic field. After heat treating at about 930° F., changes were noted in the magnetic properties for both the heat treated samples (in no magnetic field), and the samples heat treated in a magnetic field, when compared to the pre-treated state. The results are shown in Table I.

TABLE I

| ID No. | Composition | Magnetic field? | Change in $m_r$ | Change in $m_s$ | Change in $H_c$ |
|---|---|---|---|---|---|
| 12 | F | N | −93% | −83% | −75% |
| 12 | F | Y | −97% | −72% | −90% |
| 13 | A | N | −82% | −25% | −81% |
| 13 | A | Y | −54% | −12% | −66% |

As seen here, the magnetic characteristics were diminished significantly by the treatment temperature alone. For Composition A, the magnetic properties exhibit a greater change without the magnetic field applied, and a lesser change with the magnetic field applied, compared to the pre-treated state. The results are mixed for Composition F. This suggests a thermal change in the crystalline structure is taking place. The magnetic properties of the alloys can thus be a function of the alloy composition as well as the temperature and magnetic field presence during manufacturing.

This also suggests that the magnetic copper alloys of the present disclosure might be suitable for Heat Assisted Magnetic Recording (HAMR). In HAMR, a heat source is momentarily applied to the recording media (disk) to reduce the coercivity below the applied magnetic field of the recording head. This allows for higher anisotropy and smaller grains on the storage media. The heated zone is then rapidly cooled in the presence of the applied field orientation, encoding the recorded data. The heat source, typically a laser, generates just enough heat directly in front of the head during the writing process to allow the magnetic field of the head to "switch" the orientation of the grains within the media.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A magnetic copper alloy, comprising:

about 14 wt % to about 16 wt % nickel, about 7 wt % to about 9 wt % tin, at least 5 wt % to about 21 wt % manganese, and balance copper;

wherein the alloy is magnetic, as indicated by a relative magnetic permeability (μr) of at least 1.100; and wherein the magnetic copper alloy is formed by:

casting the alloy;

homogenizing the alloy for a first time period of about 4 hours to about 22 hours at a temperature of about 1200° F. to about 1700° F.;

heating the alloy for a time period of about 1 hour to about 3 hours at a temperature of about 1400° F. to about 1600° F.;

hot rolling the alloy to achieve a reduction of about 65% to about 70%; and solution annealing the alloy for a time period of about 1 hour to about 3 hours at a temperature of about 1200° F. to about 1600° F.

2. The magnetic copper alloy of claim 1, containing from at least 5 wt % to about 12 wt % manganese.

3. The magnetic copper alloy of claim 1, wherein the magnetic alloy has a relative magnetic permeability (μr) of at least 1.500.

4. The magnetic copper alloy of claim 1, wherein the magnetic alloy has an electrical conductivity (% IACS) of from about 1.5% to about 15%.

5. The magnetic copper alloy of claim 1, wherein the magnetic alloy has a Rockwell hardness B (HRB) of at least 60.

6. The magnetic copper alloy of claim 1, wherein the magnetic alloy has a Rockwell hardness C (HRC) of at least 25.

7. The magnetic copper alloy of claim 1, wherein the magnetic alloy has a relative magnetic permeability (μr) of at least 1.100, and a Rockwell hardness B (HRB) of at least 60.

8. The magnetic copper alloy of claim 1, wherein the magnetic alloy has a relative magnetic permeability (μr) of at least 1.100, and a Rockwell hardness C (HRC) of at least 25.

9. The magnetic copper alloy of claim 1, wherein the homogenizing occurs for a time period of about 4 hours to about 16 hours at a temperature of about 1400° F. to about 1700° F., and the alloy is then water quenched.

10. The magnetic copper alloy of claim 9, wherein the alloy is further formed by a second homogenizing for a time period of about 8 hours to about 12 hours at a temperature of about 1500° F. to about 1600° F. and then water quenching.

11. The magnetic copper alloy of claim 9, wherein the alloy is further formed by hot upsetting the alloy to about 40% to about 60% reduction prior to water quenching.

12. The magnetic copper alloy of claim 1, wherein the homogenizing occurs for a first time period of about 5 hours to about 7 hours at a temperature of about 1500° F. to about 1700° F., and the alloy is then air cooled.

13. The magnetic copper alloy of claim 1, wherein:

the alloy is homogenized for a first time period of about 5 hours to about 7 hours at a first temperature of about 1500° F. to about 1700° F. and then air cooled;

the alloy is heated for a time period of about 1 hour to about 3 hours at a temperature of about 1400° F. to about 1600° F.;

the alloy is hot rolled to achieve a reduction of about 65% to about 70%;

the alloy is solution annealed for a time period of about 4 hours to about 6 hours at a temperature of about 1400° F. to about 1600° F.; and wherein the forming further comprises cooling the annealed alloy by either furnace cooling or water quenching.

14. The magnetic copper alloy of claim 13, wherein the alloy is further formed by aging the alloy for a time period of about 1 hour to about 24 hours at a temperature of about 750° F. to about 850° F. and then air cooling.

15. The magnetic copper alloy of claim 1, having a nickel content of about 8 wt % to about 12 wt % and a tin content of about 5 wt % to about 7 wt %.

16. The magnetic copper alloy of claim 1, wherein the alloy is further treated by aging the alloy for a time period of about 2 hours to about 4 hours at a temperature of about 750° F. to about 1200° F. and then air cooling.

17. The magnetic copper alloy of claim 1, wherein the alloy is further treated by cold rolling the alloy to achieve a reduction of about 20% to about 40%.

18. The magnetic copper alloy of claim 17, wherein the alloy is further treated by aging the alloy for a time period of about 2 hours to about 4 hours at a temperature of about 750° F. to about 1200° F. and then air cooling.

19. The magnetic copper alloy of claim 1, wherein the alloy in an aged condition exhibits a higher magnetic attraction distance than in a solution annealed condition.

20. The magnetic copper alloy of claim 1, wherein the alloy has a 0.2% offset yield strength of about 20 ksi to about 140 ksi.

21. The magnetic copper alloy of claim 1, wherein the alloy has an ultimate tensile strength of about 60 ksi to about 150 ksi.

22. The magnetic copper alloy of claim 1, wherein the alloy has a tensile elongation of about 4% to about 70%.

23. The magnetic copper alloy of claim 1, wherein the alloy has a Rockwell B hardness of at least 60 or a Rockwell C hardness of at least 25.

24. The magnetic copper alloy of claim 1, wherein the alloy has a 0.2% offset yield strength of about 20 ksi to about 140 ksi; an ultimate tensile strength of about 60 ksi to about 150 ksi; and a tensile elongation of about 4% to about 70%.

25. The magnetic copper alloy of claim 1, wherein the alloy has a magnetic attraction distance of about 0.5 centimeters to about 11.5 centimeters.

26. The magnetic copper alloy of claim 1, wherein the alloy has a magnetic attraction distance of at least 6 centimeters.

27. The magnetic copper alloy of claim 1, wherein the alloy has a maximum magnetic moment at saturation of at least 0.4 emu.

28. The magnetic copper alloy of claim 1, wherein the alloy has a coercivity of at least 100 Oersted.

29. The magnetic copper alloy of claim 1, wherein the alloy has a coercivity of less than 100 Oersted.

30. The magnetic copper alloy of claim 1, wherein the alloy is formed by adding nickel, tin, and manganese to a molten copper batch; or wherein the alloy is made by forming a mixture or copper, nickel, tin and manganese, and then melting the mixture.

31. The magnetic copper alloy of claim 1, wherein the alloy further comprises cobalt in an amount of up to about 15 wt %.

32. An article formed from the magnetic copper alloy of claim 1.

33. The article of claim 32, wherein the article is a strip, rod, tube, wire, bar, plate, shape, or spring, or is a magnetic shield, a magnetic switch relay, a component of a magnetic sensor, or a separator between magnetic materials, or an acoustically damping device, or is a strip, a wire, a thin film, a temperature or positional control device.

* * * * *